US012595575B2

(12) United States Patent
Singh et al.

(10) Patent No.: US 12,595,575 B2
(45) Date of Patent: Apr. 7, 2026

(54) ELECTROCHEMICAL OXIDATION OF METHANE TOWARDS METHANOL ON MIXED METAL OXIDES

(71) Applicant: THE BOARD OF TRUSTEES OF THE UNIVERSITY OF ILLINOIS, Urbana, IL (US)

(72) Inventors: Meenesh R. Singh, Naperville, IL (US); Aditya Prajapati, Chicago, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 138 days.

(21) Appl. No.: 18/273,381

(22) PCT Filed: Jan. 27, 2022

(86) PCT No.: PCT/US2022/013997
§ 371 (c)(1),
(2) Date: Jul. 20, 2023

(87) PCT Pub. No.: WO2022/164965
PCT Pub. Date: Aug. 4, 2022

(65) Prior Publication Data

US 2024/0309518 A1 Sep. 19, 2024

Related U.S. Application Data

(60) Provisional application No. 63/142,425, filed on Jan. 27, 2021.

(51) Int. Cl.
*C25B 3/00* (2021.01)
*C25B 3/07* (2021.01)
(Continued)

(52) U.S. Cl.
CPC ..... *C25B 3/07* (2021.01); *C25B 3/23* (2021.01); *C25B 9/15* (2021.01); *C25B 9/19* (2021.01);
(Continued)

(58) Field of Classification Search
CPC ..... C25B 3/07; C25B 11/089; C25B 11/032; C25B 11/054; C25B 9/19; C25B 3/23; C25B 9/15
See application file for complete search history.

(56) References Cited

U.S. PATENT DOCUMENTS

2013/0233722 A1 9/2013 Chen
2014/0072836 A1* 3/2014 Mills ..... H01M 14/00 429/422
(Continued)

OTHER PUBLICATIONS

Fratesi, "Low Temperature Methane-to-Methanol Conversion on Transition Metal Surfaces," (Oct. 2005), pp. 1-110. (Year: 2005).*
(Continued)

*Primary Examiner* — Zulmariam Mendez
(74) *Attorney, Agent, or Firm* — MARSHALL, GERSTEIN & BORUN LLP

(57) ABSTRACT

An electrochemical cell for conversion of methane to methanol includes a bimetallic catalyst having alternating regions of first and second metals thereby providing interfaces at which methane is converted to methanol or formate.

17 Claims, 48 Drawing Sheets

(51) Int. Cl.

| | |
|---|---|
| ***C25B 3/23*** | (2021.01) |
| ***C25B 9/15*** | (2021.01) |
| ***C25B 9/19*** | (2021.01) |
| ***C25B 11/032*** | (2021.01) |
| ***C25B 11/054*** | (2021.01) |
| ***C25B 11/089*** | (2021.01) |

(52) U.S. Cl.
CPC ..... *C25B 11/032* (2021.01); *C25B 11/054* (2021.01); *C25B 11/089* (2021.01)

(56) References Cited

U.S. PATENT DOCUMENTS

| | | | |
|---|---|---|---|
| 2015/0129430 A1 | 5/2015 | Fan | |
| 2016/0064743 A1 | 3/2016 | Lu | |
| 2016/0215404 A1* | 7/2016 | Palmore ..... | C25B 11/04 |
| 2020/0291535 A1 | 9/2020 | Surendranath et al. | |

OTHER PUBLICATIONS

Lum et al., "Sequential Catalysis Controls Selectivity in Electrochemical CO2 Reduction on Cu," Energy & Environmental Science (2018), vol. 11, No. 10, pp. 2935-2944. (Year: 2018).*

Arminio-Ravelo et al., Strategies toward the sustainable electrochemical oxidation of methane to methanol, Curr Opin Green Sustainable Chem., 30:100489 (Aug. 2021).

Fornaciari et al., A perspective on the electrochemical oxidation of methane to methanol in membrane electrode assemblies, ACS Energy Letters, 5(9):2954-63 (Sep. 2020).

International Application No. PCT/US2022/013997, International Search Report and Written Opinion, mailed Jul. 22, 2022.

Jiang et al., A highly selective tin-copper bimetallic electrocatalyst for the electrochemical reduction of aqueous CO2 to formate, Applied Catalysis B Environmental, 259:118049 (2019).

Kuhl et al., New insights into the electrochemical reduction of carbon dioxide on metallic copper surfaces, Energy & Environmental Science, 5(5):7050-9 (2012).

Prajapati et al., Fundamental insight into electrochemical oxidation of methane towards methanol on transition metal oxides, Proc. Natl. Acad. Sci. USA, 118(8):e2023233118 (Feb. 2021).

Rocha et al., A feasibility study of the electro-recycling of greenhouse gases: design and characterization of a (TiO2/RuO2)/PTFE gas diffusion electrode for the electrosynthesis of methanol from methane, Electrocatalysis, 1(4):224-9 (Dec. 2010).

* cited by examiner (A)

(B)

(G)

(A)

(A)

(B)

ELECTROCHEMICAL OXIDATION OF METHANE TOWARDS METHANOL ON MIXED METAL OXIDES

FIELD

The disclosure relates to electrochemical cells and methods for conversion of methane to methanol using bimetallic metal catalyst.

BACKGROUND

Conventional energy-intensive processes to convert methane to methanol operate at high temperatures and pressure. Current low-temperature processes are limited by mass transfer of methane, which is inefficient, and the unavailability of active catalysts to convert methane to methanol.

Electrochemical oxidation of methane ($CH_4$) at ambient conditions offers a sustainable route for efficient utilization of abundant natural resources, such as shale gas and biogas. However, the lower activity and selectivity of the current electrocatalyst pose hurdles for the large-scale deployment of electrochemical technologies for efficient utilization of $CH_4$. Currently, the majority (about 66%) of $CH_4$-rich sources are burned to produce electricity or to provide heating for residential and commercial buildings, which contributes about 1 gigaton of $CO_2$ emissions annually.

$CH_4$ is also utilized to produce oxygenated chemicals such as $CH_3OH$ using industrial processes like steam reforming followed by gas-phase conversion or direct thermocatalytic conversion. Thermocatalytic routes often require high temperature and pressure and suffer from catalyst poisoning.

Electrochemical processes offer an environmentally benign and sustainable route for storing electrical energy by converting $CH_4$ and $H_2O$ to $CH_3OH$ and for generating electrical energy using a direct $CH_4$ fuel cell that primarily generates $CO_2$. However, the primary challenge in such electrochemical processes is the first step of $CH_4$ activation on electrocatalysts, which is difficult at ambient conditions owing to a high C—H bond energy of 439 kJ/mol, high symmetry with tetrahedral molecular geometry, low polarizability of 2.488 $Å^3$, the low solubility of 1.272 mM in water at ambient temperature and pressure, and competitive oxygen evolution reaction (OER).

The mechanism of electrochemical activation followed by oxidation of $CH_4$ and its competition with OER on transition metal oxides (TMOs) is not known or understood in the art. The majority of previous work focuses on high-temperature electrocatalysis in galvanic cell configurations, such as solid oxide fuel cells, in which the primary objective is to harvest electrical energy by fully oxidizing $CH_4$ to $CO_2$. Convention solid oxide fuel cells operating at a temperature range of 300 to 700° C. using a Ni-based composite anode have been studied for partial oxidation of $CH_4$ to hydrocarbons (e.g., CO, $C_2H_4$. $C_2H_6$, and $CH_3OH$), but their operating efficiencies drop rapidly because of coking. Low-temperature electrolytic systems operating at temperatures <120° C. using Pt, Platinized-Pt, or Pt/Au catalysts have also been reported for partial oxidation of $CH_4$ to $CH_3OH$, but the faradic efficiencies (FE) are too low for practice use.

SUMMARY

An electrochemical cell for conversion of methane to methanol and/or formate can include an anode compartment comprising an anode, a gas inlet in fluid communication with the anode compartment for introduction of methane into the anode compartment, a cathode compartment comprising a cathode, a membrane separating the anode compartment and the cathode compartment, electrolyte disposed in and/or flowed through the anode and cathode compartments; and a product outlet in fluid communication with the anode compartment for collection of the methanol and/or formate after conversion. The gas inlet is arranged such that methane flows in contact with and/or through the bimetallic catalyst. The anode comprises or has disposed thereon a bimetallic catalyst. The bimetallic catalyst comprising a patterned arrangement of a first metal region and a second metal region disposed on a support. Methane is converted to methanol and/or formate when methane contacts the bimetallic catalysts. In the patterned arrangement the first and second metal regions are arranged in alternating fashion with an interface defined between adjacent ones of the first and second metal regions. The first metal regions each include or are formed of one or more of Cu, Pd, Ag, and Ni and the second metal regions each include or are formed of one or more of Ti, Ir, Ru, Sn, Pb, and Pt.

A process for converting methane to methanol and/or formate using an electrochemical cell in accordance with the disclosure can include flowing methane and/or a methane containing source in contact with the bimetallic catalyst, wherein upon contact with the bimetallic catalyst the methane is converted to methanol and/or formate at the interface between the first and second metal regions.

A reactant-impulse chronoamperometry method for measuring $CH_4$ binding energy can include providing rotating disc electrode cell comprising a catalyst; feeding an Ar-saturated electrolyte in contact with the rotating disc electrode at a temperature and at a fixed potential; switching the Ar-saturated electrolyte with a $CH_4$ saturated electrolyte at a potential lower than an onset potential for methane oxidation reaction on the catalyst by changing the electrolyte feed to the $CH_4$ saturated electrolyte; returning to the Ar-saturated electrolyte feed by changing the electrolyte feed back to the Ar-saturated feed; and measuring a dynamic change in an oxidation evolution reaction (OER) current density when switching between the Ar-saturated electrolyte and the $CH_4$ saturated electrolyte. A change in the OER current density that occurs when switching between the Ar-saturated electrolyte to the $CH_4$ saturated electrolyte correlates to the binding free energy of methane on the catalyst. The change in current density is calculated by $$\theta = \frac{I_{OER,Ar} - I_{OER,CH_4}}{I_{OER,Ar}}$$

where θ is the fractional coverage of the $*CH_4$ on the electrode surface, $I_{OER,Ar}$ is the OER current density in Ar-saturated electrolyte, and $I_{OER,CH_4}$ is the OER current density in the $CH_4$-saturated electrolyte. The binding free energy of $CH_4$ is then determined from:

$$\Delta G = RT \ln(K)$$

where R is the universal gas constant (8.314 J $mol^{-1}$ $K^{-1}$) and T is the temperature, and K is $$K = \frac{\theta(1 - x^*}{x^*(1 - \theta)}$$

where x* is the mole fraction of dissolved $CH_4$ in the electrolyte.

Squares represent the first two transition metal oxides, circles represent the second-row transition metal oxides, and blue represents the third-row transition metal oxides.

Figure 3B:
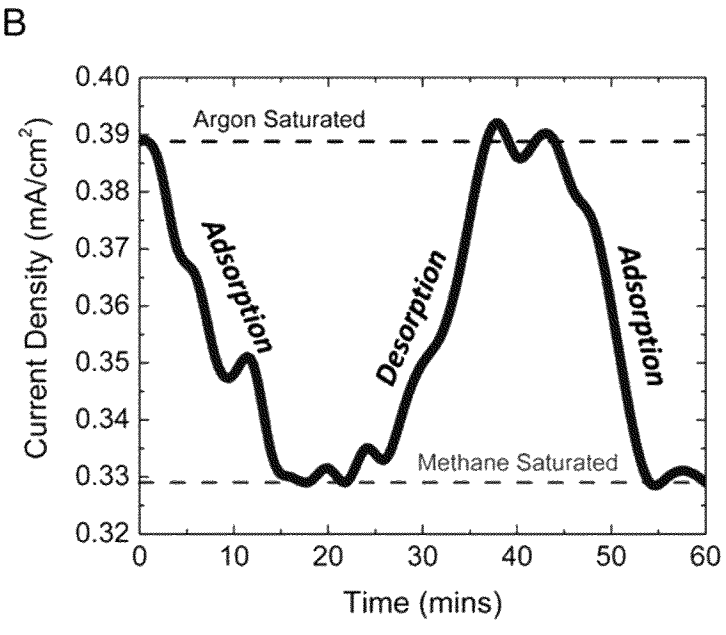
FIG. 3B is a graph showing the reversible change in the OER current density with adsorption and desorption of $CH_4$ at a fixed applied potential of 1.52 V vs. RHE.
Figure 3A:
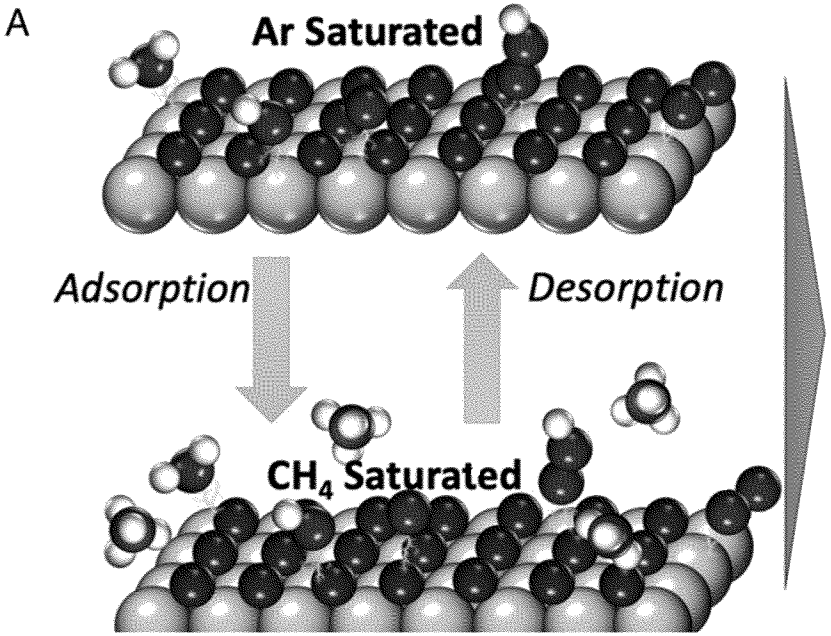
FIG. 3A is a schematic representation of oxygen evolution reaction (OER) intermediates on (110) surface of transition metal oxides in Ar-saturated and $CH_4$-saturated electrolytes.
Figure 3D:
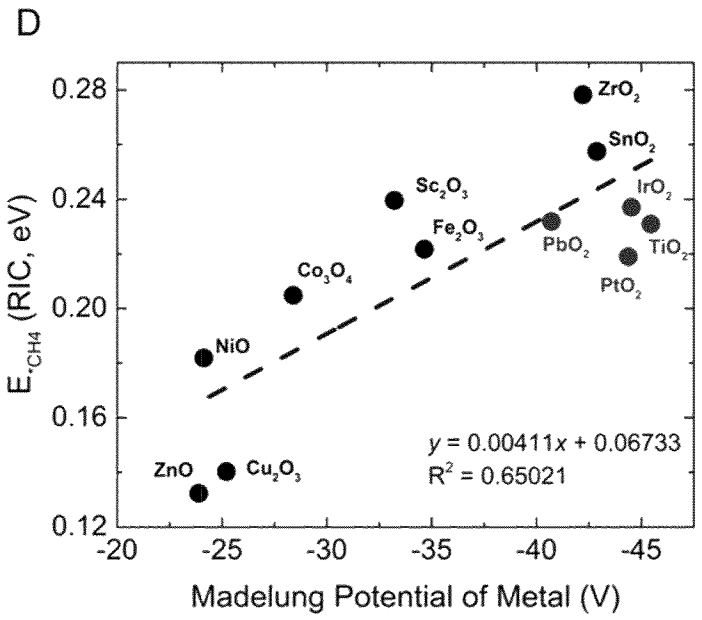
FIG. 3C is a graph showing the estimated binding energies of $*CH_4$ obtained using Everett isotherm for different transition metal oxides at 1.52 V vs. RHE. The MOR active transition metals—$TiO_2$, $IrO_2$, $PbO_2$, and $PtO_2$—had similar binding energy in the range of 0.22 to 0.25 eV and similar activation energy in the range of 0.09 to 0.12 eV.

FIG. 3D is a graph showing the scaling relationship between the measured binding energy of *CH4 and the Madelung potential of metal in transition metal oxides. The MOR active catalysts had higher binding energy of $*CH_4$ and lower Madelung potential.

Figure 4A:
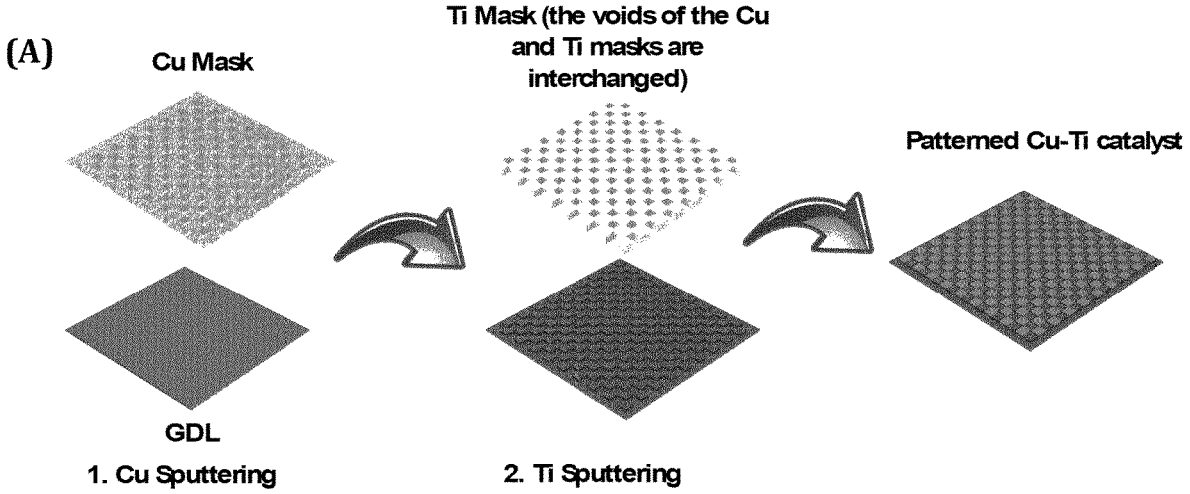

FIG. 4A is a schematic illustration of a method of synthesizing a patterned bimetallic catalyst in accordance with the disclosure.

Figure 4C:
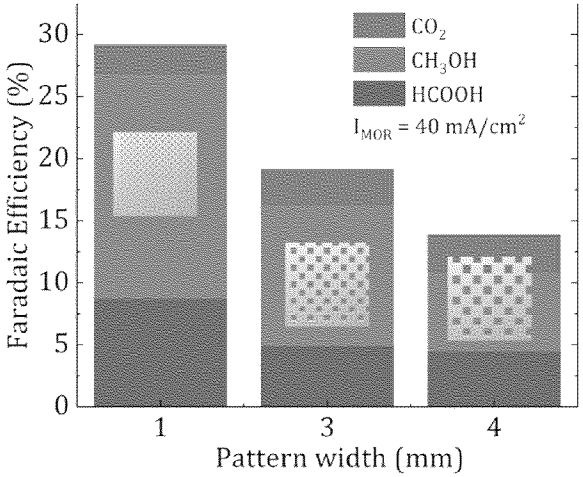
Figure 4B:
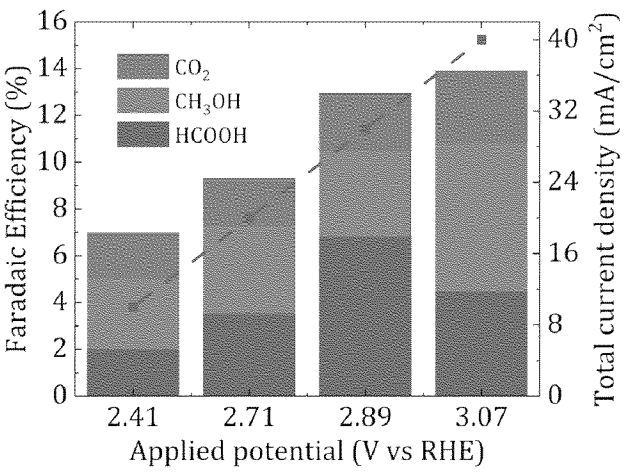

FIG. 4B is a graph showing the faradaic efficiency (FE) and current density of MOR on a 4×4 patterned Cu—Ti bimetallic catalysts.

FIG. 4C is a graph showing the effect of pattern size on the MOR activity. Each stacked bar plot shows a graphic of the corresponding mesh size.

Figure 4D:
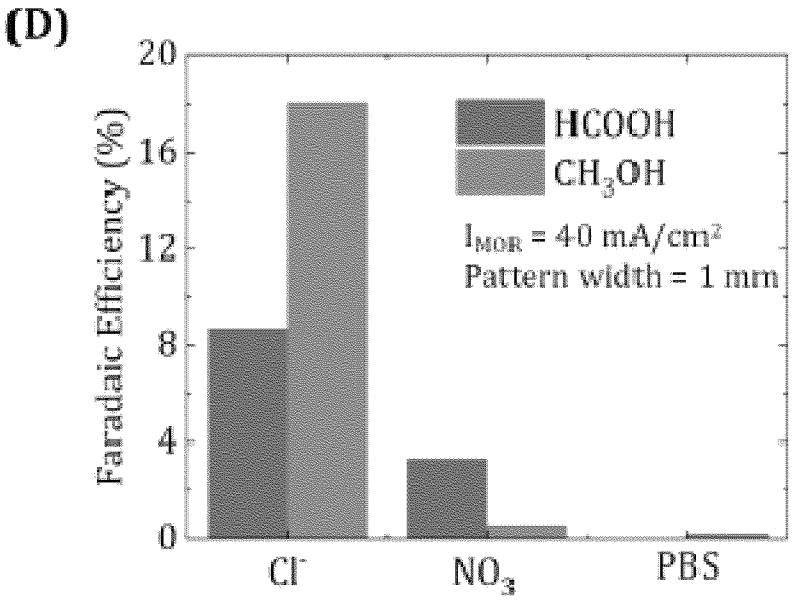

FIG. 4D is a graph showing the effect of anions on MOR activity.

Figure 4E:
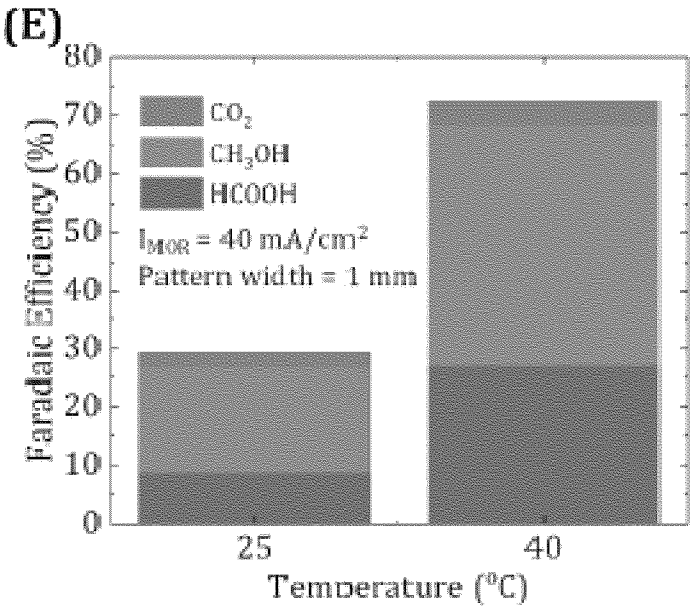

FIG. 4E is a graph showing the effect of temperature on MOR activity.

Figure 4F:
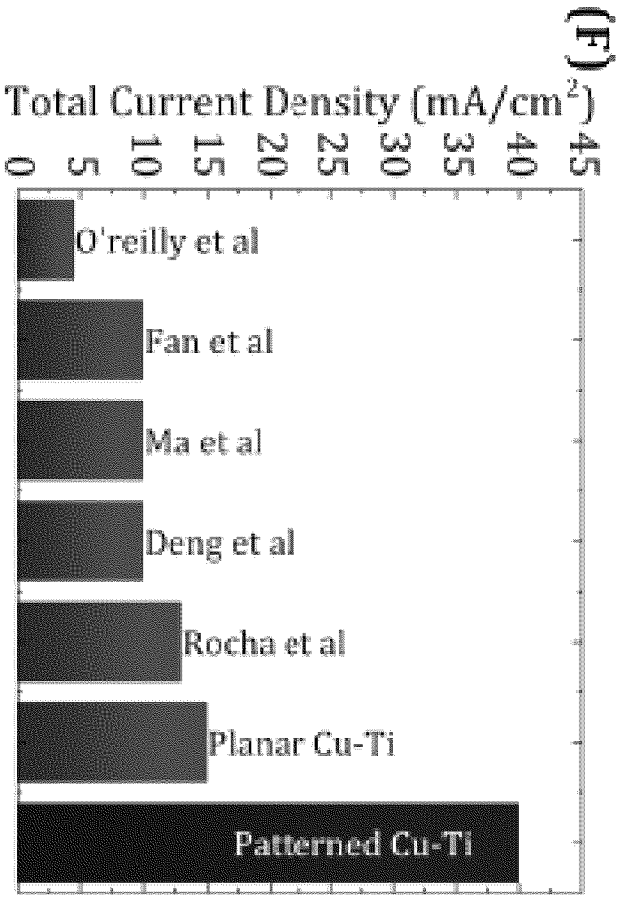

FIG. 4F is a graph showing a comparison of the total current density of the electrochemical cell with bimetallic catalyst of the disclosure as compared to literature reported values on ambient MOR.

Figure 5A:
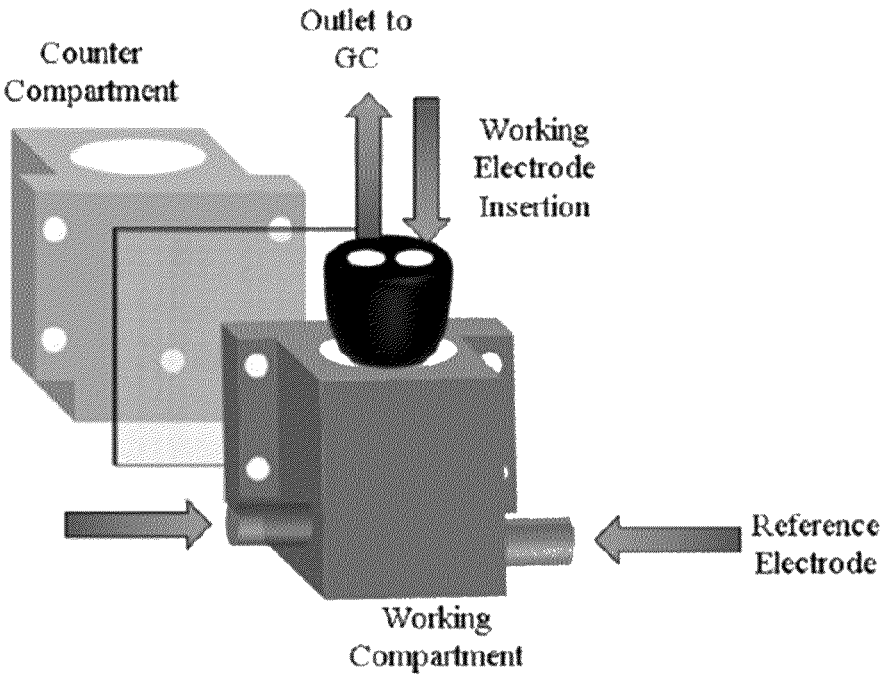

FIG. 5A is a schematic illustration of an electrochemical cell used in the examples.

Figure 5B:
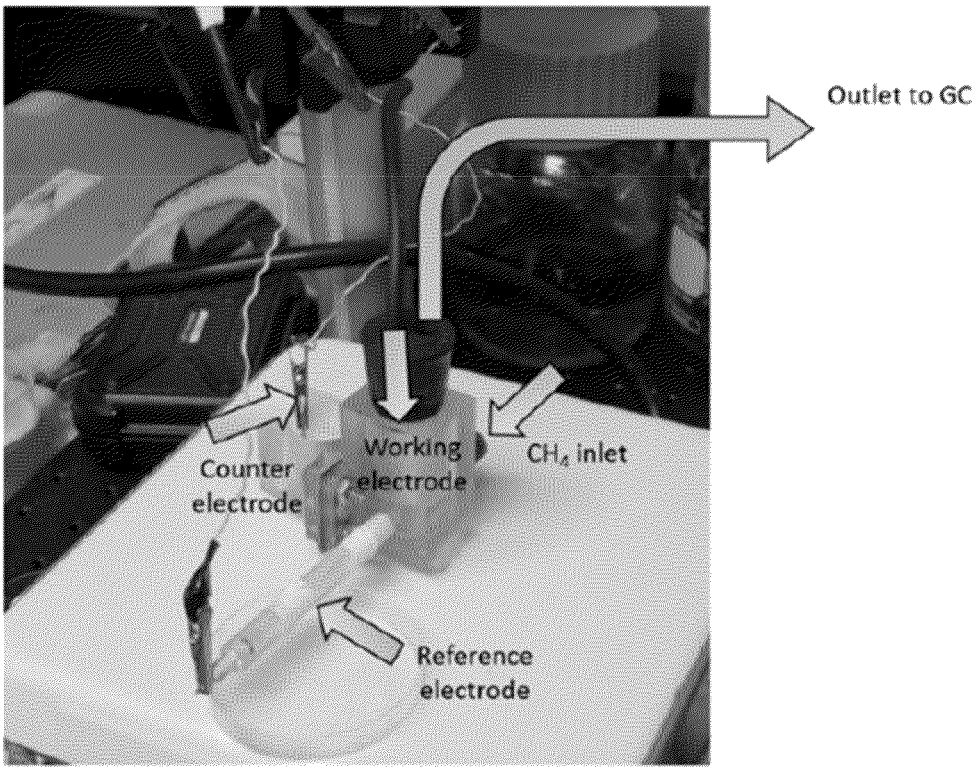

FIG. 5B is a photograph of an experimental setup for MOR using the electrochemical cell of FIG. 5A.

Figure 6A:
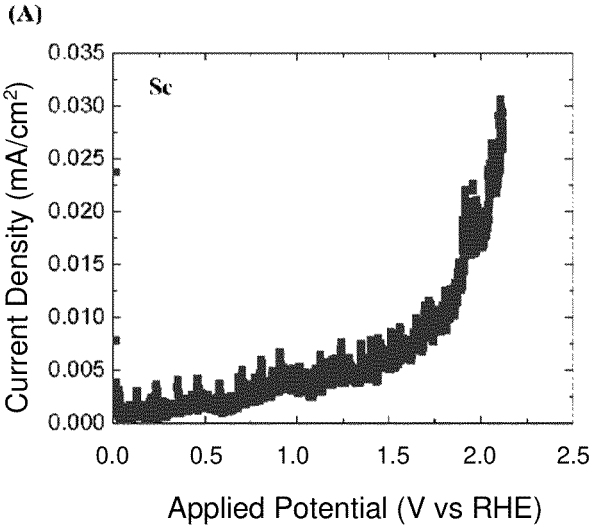
Figure 6B:
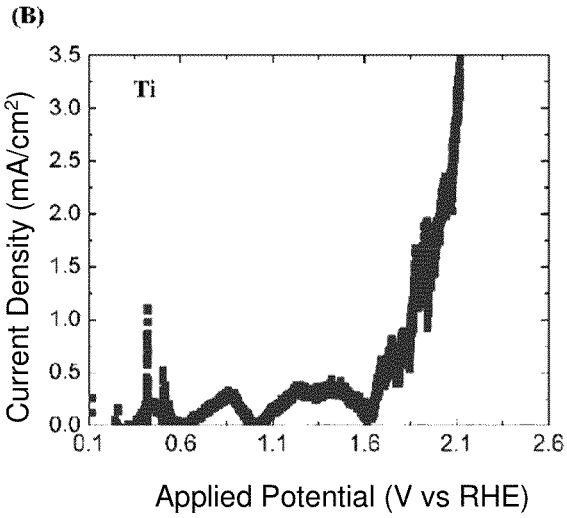
Figure 6D:
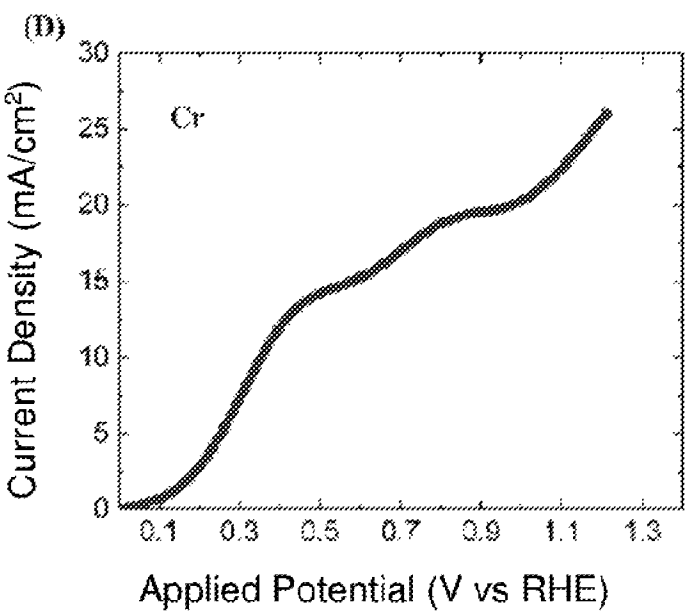
Figure 6C:
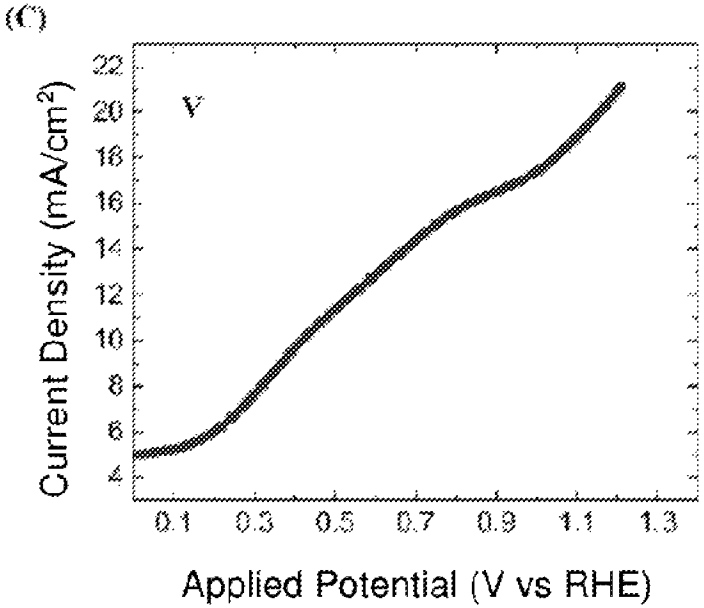
Figure 6E:
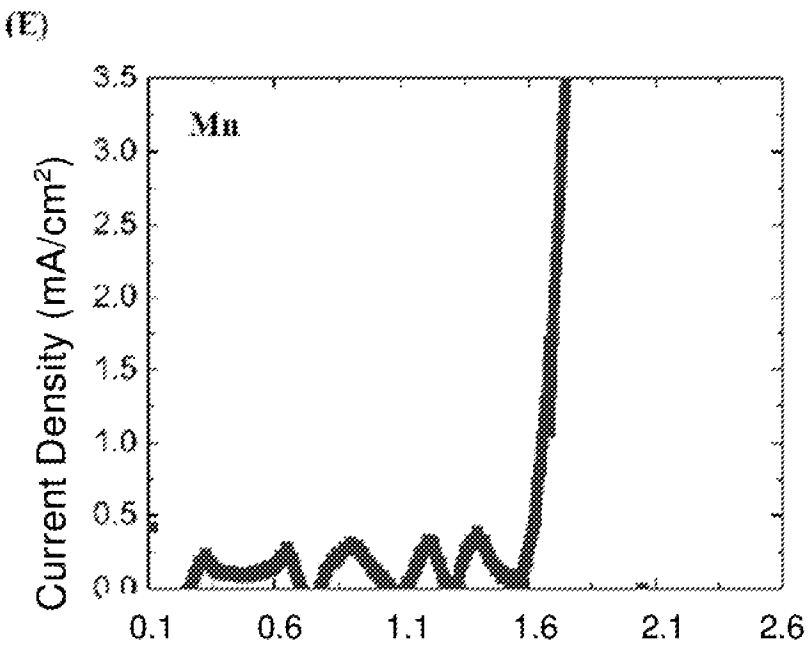
Figure 6F:
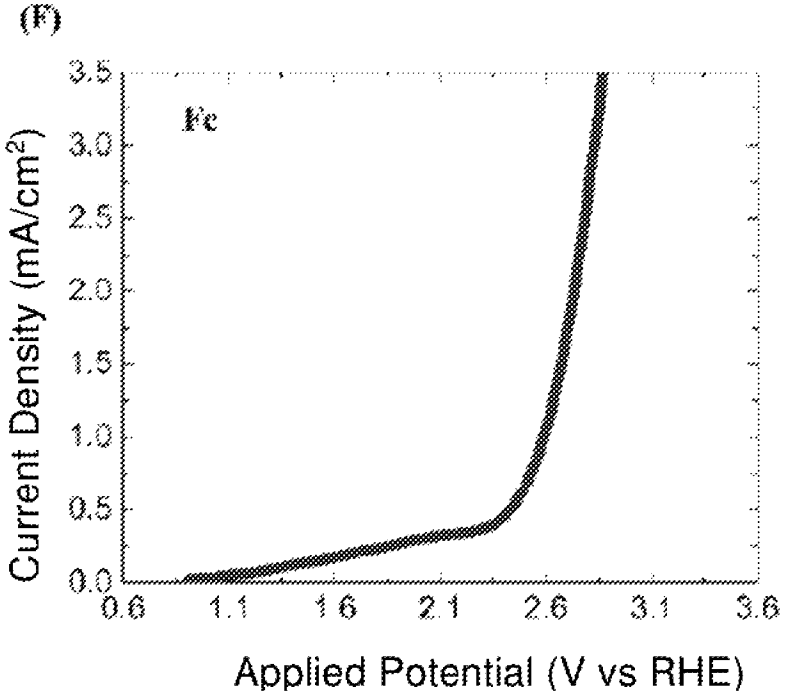
Figure 6G:
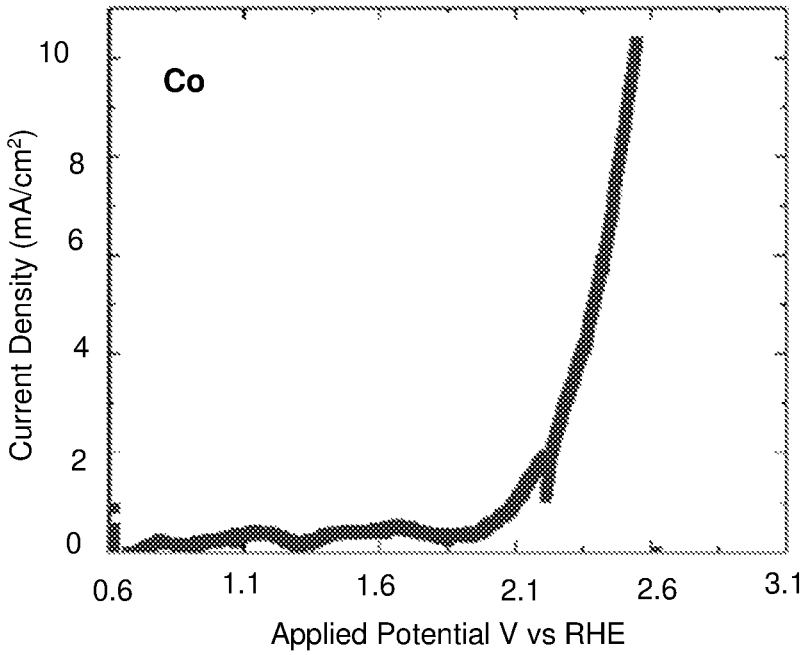
Figure 6H:
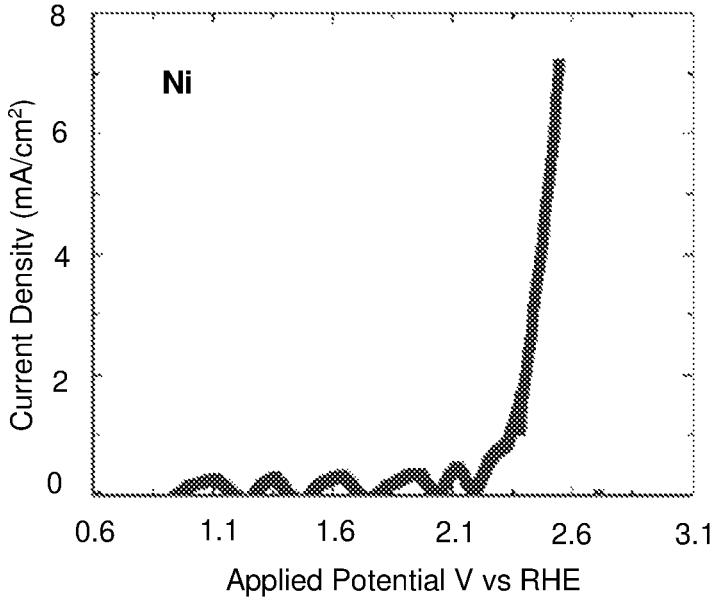
Figure 6I:
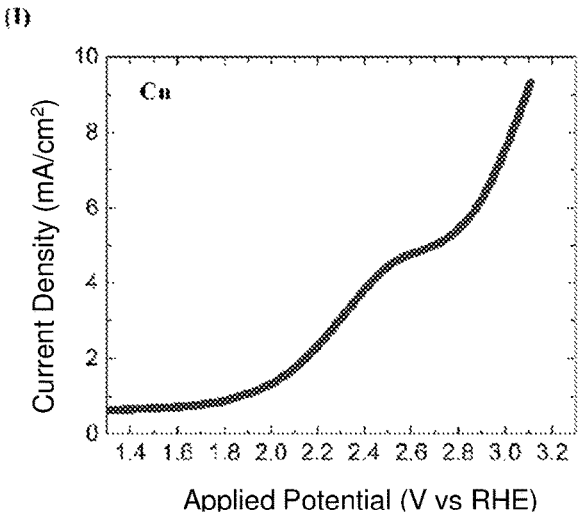
Figure 6J:
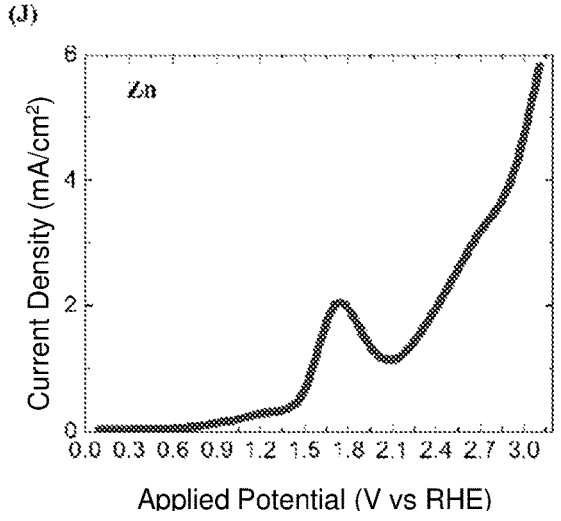
Figure 6K:
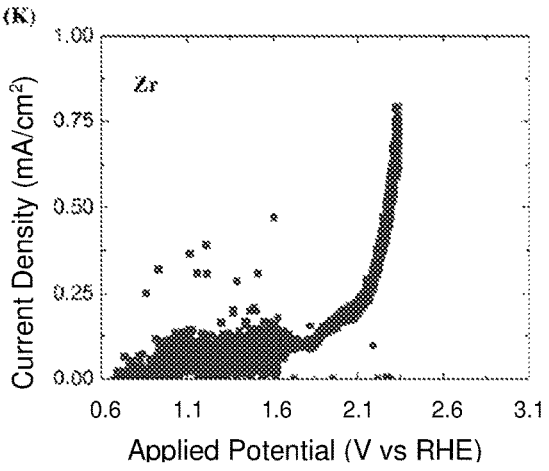
Figure 6L:
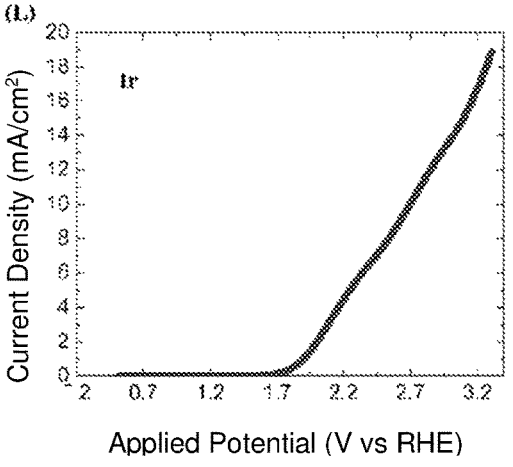
Figure 6M:
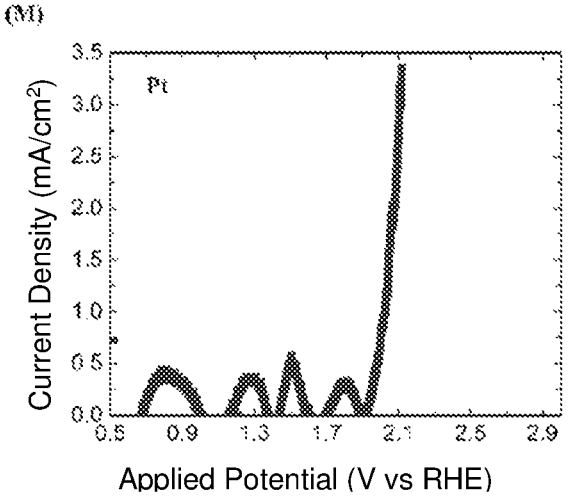
Figure 6N:
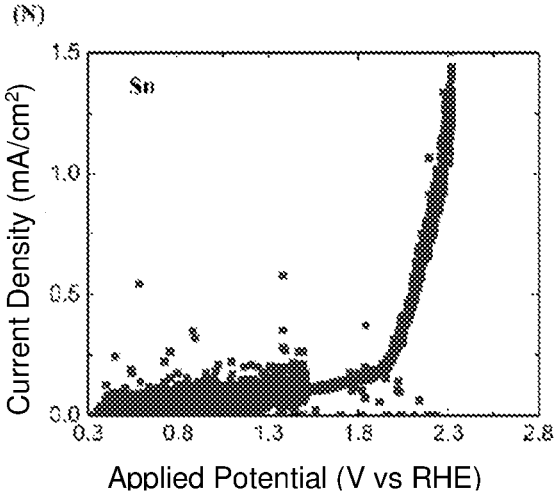
Figure 6O:
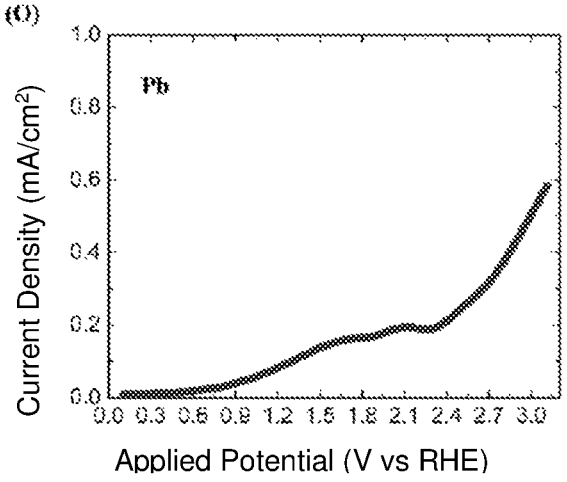

FIGS. 6A-6O are graphs showing the linear sweep voltammograms for the transition metal oxides tested in $CH_4$ saturated 0.1 M phosphate buffer solution.

Figures 7A, 7B:
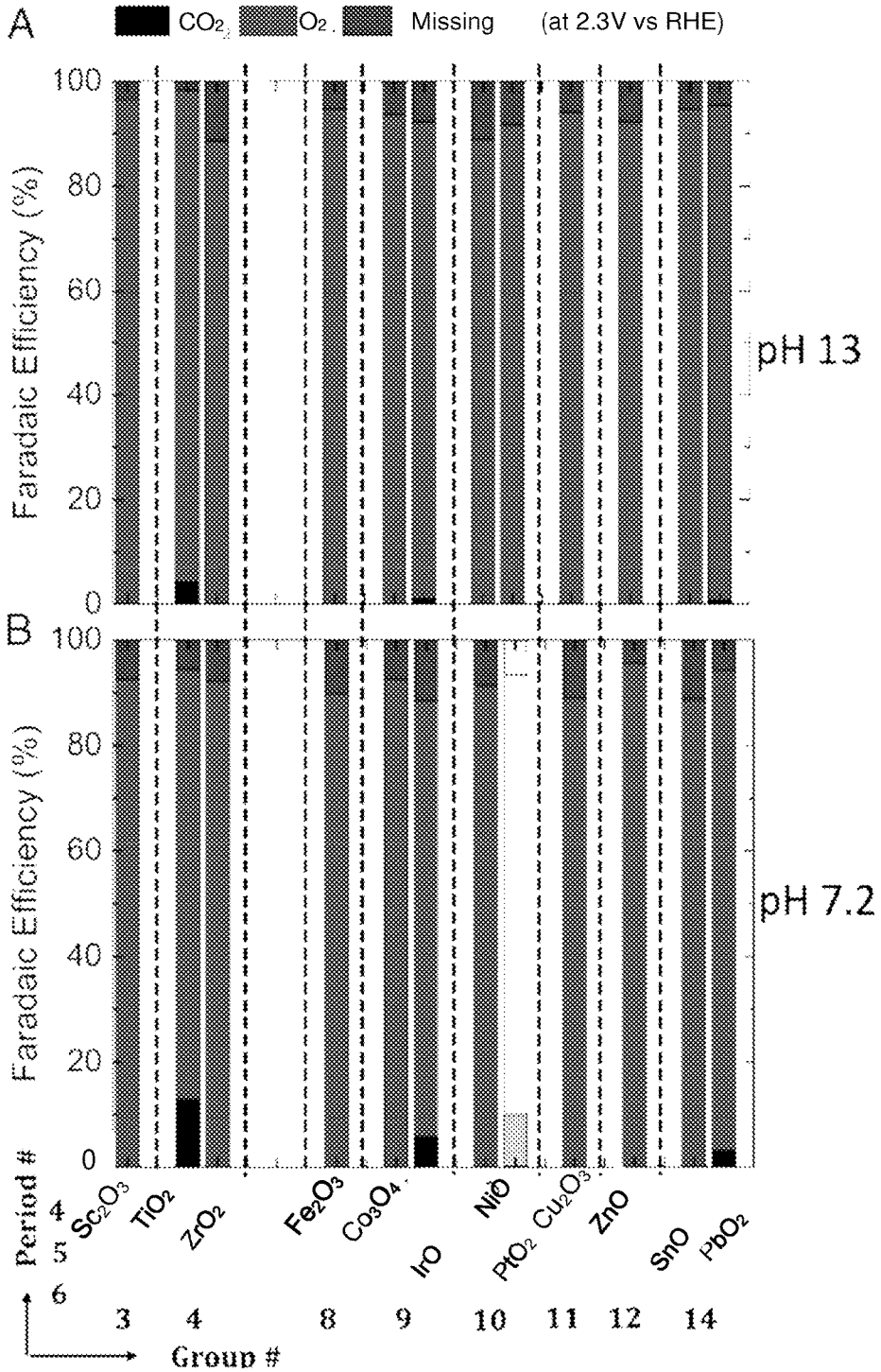

FIGS. 7A and 7B are graphs showing product distribution and FE of OER and MOR over stable transition metal oxides in (A) 0.1 M KOH (pH=13) and (B) 0.1 M potassium phosphate buffer (pH=7).

Figure 8A:
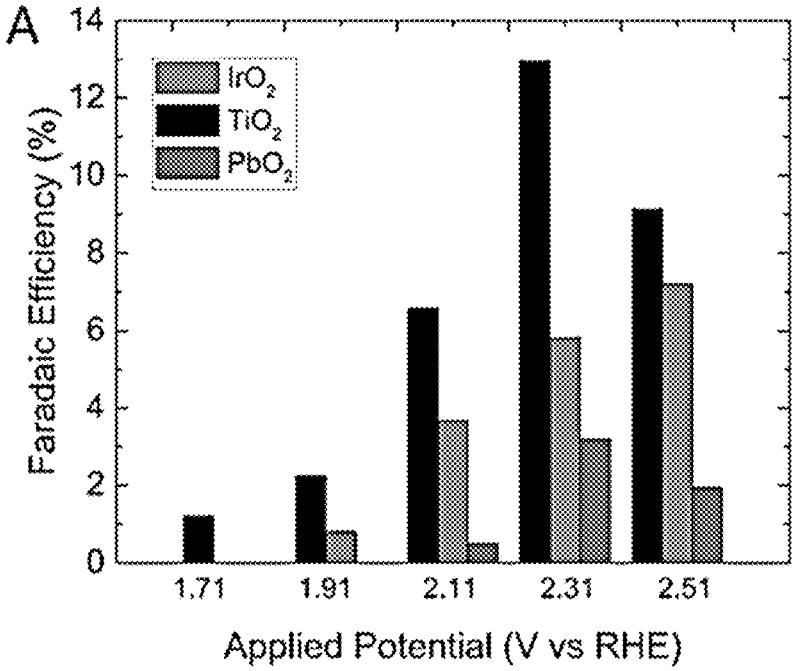

FIG. 8A is a graph showing the Faradaic efficiency (FE) of MOR producing $CO_2$ on $TiO_2$, $IrO_2$, and $PbO_2$ at different applied potentials in neutral pH phosphate buffer electrolyte.

Figure 8B:
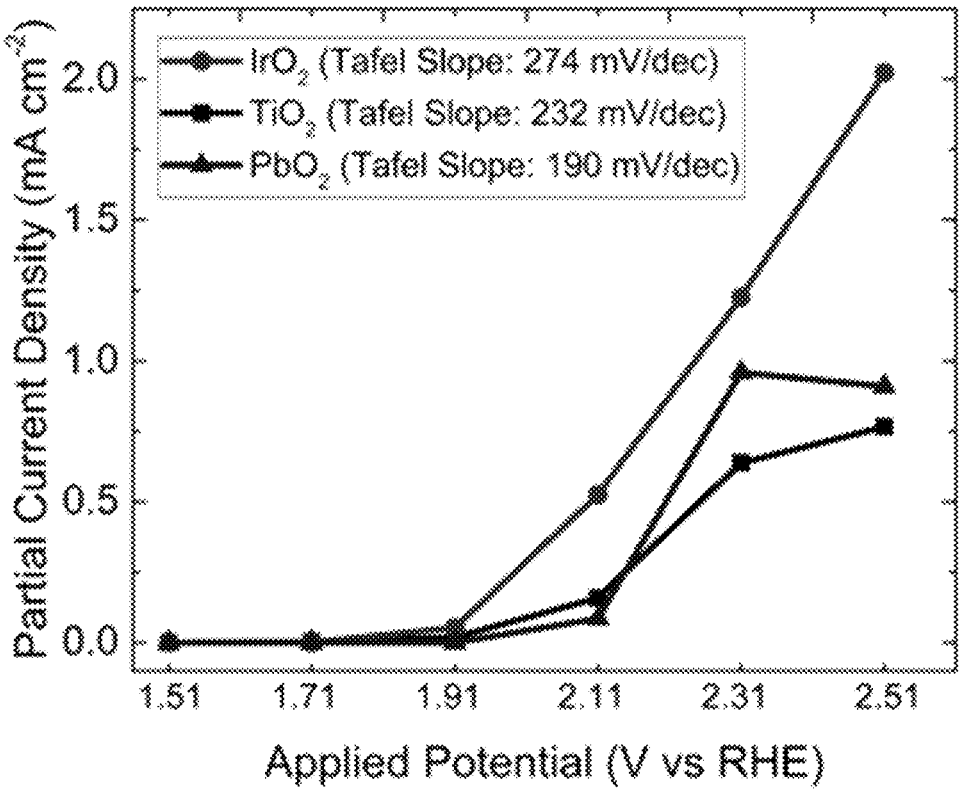

FIG. 8B is a graph showing the partial current density of MOR producing $CO_2$ on $TiO_2$, $IrO_2$, and $PbO_2$ at different applied potentials in neutral pH phosphate buffer electrolyte.

Figure 9:
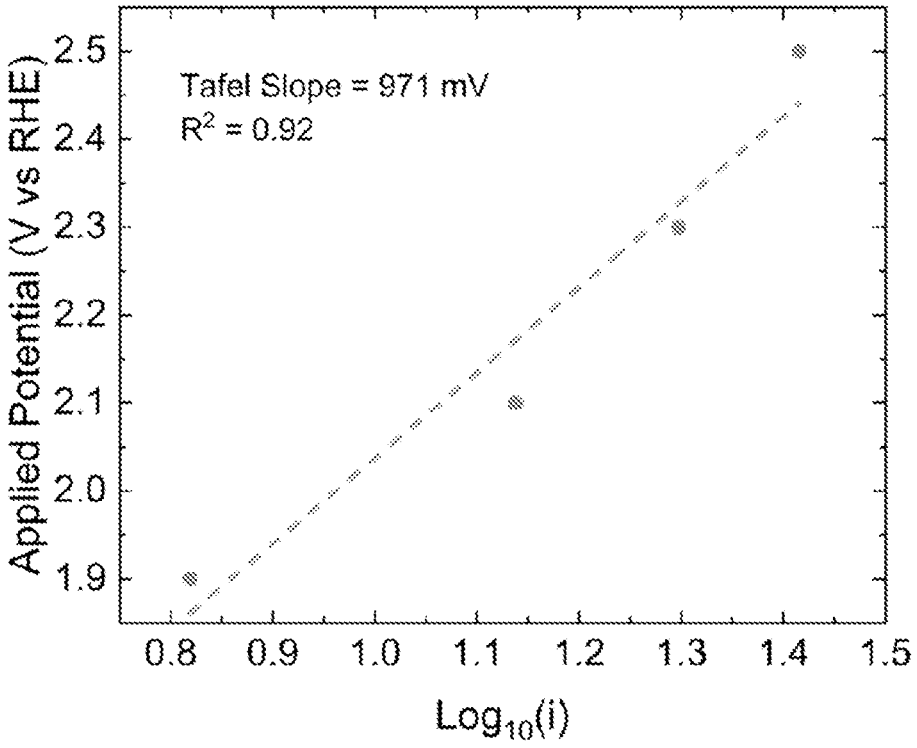

FIG. 9 is a graph showing the Tafel slow for $IrO_2$ at higher potentials.

Figure 10A:
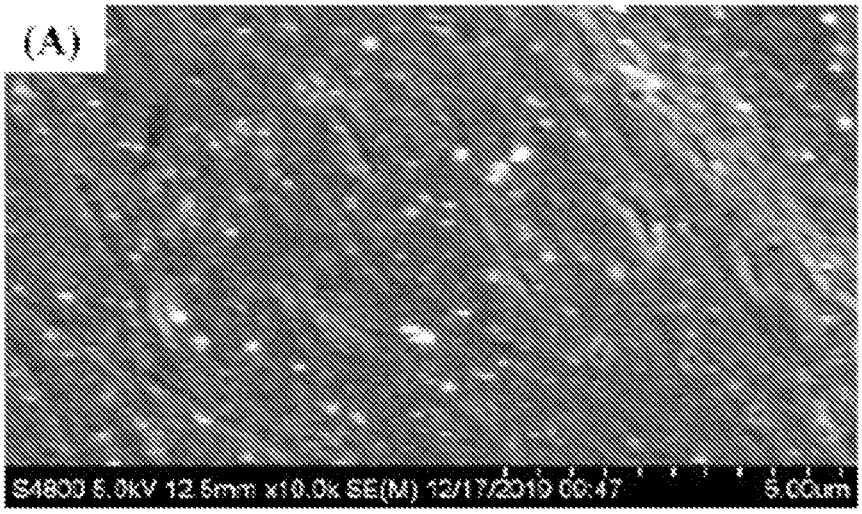

FIG. 10A is an SEM image of a titanium metal disk before MOR at 10 k magnification.

Figure 10B:
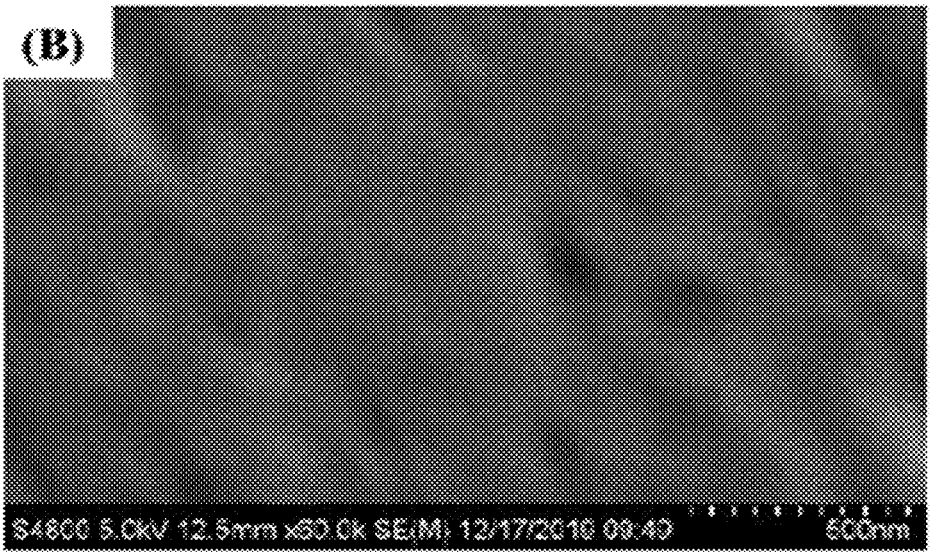

FIG. 10B is an SEM image of the titanium disk of FIG. 10A at 60 k magnification.

Figure 10C:
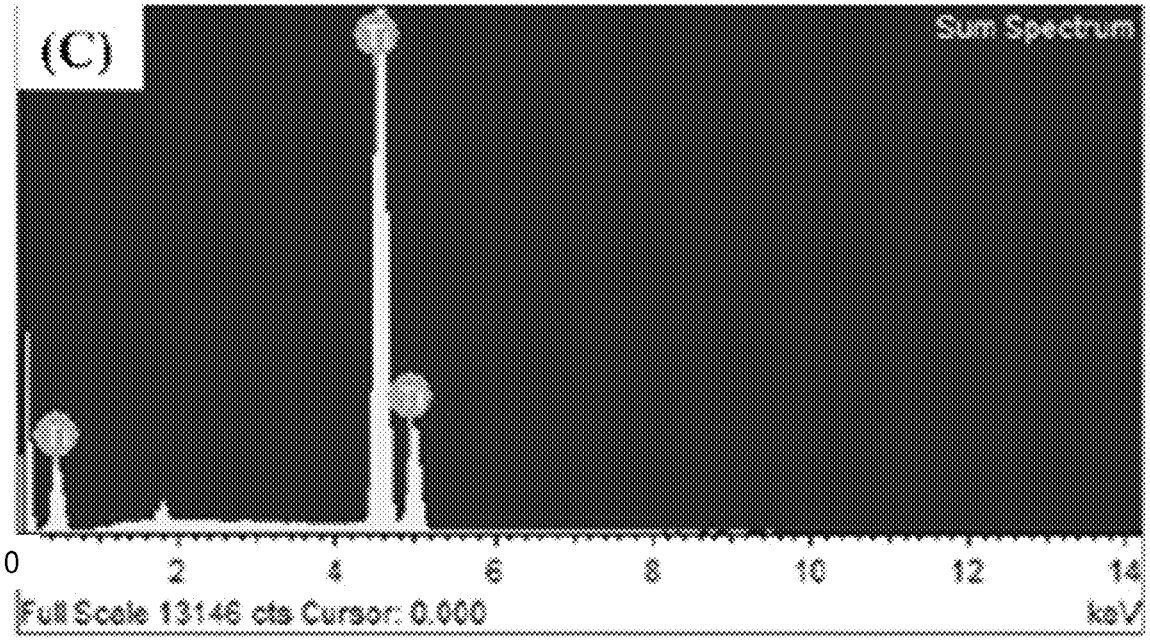

FIG. 10C is an EDS spectrum of the titanium disk of FIG. 10A.

Figure 10D:
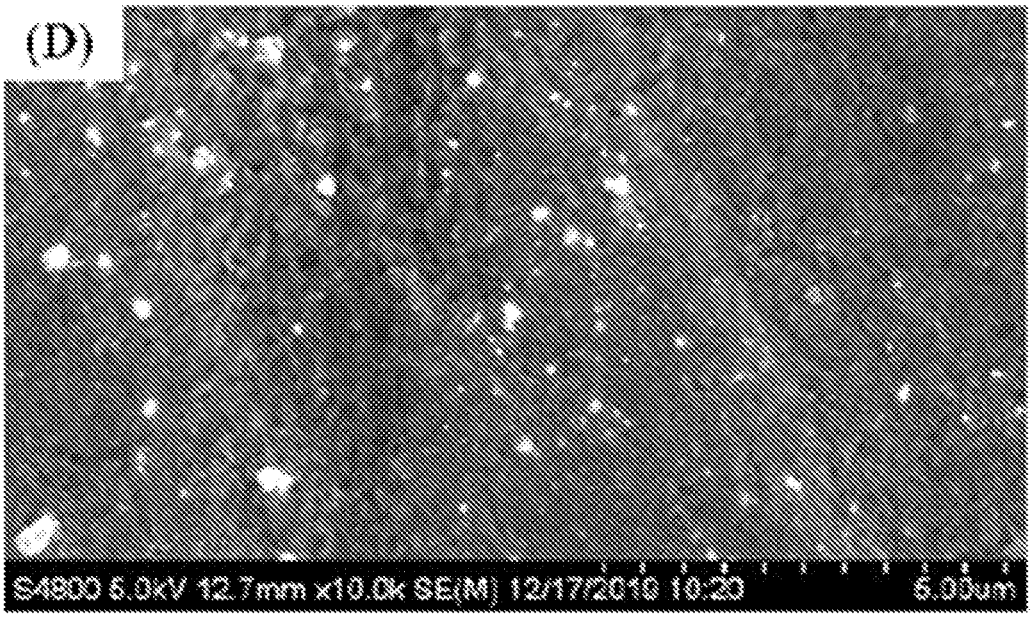

FIG. 10D is an SEM image of a titanium metal disk after MOR at 10 k magnification.

Figure 10E:
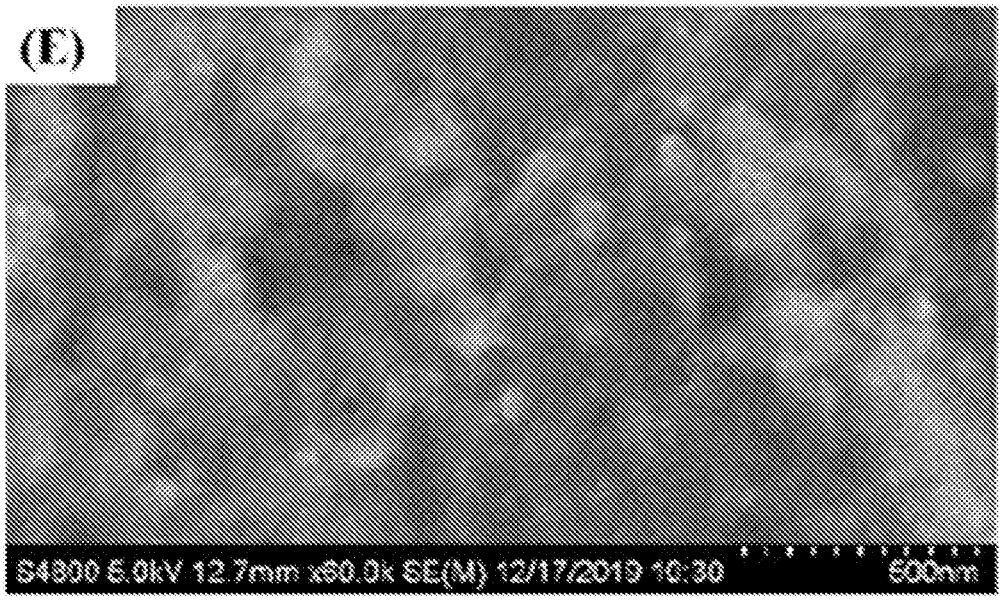

FIG. 10E is an SEM image of the titanium disk of FIG. 10D at 60 k magnification.

Figure 10F:
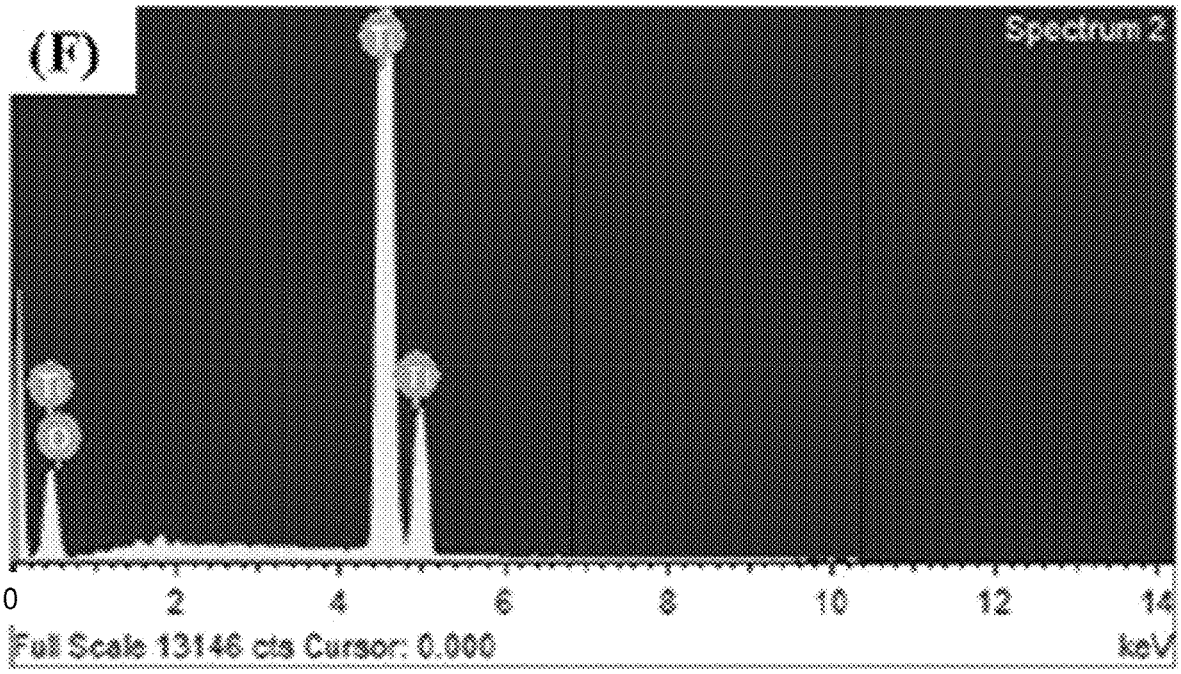

FIG. 10F is an EDS spectrum of the titanium disk of FIG. 10D.

Figure 11A:
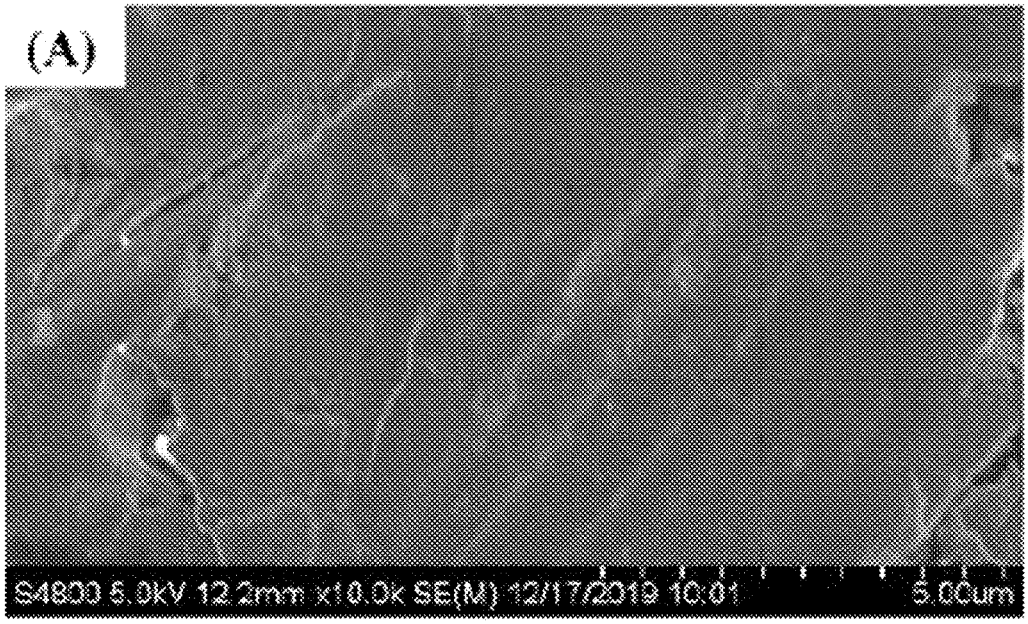

FIG. 11A is an SEM image of an iridium disk before MOR at 10 k magnification.

Figure 11B:
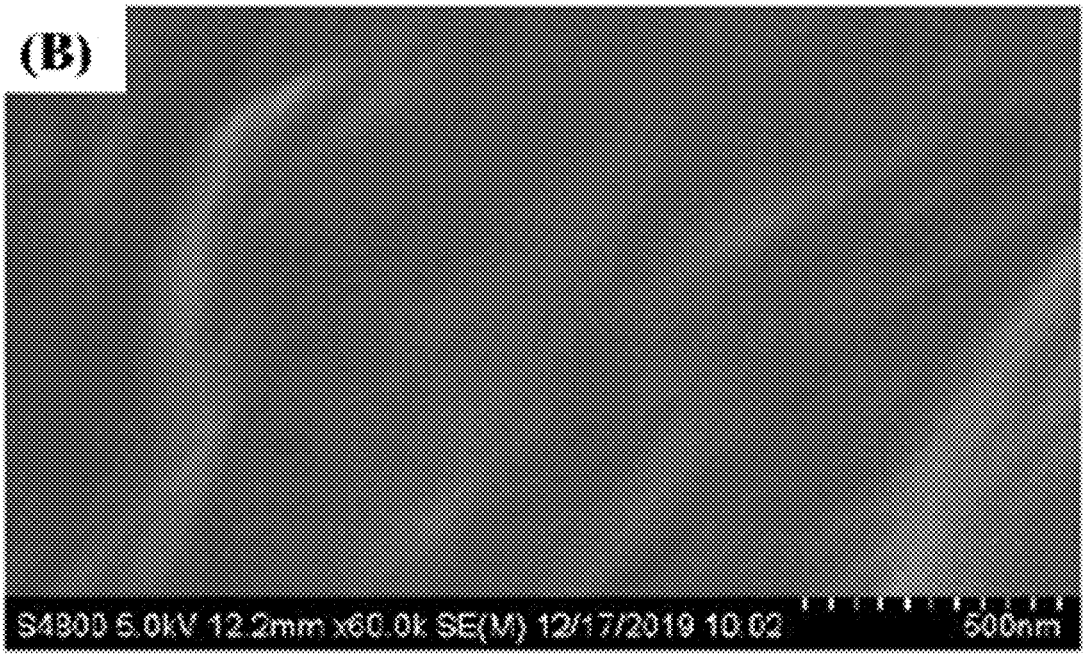

FIG. 11B is an SEM image of the iridium disk of FIG. 11A at 60 k magnification.

Figure 11C:
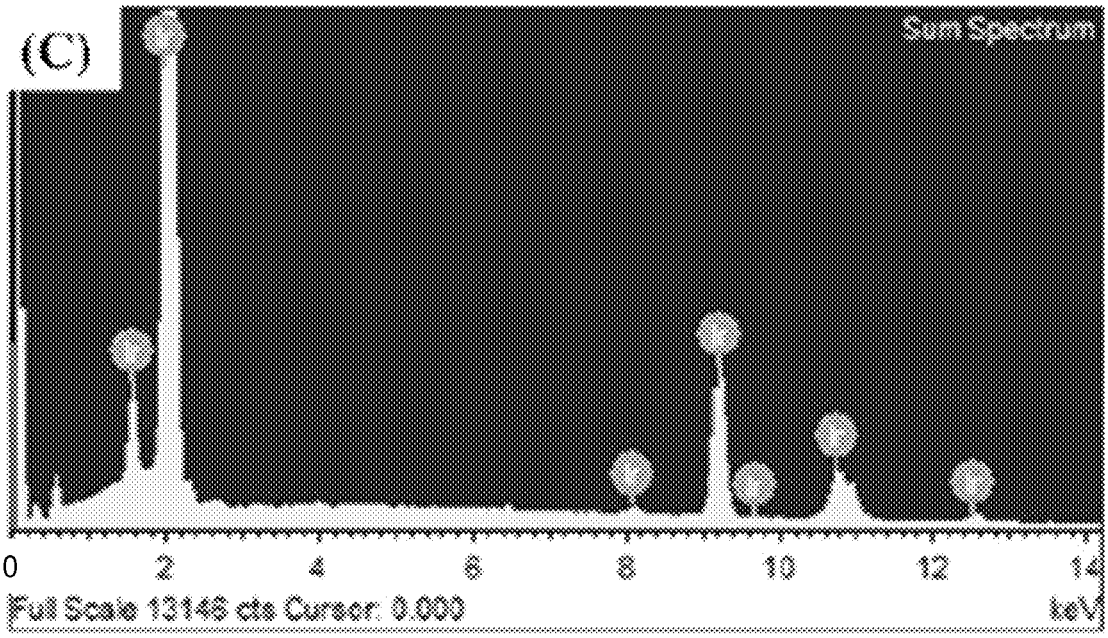

FIG. 11C is an EDS spectrum of the iridium disk of FIG. 11A.

Figure 11D:
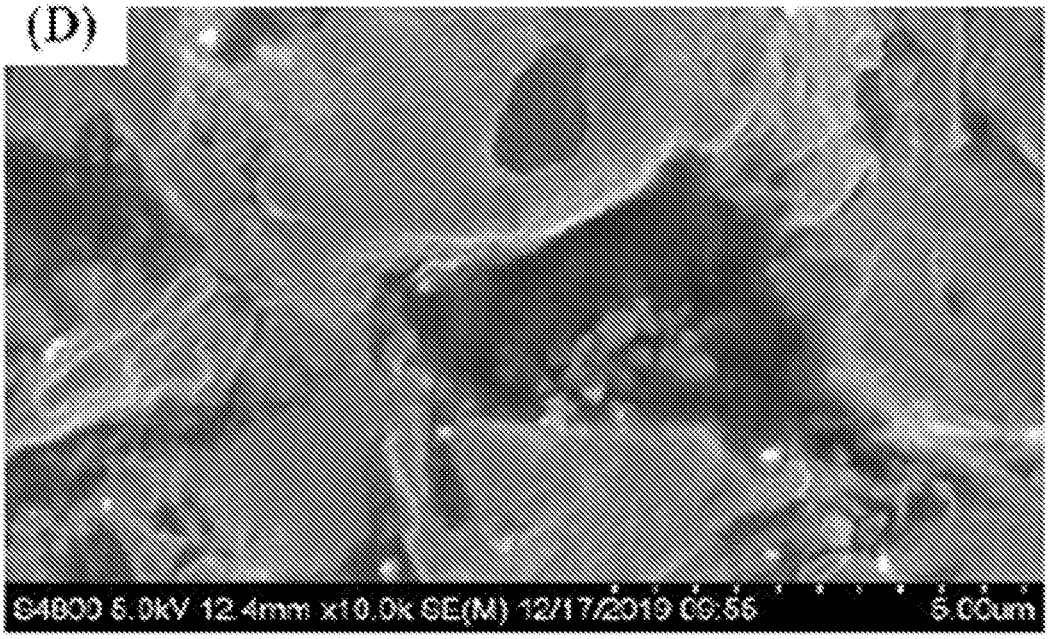

FIG. 11D is an SEM image of a iridium metal disk after MOR at 10 k magnification.

Figure 11E:
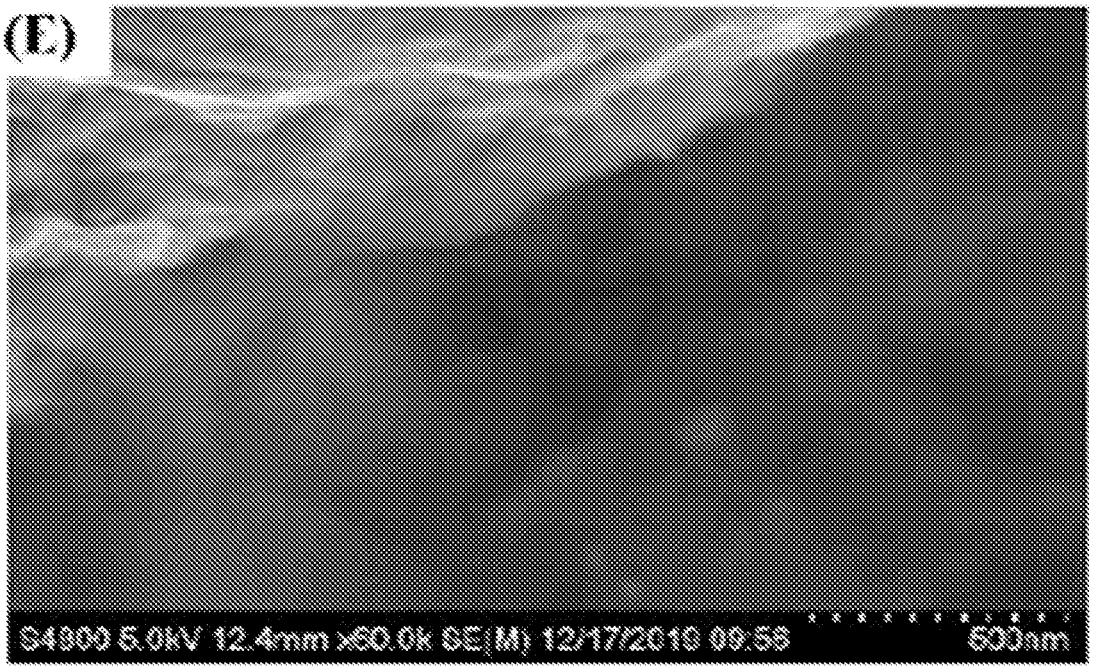

FIG. 11E is an SEM image of the iridium disk of FIG. 11D at 60 k magnification.

Figure 11F:
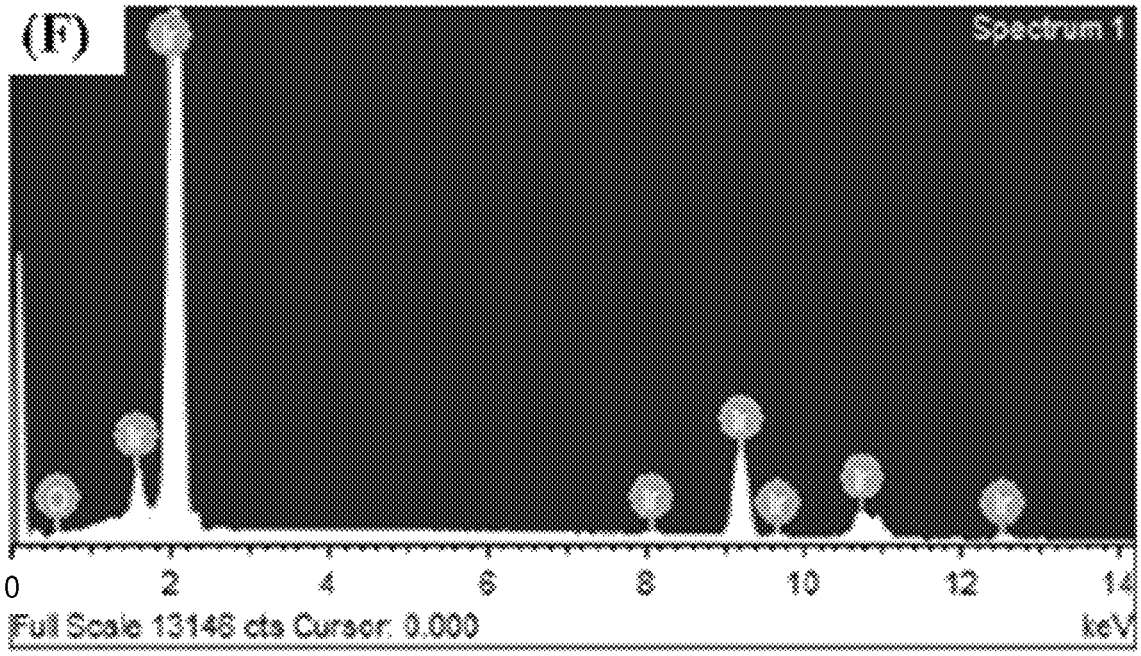

FIG. 11F is an EDS spectrum of the titanium disk of FIG. 11D.

Figure 12A:
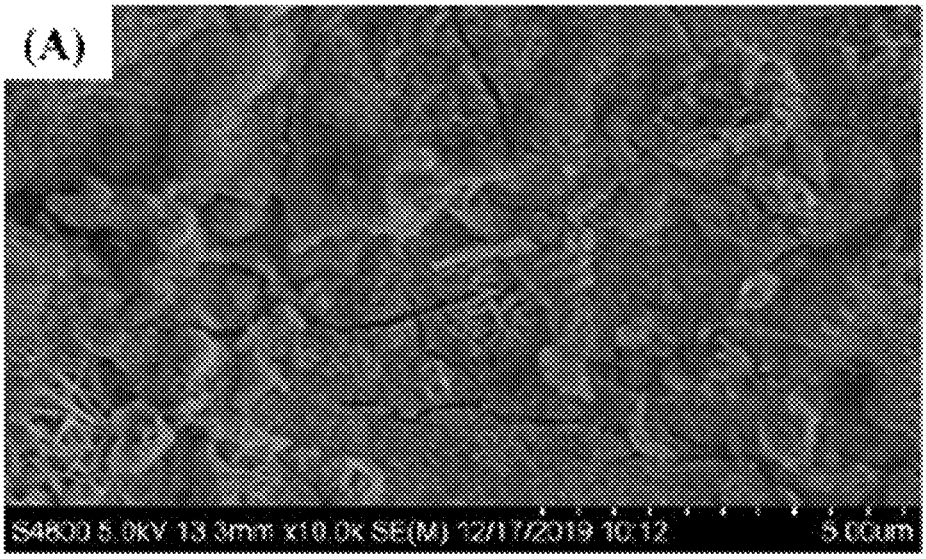

FIG. 12A is an SEM image of a lead disk before MOR at 10 k magnification.

Figure 12B:
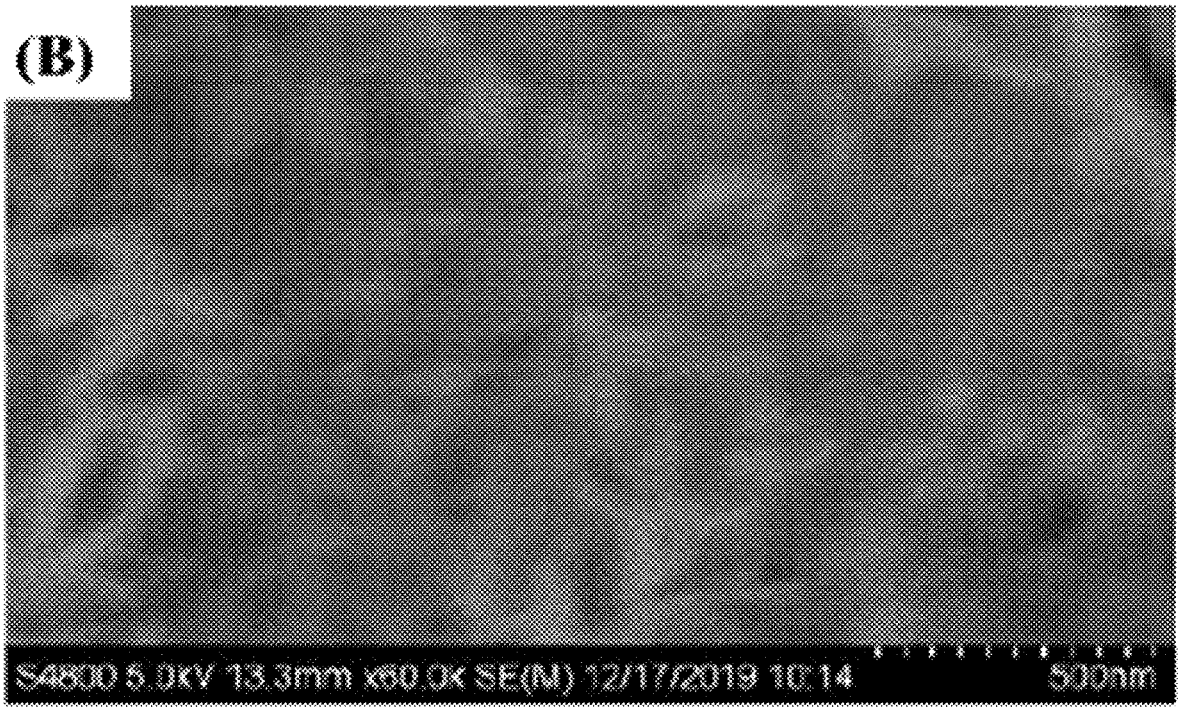

FIG. 12B is an SEM image of the lead disk of FIG. 12A at 60 k magnification.

Figure 12C:
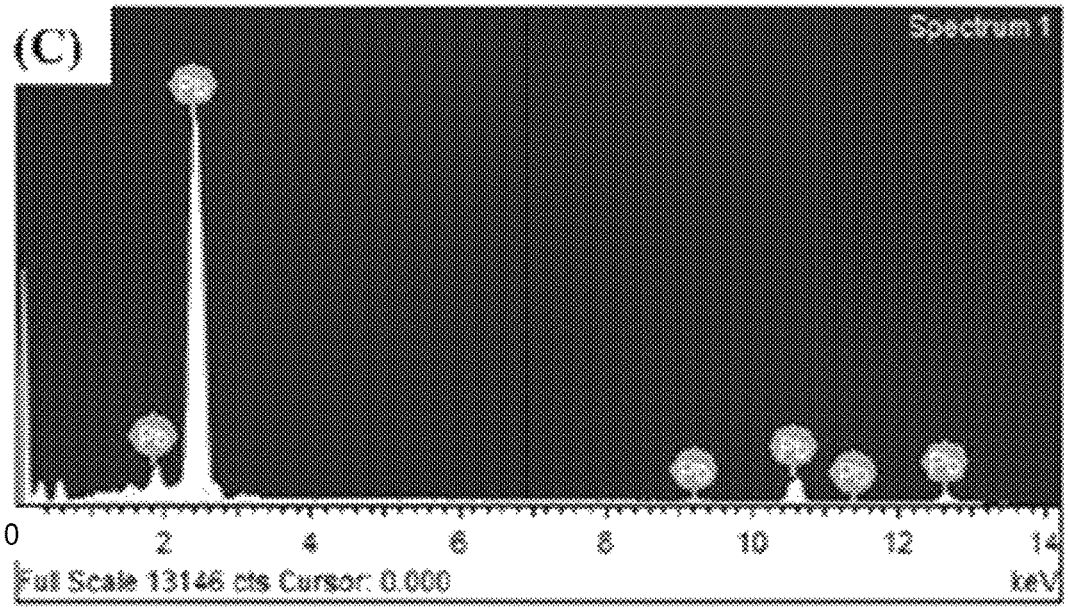

FIG. 12C is an EDS spectrum of the lead disk of FIG. 12A.

Figure 12D:
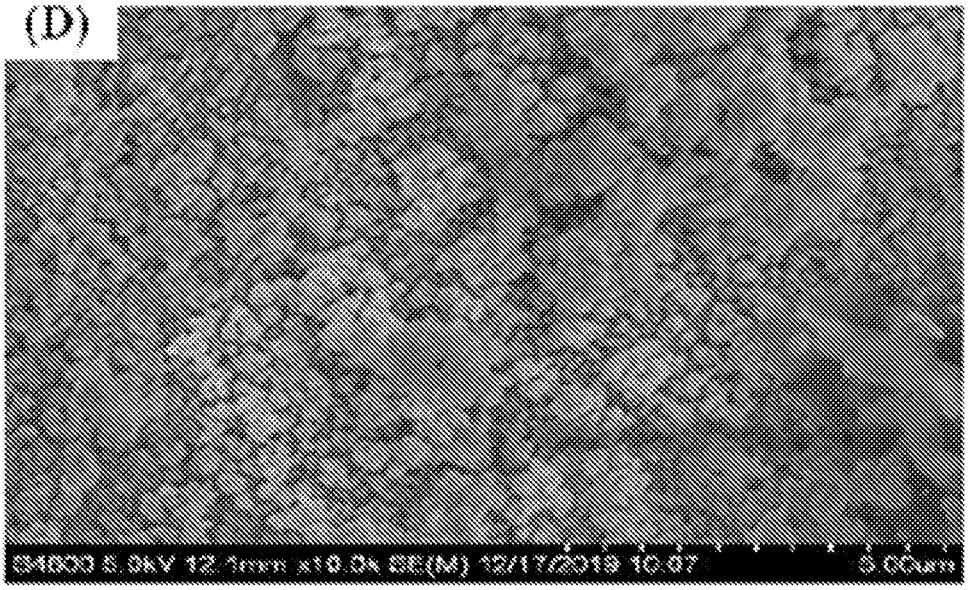

FIG. 12D is an SEM image of a lead metal disk after MOR at 10 k magnification.

Figure 12E:
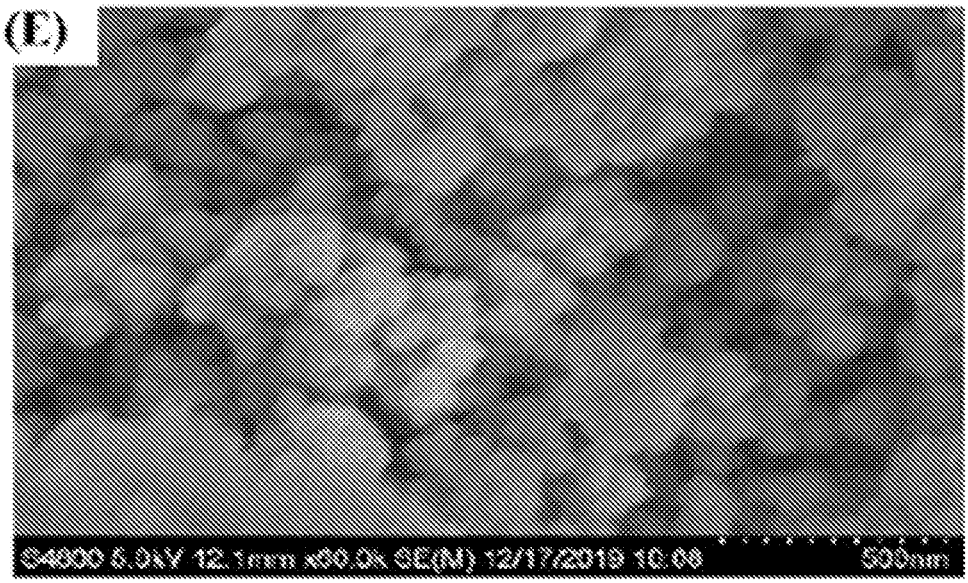

FIG. 12E is an SEM image of the lead disk of FIG. 12D at 60 k magnification.

Figure 12F:
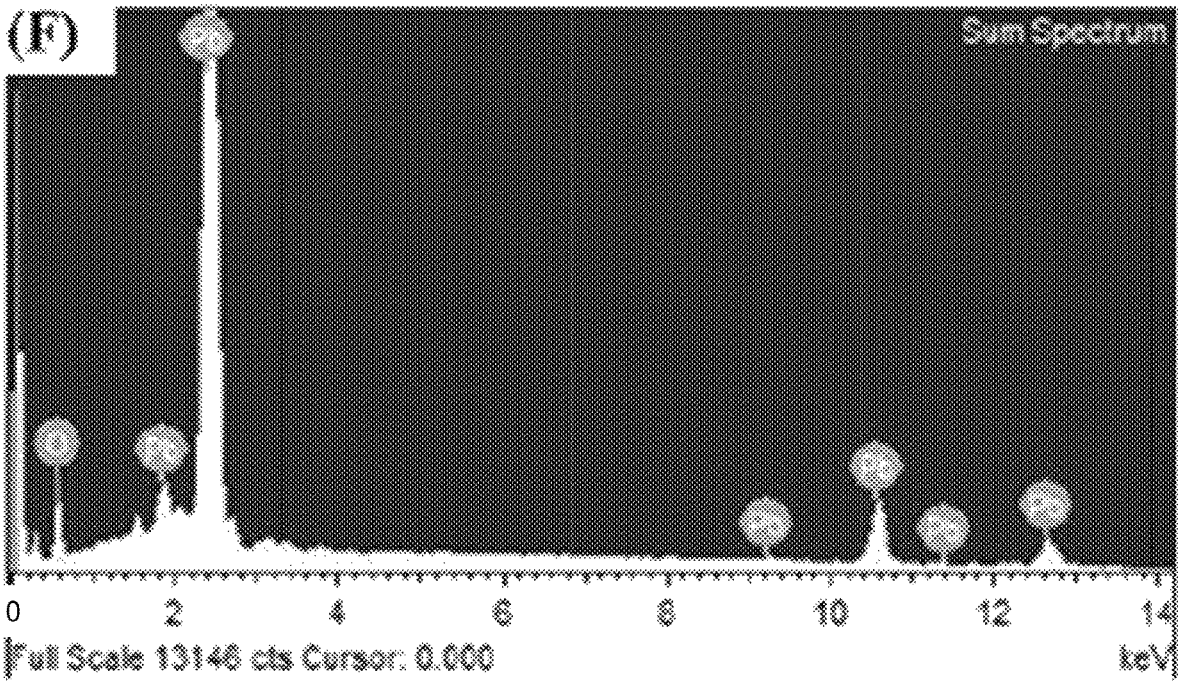

FIG. 12F is an EDS spectrum of the lead disk of FIG. 12D.

Figure 13A:
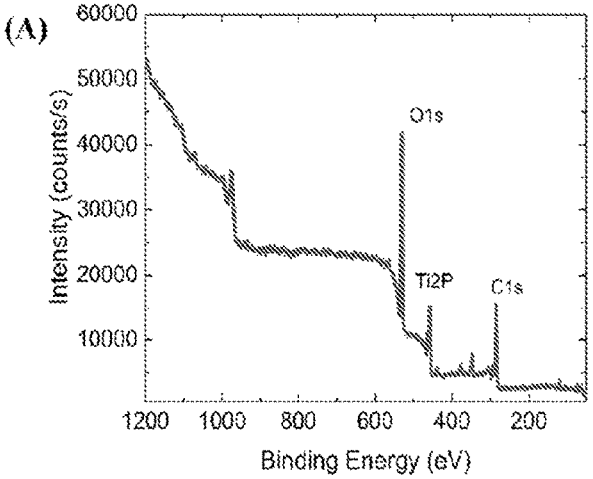

FIG. 13A is a survey scan for a Ti disk before MOR.

Figure 13B:
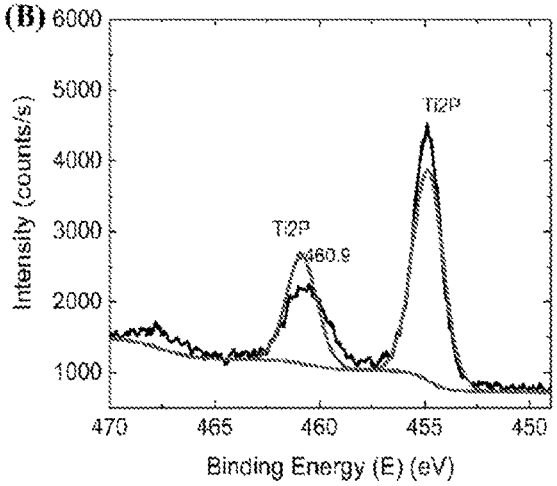

FIG. 13B is an elemental scan for the Ti disk of FIG. 13A.

Figure 13C:
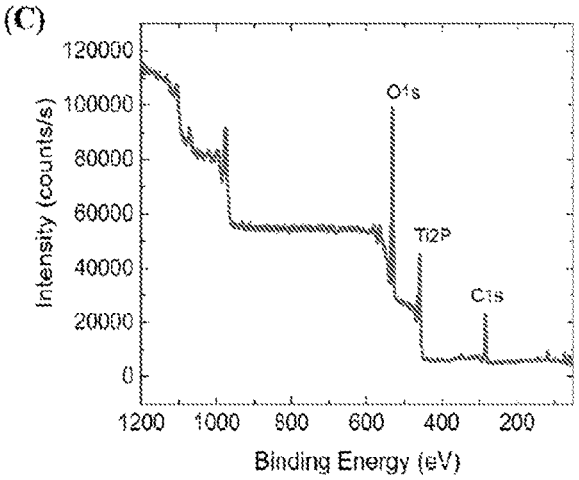

FIG. 13C is a survey scan for a Ti disk after MOR.

Figure 13D:
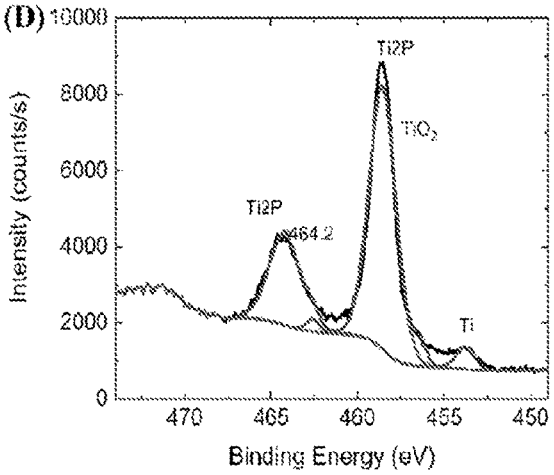

FIG. 13D is an elemental scan for the Ti disk of FIG. 13C.

Figure 14B:
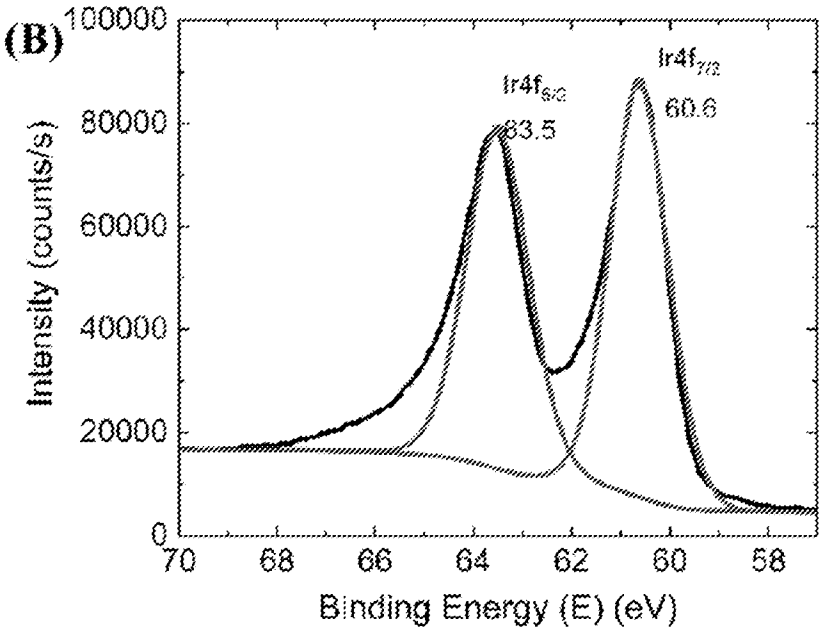
Figure 14A:
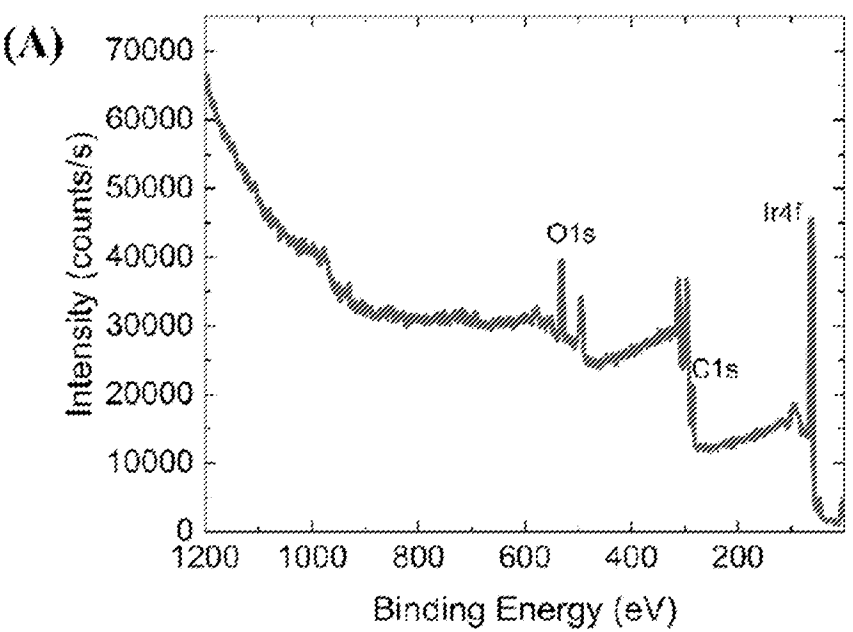

FIG. 14A is a survey scan for an Ir metal disk before MOR.

FIG. 14B is an elemental scan for the Ir metal disk of FIG. 14A.

Figure 14D:
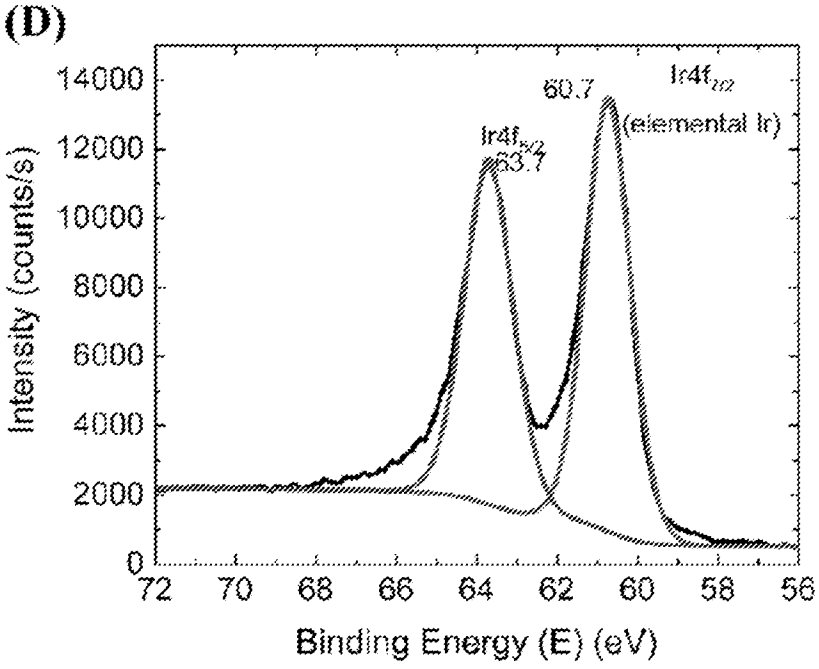
Figure 14C:
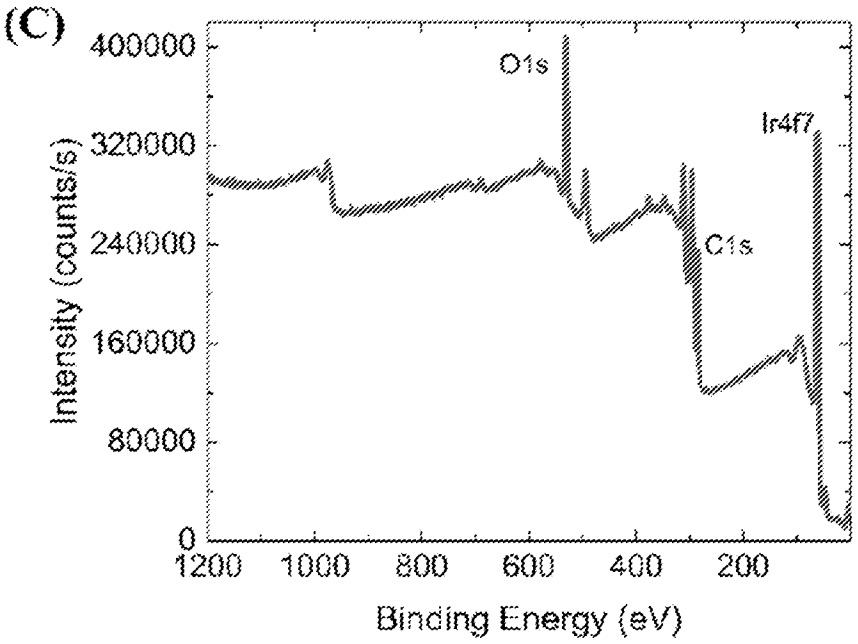

FIG. 14C is a survey scan for an Ir meal disk after MOR.

FIG. 14D is an elemental scan for the Ir metal disk of FIG. 14C.

Figure 15A:
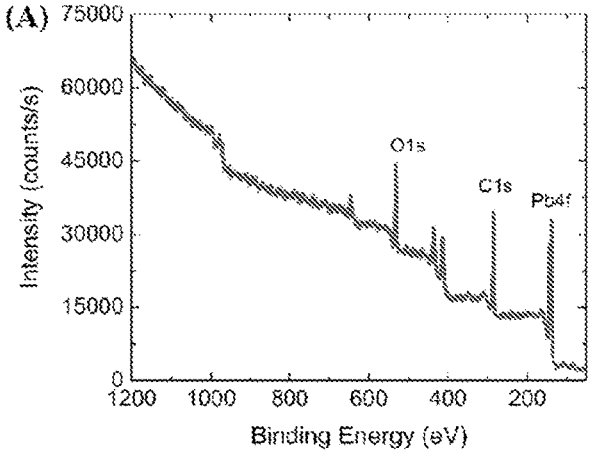

FIG. 15A is a survey scan for a Pb metal disk before MOR.

Figure 15B:
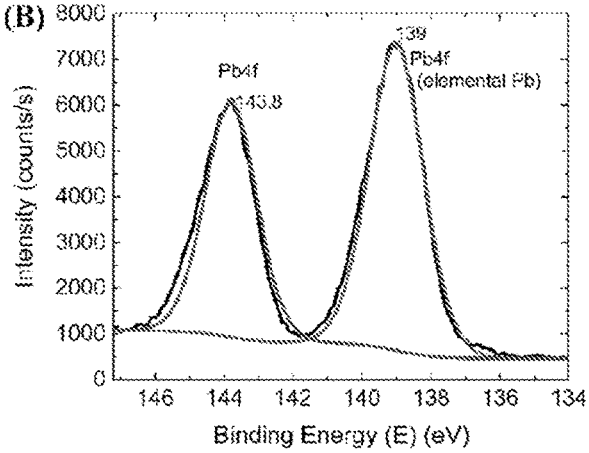

FIG. 15B is an elemental scan for the Pb metal disk of FIG. 15A.

Figure 15C:
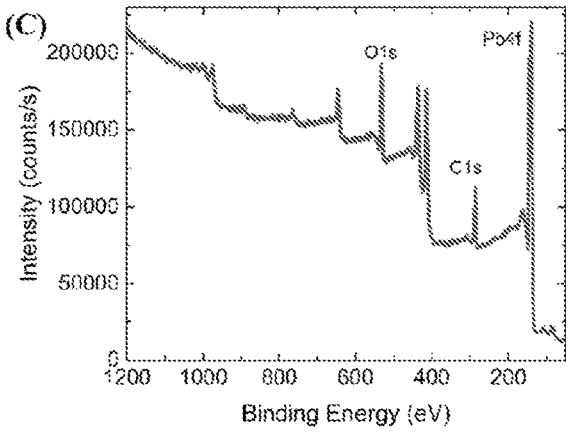

FIG. 15C is a survey scan for a Pb metal disk after MOR.

Figure 15D:
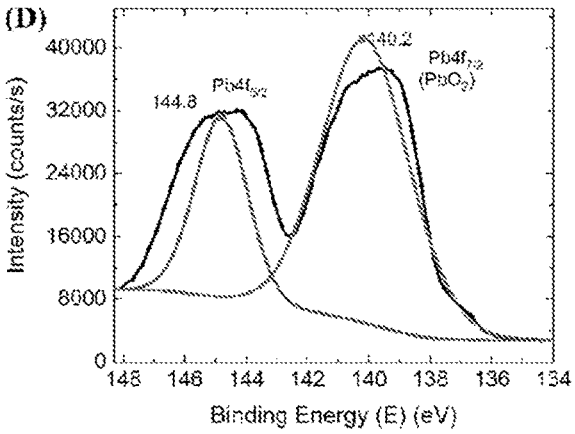

FIG. 15D is an elemental scan for the Pb metal disk of FIG. 15C.

Figure 16:
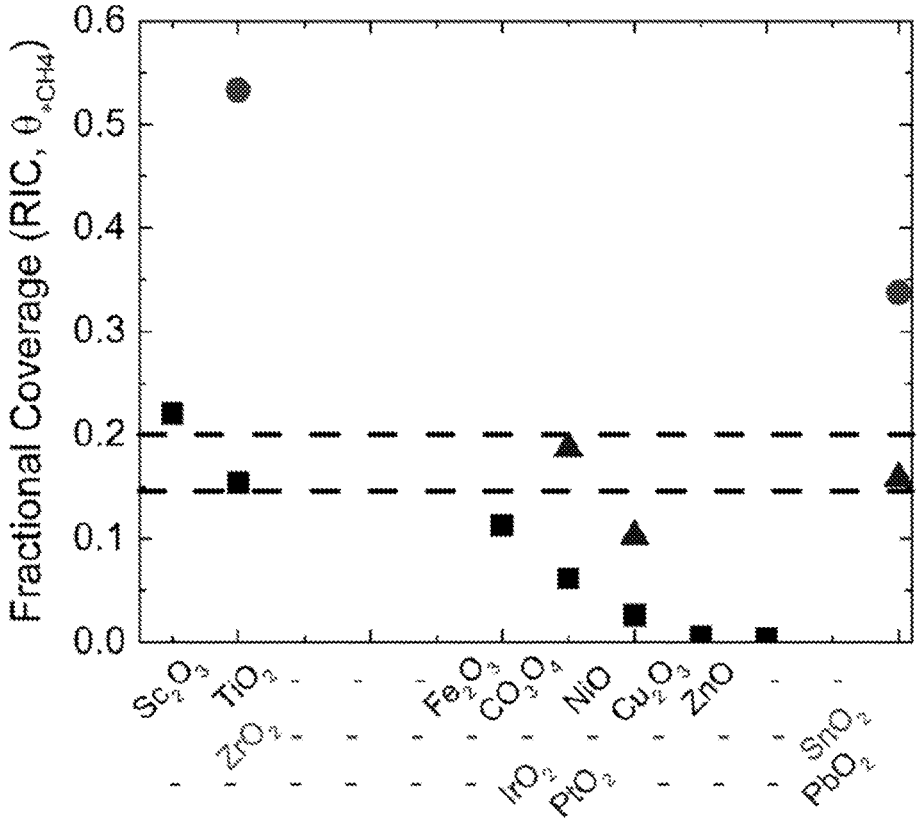

FIG. 16 is a graph showing the experimentally determined fractional coverage of $*CH_4$ for transition metal oxides.

Figure 17A:
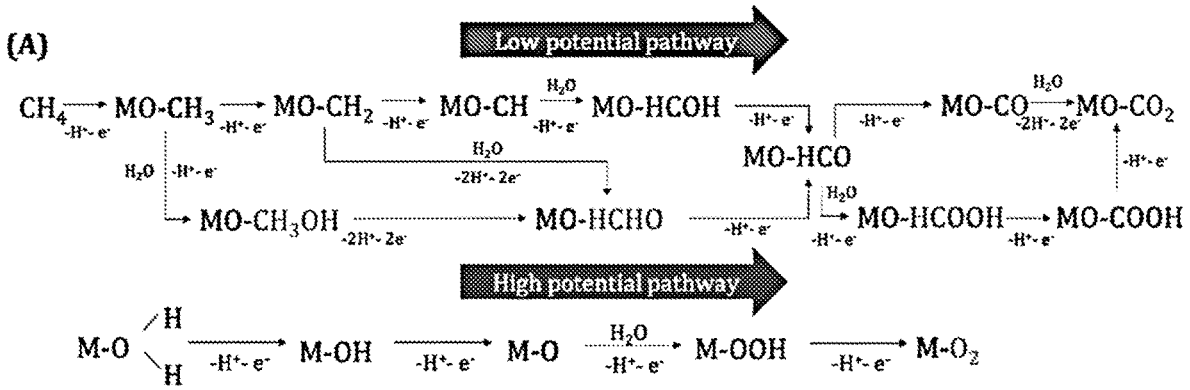

FIG. 17A is an illustration of a reaction mechanism of MOR and OER in an aqueous electrolyte where MO is the transition metal oxide. The species in light gray for MOR indicate stable partial methane oxidation products.

Figure 17B:
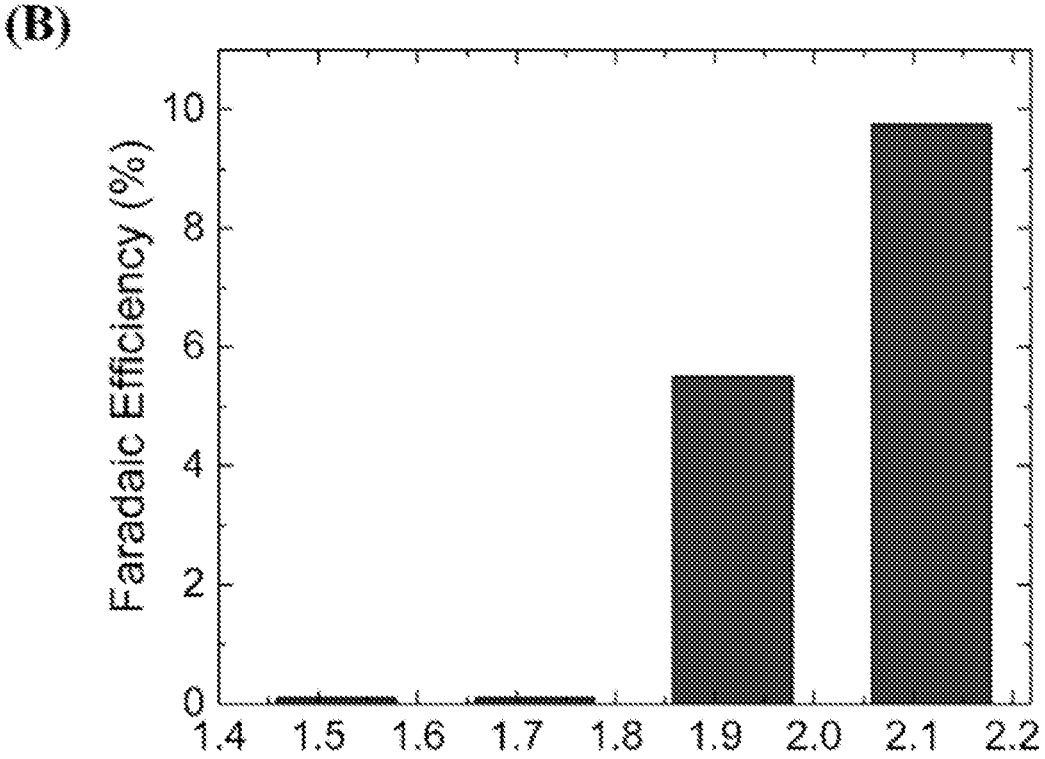

FIG. 17B is a graph of the FE of methanol oxidation reaction to $CO_2$ at different applied potentials for $TiO_2$.

Figure 17C:
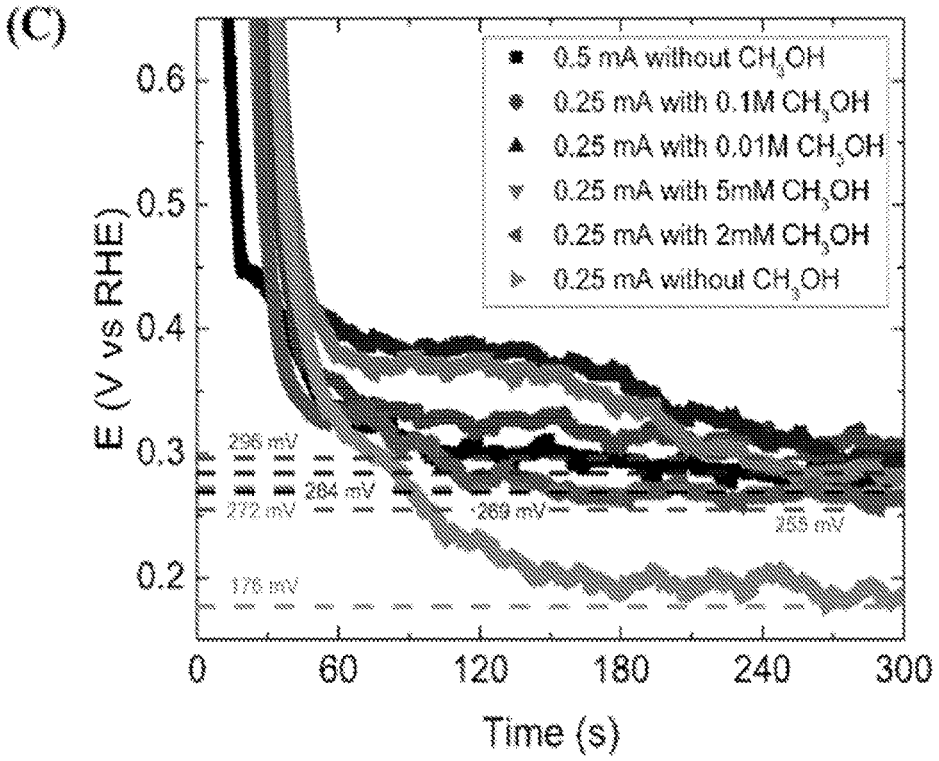

FIG. 17C is a graph of t-OCP experiments for just methane saturated electrolyte, just methane saturated electrolyte at higher current, and methane saturated electrolyte with artificially introduced varied concentrations of $CH_3OH$ in the electrolyte.

Figure 18A:
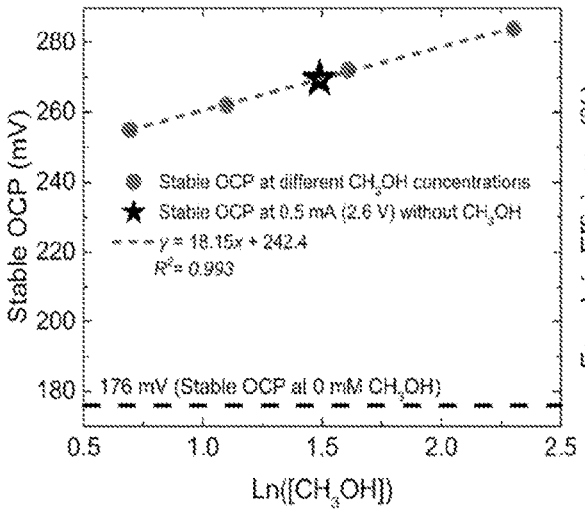

FIG. 18A is a graph showing the shift in the stable OCP with increasing concentrations of $CH_3OH$ in phosphate buffer electrolyte for an initial current of 0.25 mA at 1.8 V. The linear relation is similar to the Nernst equation. The increase in stable OCP from 176 mV for 0.25 mA to 269 mV for 0.5 mA initial current in $CH_4$-saturated phosphate buffer electrolyte without added $CH_3Oh$ indicates the formation of *CHOH on $TiO_2$.

Figure 18B:
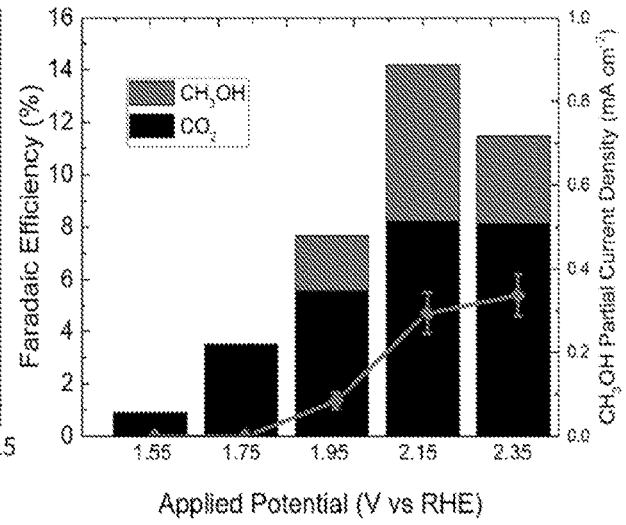

FIG. 18B is a graph showing the FE and partial current density of $CH_3OH$ on $Cu_2O_3$—TiO bimetallic catalyst in $CH_4$-saturated 0.1 M potassium phosphate buffer.

Figure 19:
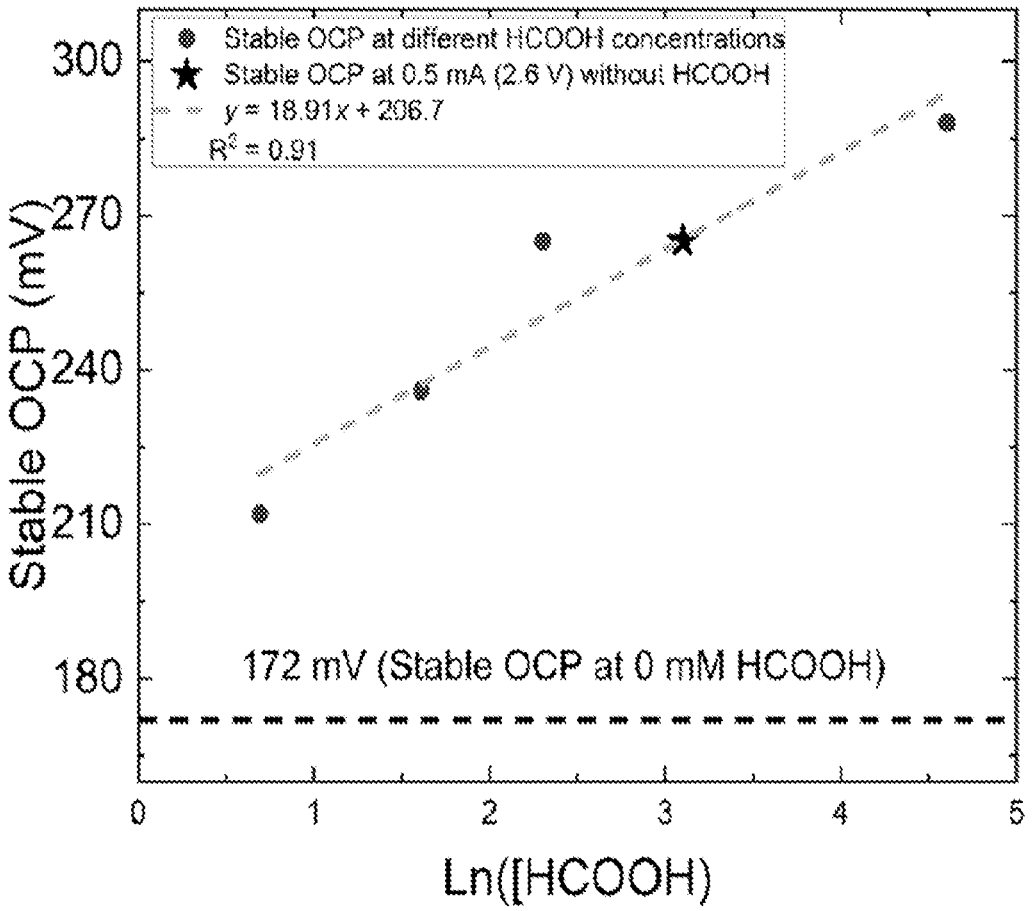

FIG. 19 is a graph showing the stable shift in OCP with increasing concentration of HCOOH in phosphate buffer electrolyte for an initial current 0.25 mA at 1.8 V.

Figure 20:
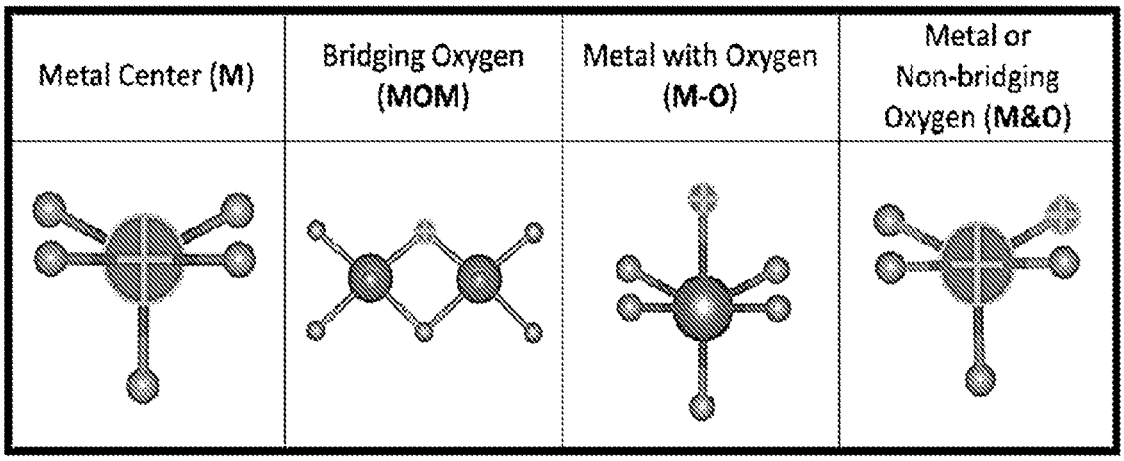

FIG. 20 is a pictorial representation of the binding site utilized. Atoms marked with "+" indicate where each intermediate is bound.

Figure 21:
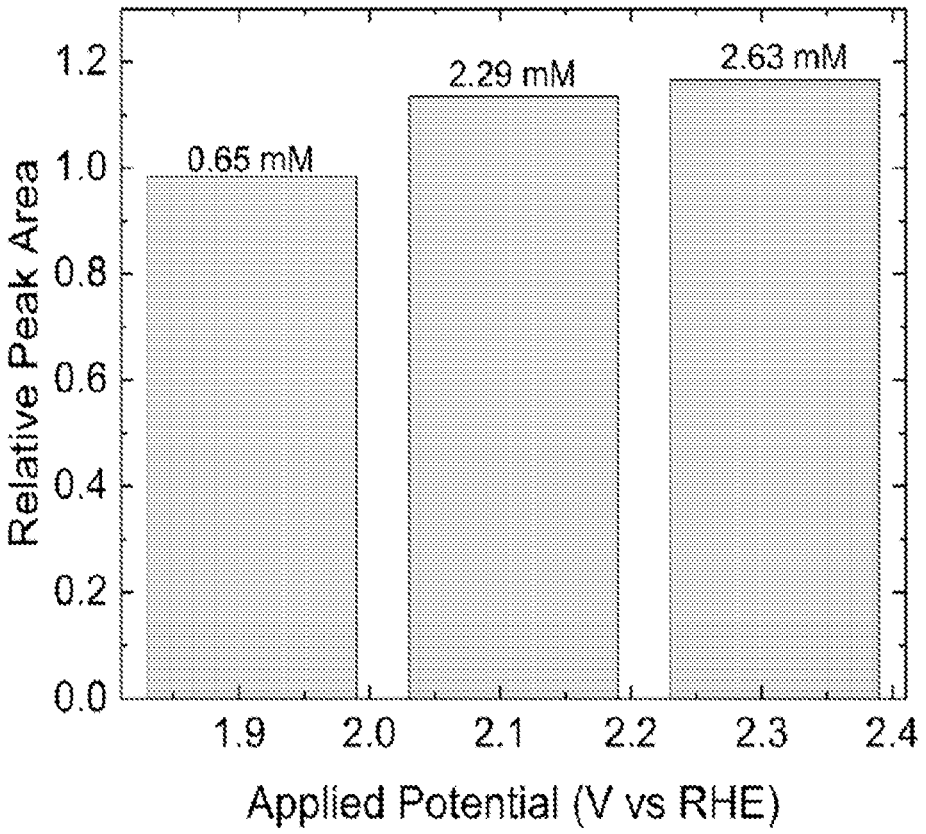

FIG. 21 is a graph showing the concentration of $CH_3OH$ obtained post-MOR at different applied potentials.

Figure 22:
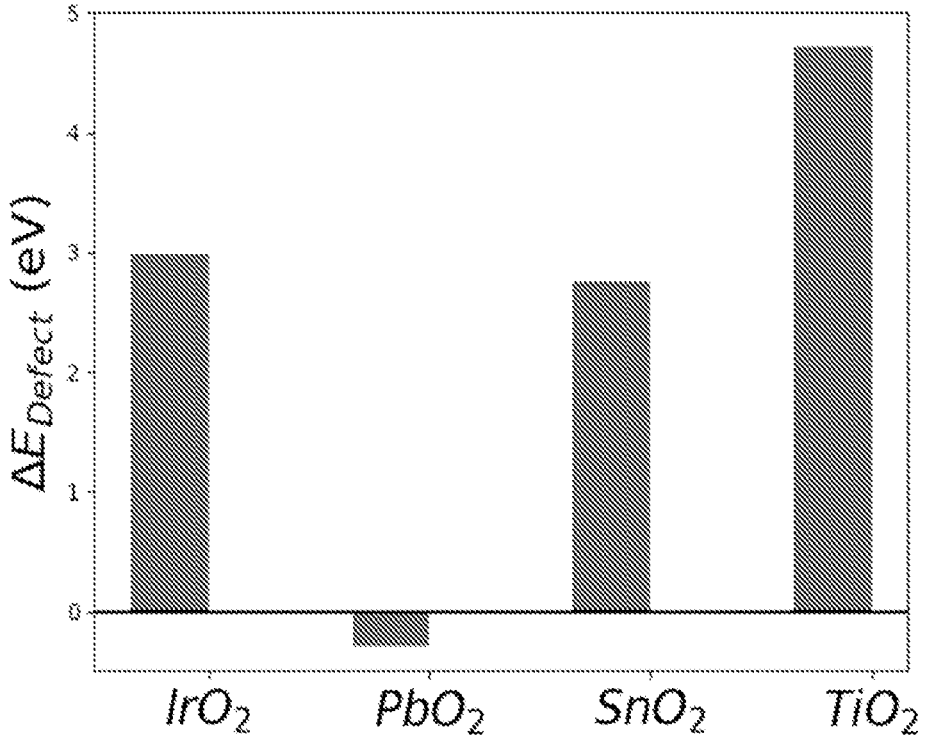

FIG. 22 is a graph showing the reaction energy in eV of $*\rightarrow*_{Defect}+\frac{1}{2}O_2(g)$ where $*_{Defect}$ indicates the vacancy of one of the bridging oxygen on the surface.

Figure 23:
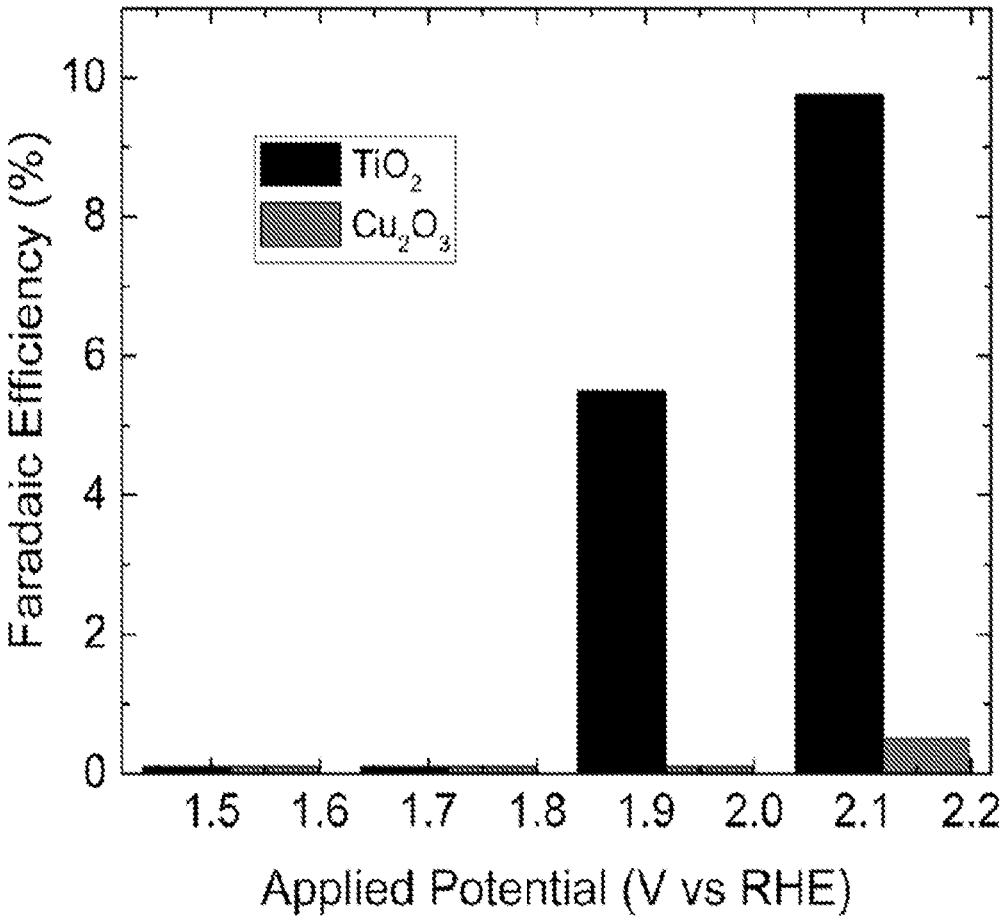

FIG. 23 is a graph showing the FE of methanol oxidation to $CO_2$ over $TiO_2$ and $Cu_2O_3$ in 1 mM methanol in 0.05 M phosphate buffer.

Figure 24:
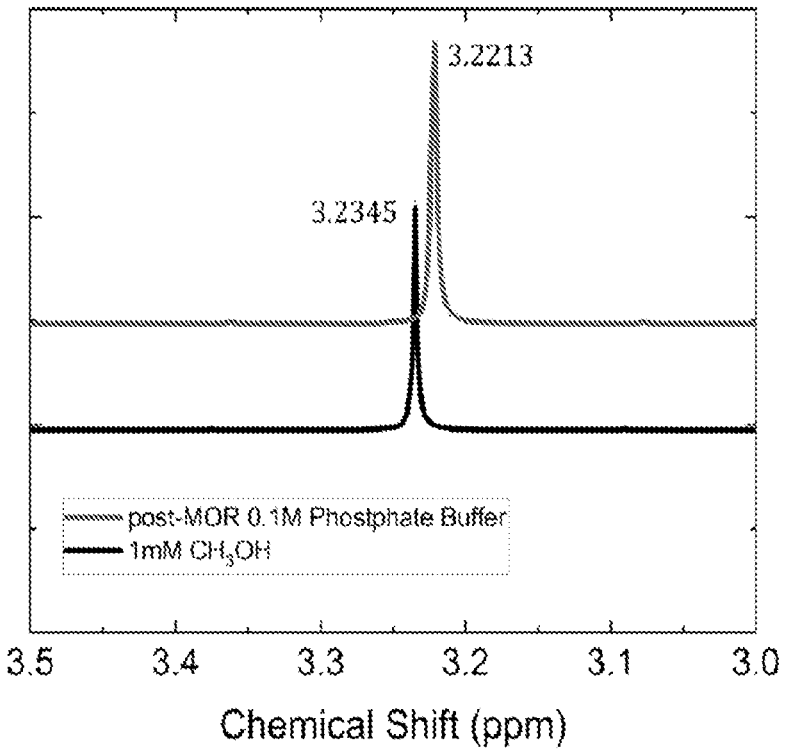

FIG. 24 is a 1 D 1 H NMR spectra of 1 mM $CH_3OH$ in water and post-MOR electrolyte after the chronoamperometry performed at 2.31V vs RHE.

Figure 25:
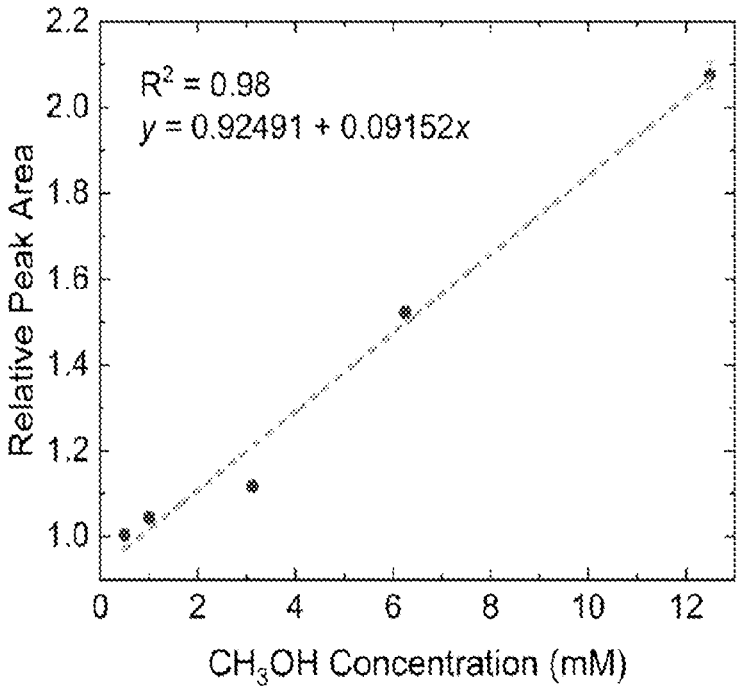

FIG. 25 is a graph of a calibration curve using HPLC for varying concentrations of $CH_3OH$.

Figure 26:
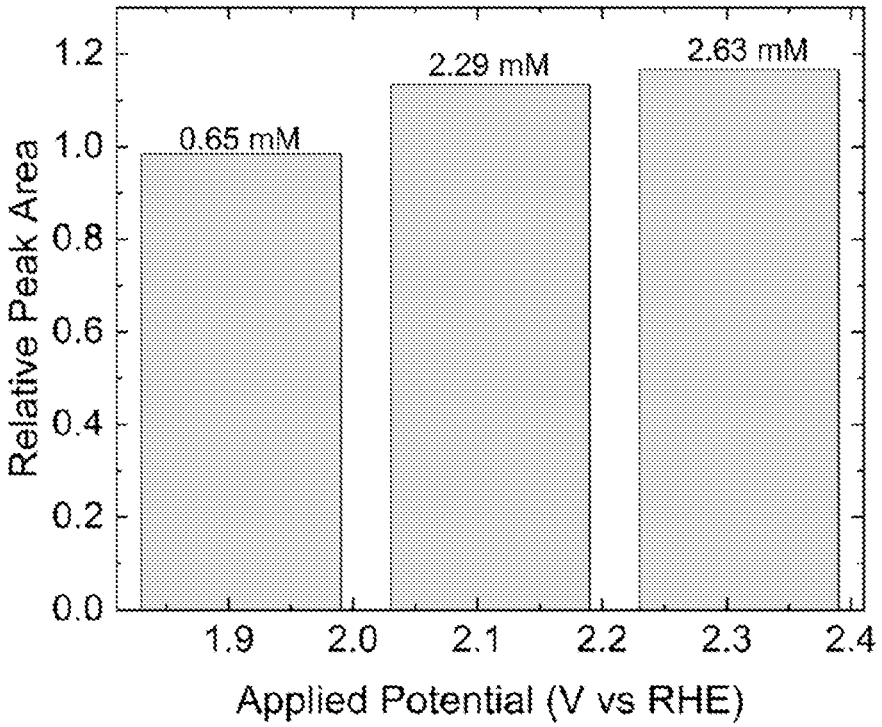

FIG. 26 is a graph showing the concentration of $CH_3OH$ obtained post-MOR at different applied potentials.

Figure 27A:
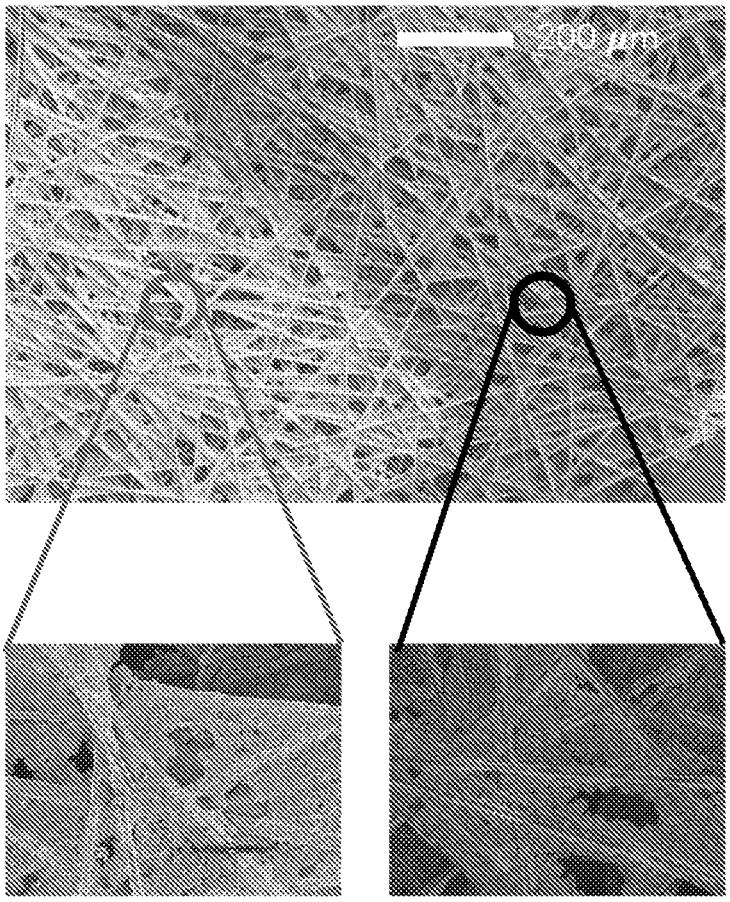

FIG. 27A is an SEM micrograph of the patterned Cu—Ti catalyst, pre-MOR. The zoomed-in image shows the Cu region on the left and the Ti region on the right.

Figure 27B:
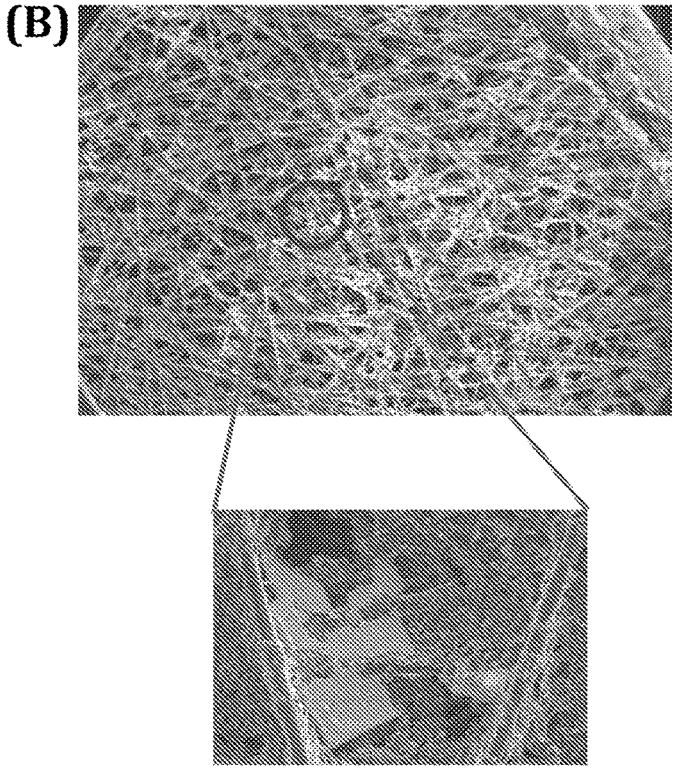

FIG. 27B is an SEM micrograph of the patterned Cu—Ti catalyst, post-MOR. The zoomed-in image shows the overlap of Cu—Ti interface.

Figure 27C:
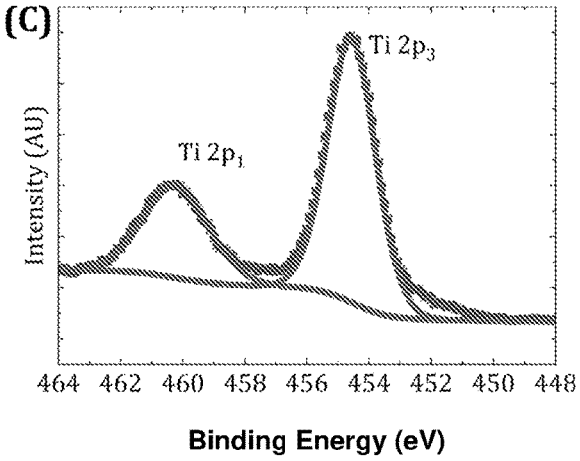
Figure 27D:
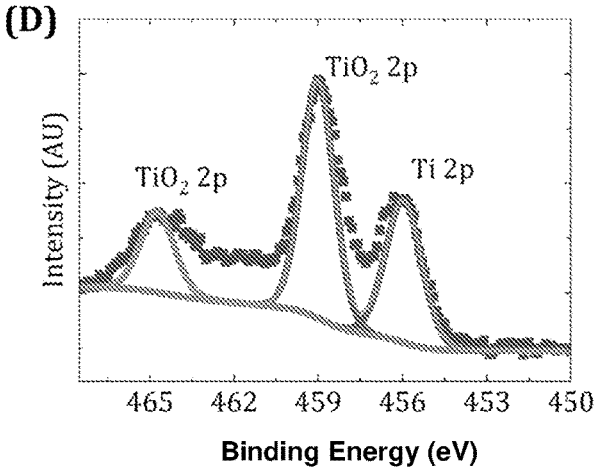

FIGS. 27C and 27D are XPS spectra of Ti (C) pre-MOR and (D) post-MOR.

Figure 27E:
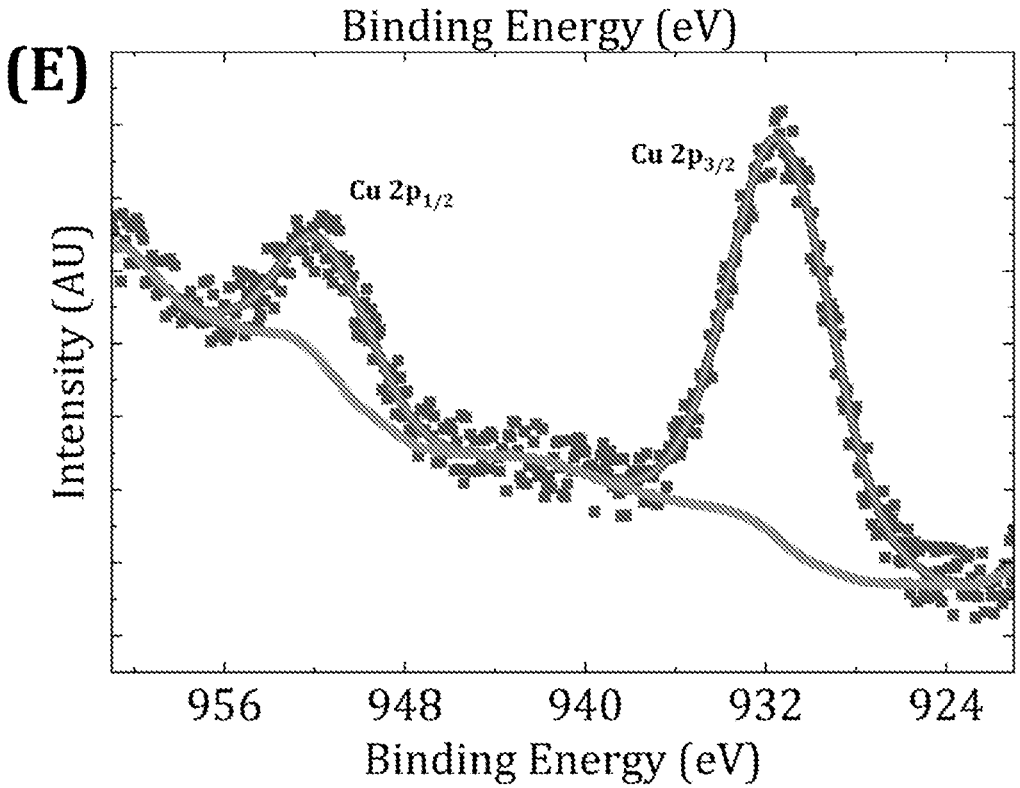
Figure 27F:
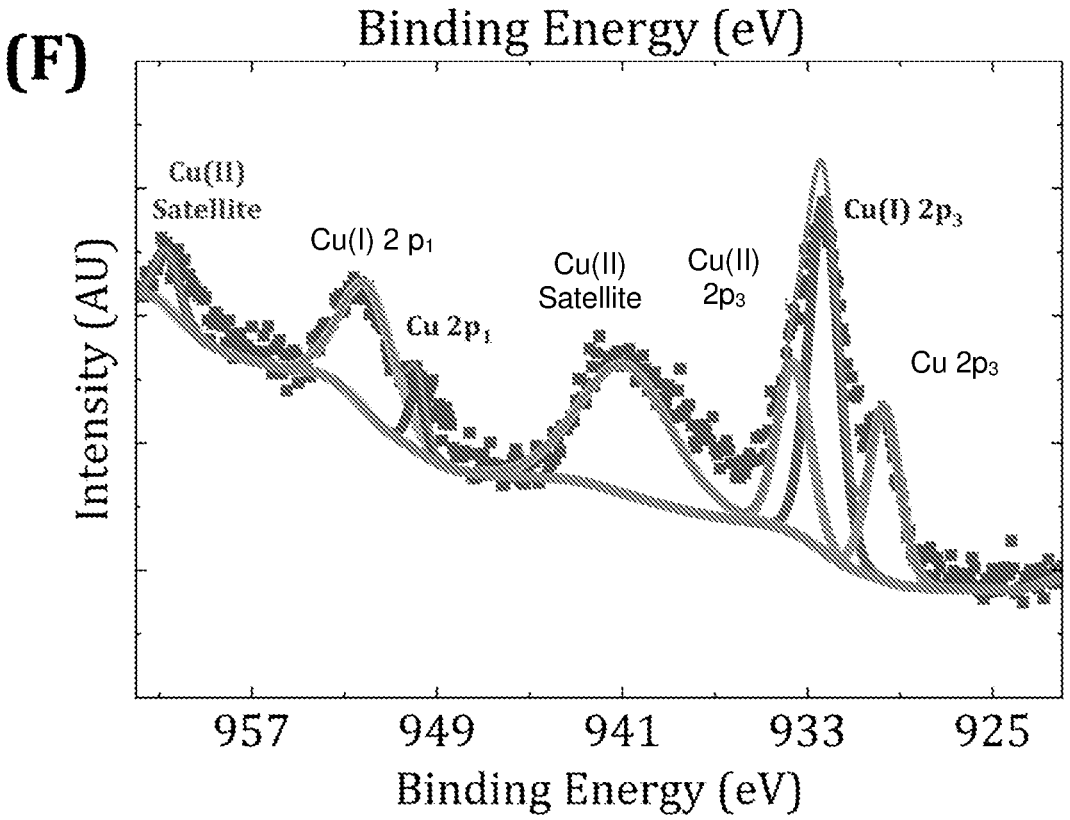

FIGS. 27E and 27F are XPS spectra of Cu (E) pre-MOR and (F) post-MOR.

Figure 28:
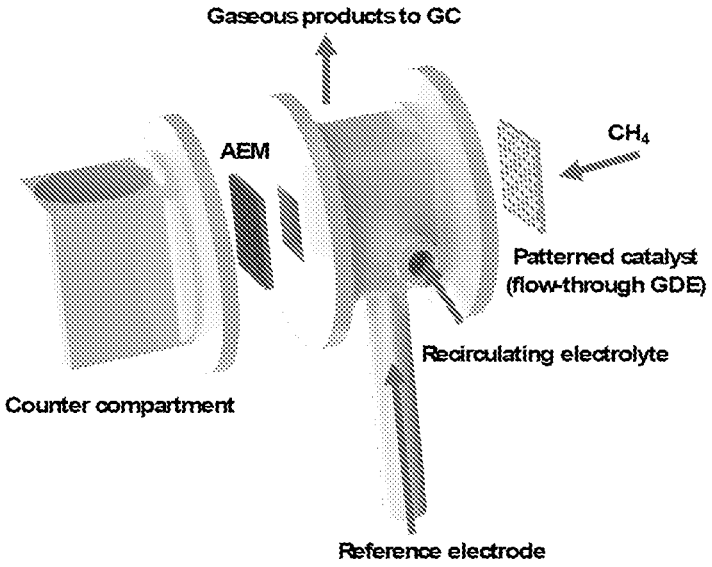

FIG. 28 is a schematic of a flow-through gas diffusion electrode electrochemical cell in accordance with the disclosure.

Figure 29A:
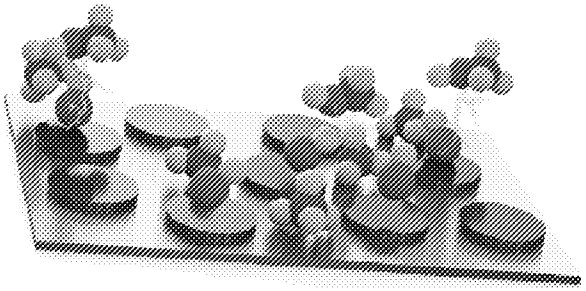

FIG. 29A is a schematic representation of electrodeposited Cu islands on a planar $TiO_2$ catalyst. The interaction between the *OH-active Cu oxide sites adjacent to $*CH_3$-active $TiO_2$ sites leads to favorable partial oxidation of $CH_4$ to $CH_3OH$.

Figure 29B:
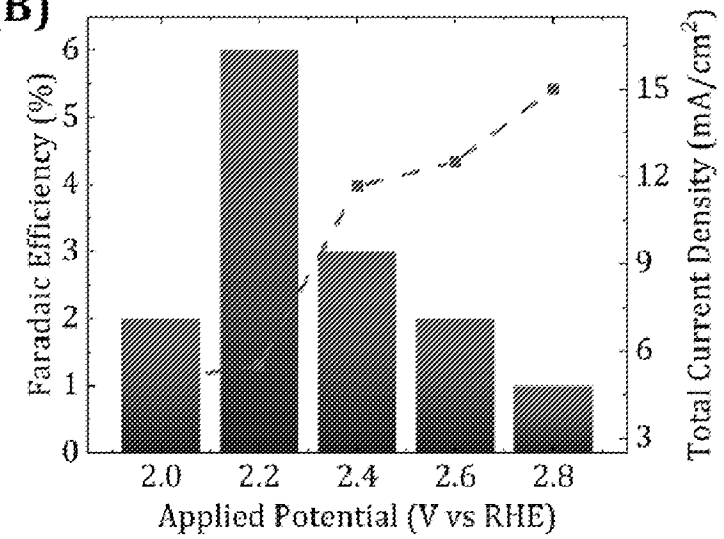

FIG. 29B is a graph showing the FE of $CH_3OH$ under a wide range of overpotential. The bar shows the FE of $CH_3OH$ and the black markers indicate the total current density of the H-cell.

Figure 30:
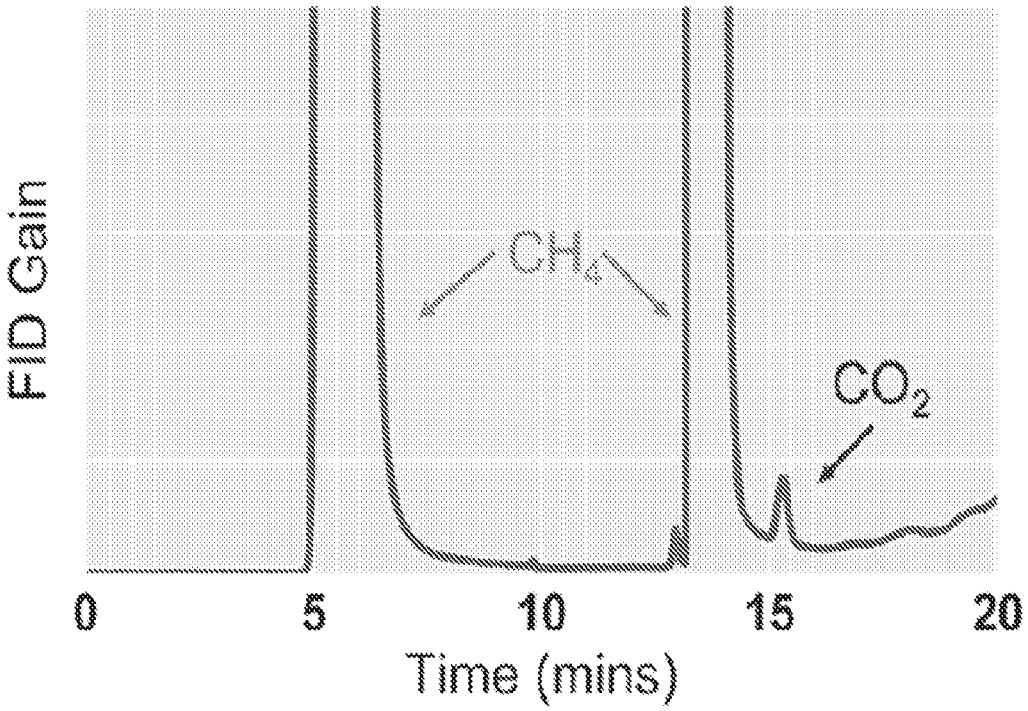

FIG. 30 is a gas chromatograph of the MOR control experiment on $PtO_2$ in 1 M KCl electrolyte at 2.31 V vs RHE.

Figure 31A:
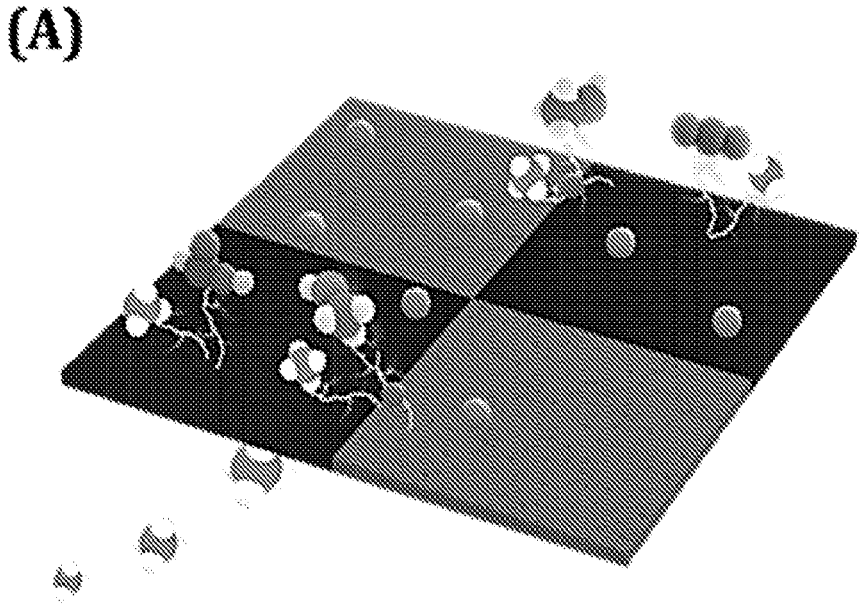

FIG. 31A is a schematic representation of two active sites responsible for MOR activity of different products. The light gray squares represent the Cu pattern, and the black squares represent the Ti pattern of the bimetallic catalyst. $CH_3OH$ is formed at the active sites at the interface, and $CO_2$ and HCOOH are formed on titania.

FIG. 3B is a graph showing the activation barrier of methane dissociation on $Cu_2O$ (111) as a function of uniform electric field strength. The fields investigated were likely much lower than those near a chloride ion, cations typically have a local field strength of ~1 V/Å on Cu (111).

Figure 32:
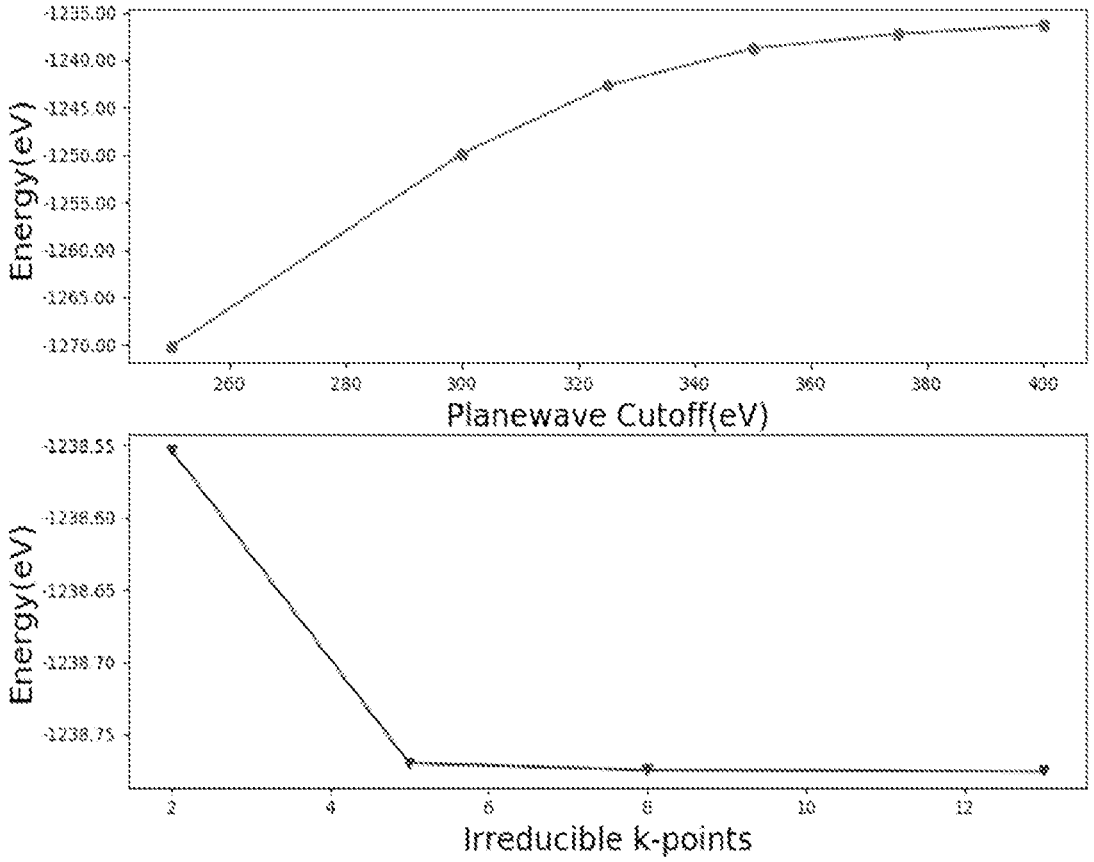

FIG. 32 is a graph showing the adsorption energy of $CH_4$ on the reduced $IrO_2$ surface with respect to planewave cutoff and k-point mesh. The calculations done on varying planewace cutoff include a 4×4×1 k-points mesh and the calculations done varying k-points include a planewave cutoff of 350 eV.

DETAILED DESCRIPTION $CH_4$ is a stable, nonpolar molecule. It is known to bind weakly on transition metals through a dissociative mechanism, whereas all the $CH_x$ (x=1-3) intermediates bind more strongly. $CH_4$ oxidation to CO is preferable through the dissociative chemisorption of $CH_4$ on Pt with the sequence $*CH_3\rightarrow*CH_2\rightarrow*CHOH\rightarrow*CHO\rightarrow*CO$. Oxygen-assisted dehydrogenation drives the selectivity of the reaction to either $CH_xO_y$ or $CO_x$ products. The presence of oxygen on transition metals in the form of metal oxides has been determined to play a key role in C—H bond activation and the oxidation of $CH_4$. Under anodic overpotentials, dissolved $CH_4$ dissociates to form $*O—CH_3$ ($CH_3$ bonded to metal oxide) and *O—H. Because of H—C—H bond symmetry in $CH_4$ and $CH_3$, the energy needed to break (or activate) the C—H bond is equal to the energy required to transfer H from $CH_4$ to *O (metal oxide). The activity descriptor for methane oxidation reaction is $E_{OH}$-$E_O$, whereas the activity descriptor for oxygen evolution reaction (OER) is $E_O$-$E_{OH}$. The participation of *O species in both MOR and OER is the primary cause for the competitive kinetics determining the selectivity of $CH_4$ oxidation on transition metal oxides.

Figure 1:
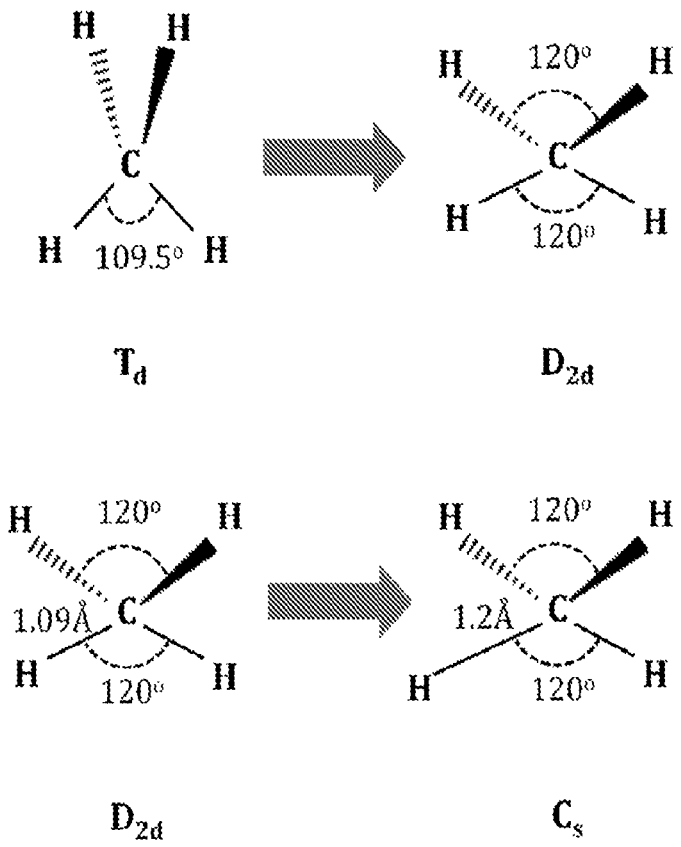
FIG. 1 is a schematic illustration of molecular transformations $T_d$ to $D_{2d}$ during adsorption and $D_{2d}$ to $C_s$ during activation of the C—H bond for the methane oxidation reactions.

The mechanism of $CH_4$ adsorption involves the transformation of tetrahedral ($T_d$) symmetry to the H—C—H bond-angle-distorted ($D_{2d}$) structure followed by C—H bond elongation and adoption to $C_s$ conformation. This symmetry transformation can also be explained using the molecular orbital theory. The $T_d$ symmetry of $CH_4$ (with bond angle 109.5°) has two occupied orbitals—$a_1$ and $t_2$—and two unoccupied antibonding orbitals—$a_1$* and $t_2$*. The interaction of $CH_4$ with the transition metal oxide causes the threefold degenerate $t_2$ set to split into the destabilized $b_2$ state because of reduced overlap between 2p and 1s orbitals and the stabilized twofold degenerate estate because of an increase in C—H bonding character. Similarly, the unoccupied $t_2$* orbital splits into a stabilized $b_2$* state and destabilized a twofold degenerate e* state because of the antibonding character of C—H bonds. The destabilization of $t_2$ and $t_2$* orbitals results in the distortion of adsorbed $CH_4$ to attain $D_{2d}$ conformation with an increased H—C—H bond angle of 120°. The formation of the distorted structure ($D_{2d}$) is then followed by the elongation of one of the C—H bonds to attain $C_s$ conformation. The degree of C—H bond elongation governs the C—H bond activation on different transition metal oxides. FIG. 1 is a schematic illustration of the molecular transformations during adsorption ($T_d\rightarrow D_{2d}$) of $CH_4$ followed by activation ($D_{2d}\rightarrow C_s$). The interactions between $CH_4$ and transition metal oxides are mostly electrostatic in the nonfaradaic region of MOR. The columbic interaction between transition metal oxides and $CH_4$ helps in stabilization of $b_2$ state and $t_2$ orbital and thereby the adsorption of $CH_4$. Without intending to be bound by theory, it is believed that the electrostatic (or Madelung) potential of the metal in the transition metal oxide should have a direct effect on the measured binding energy of $CH_4$. FIG. 3D shows a nearly linear trend between the measured binding energy and the Madelung potential of the metal in the transition metal oxide. The MOR active catalysts had lower Madelung potentials (<−40V) as compared to other inactive catalysts. It can be inferred from FIG. 3D that the MOR active catalysts should have higher methane binding energy (>0.23 eV) and lower Madelung potentials (<−40 V). All of the MOR active catalysts tested in Examples 1-3—$TiO_2$, $PbO_2$, $IrO_2$, and $PtO_2$— satisfied this activity criteria. $ZrO_2$, which satisfied the activity criteria, was not active toward MOR. Without intending to be bound by theory, it is believed that the presence of shared active sites for competitive OER and MOR on $ZrO_2$ results in the lack of activity toward MOR. Additionally, $ZrO_2$ has poor electrical conductivity, which could be a reason for lower activity of OER and inactivity of MOR.

Catalyst and methods of the disclosure can advantageously utilize a gas diffusion electrode or gas diffusion layer in some arrangements to allow for the introduction of the methane or methane containing source in gaseous form. The low solubility of $CH_4$ in water (1.272 mM in water at STP) presents a challenge for MOR activity in aqueous media. The catalysts and methods of the disclosure advantageously provide a reactor that allows for transport of $CH_4$ in gaseous (vapor) form at the anode, which has been observed to help circumvent the solubility problems. Prior work with electrochemical oxidation in an aqueous medium also suffered from corrosion of the catalyst due to the highly oxidizing applied potentials required, resulting in the surface morphology of the catalytic materials evolving constantly and as a consequence material degradation. The catalyst of the disclosure are advantageously stable with high selectivity and high current density for MOR to $CH_3OH$ and HCOOH.

Figure 2A:
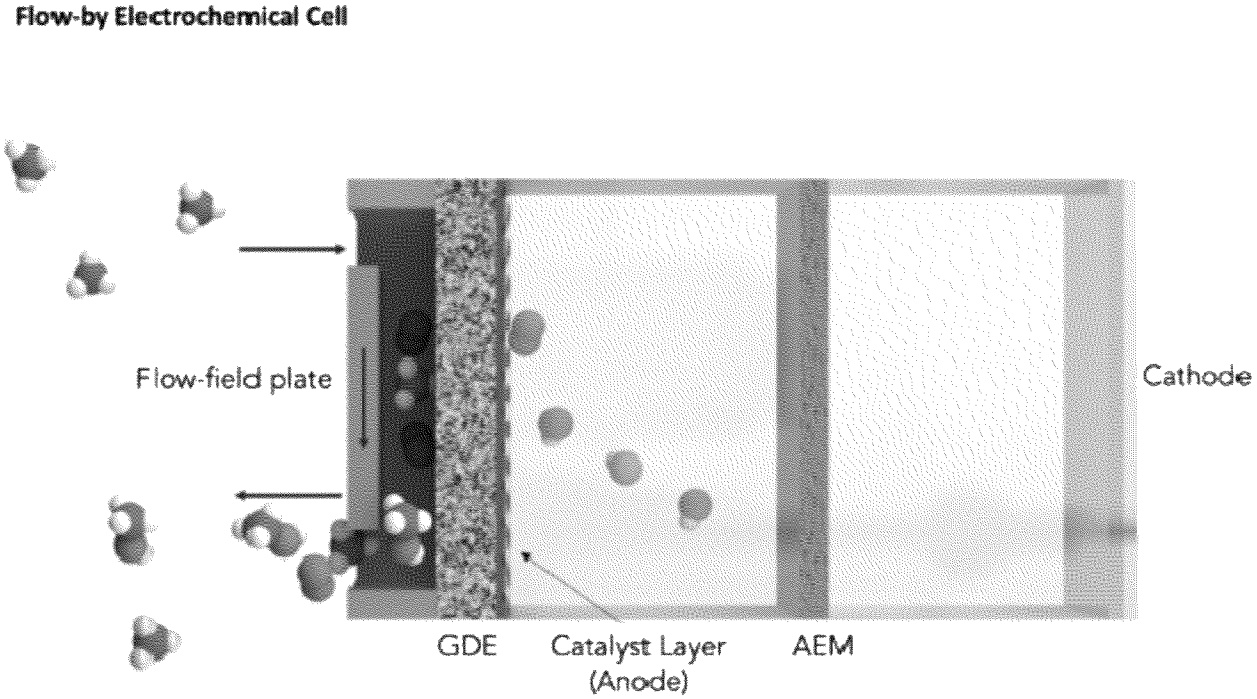
FIG. 2A is a schematic illustration of a flow-by electrochemical cell in accordance with the disclosure.
Figure 2B:
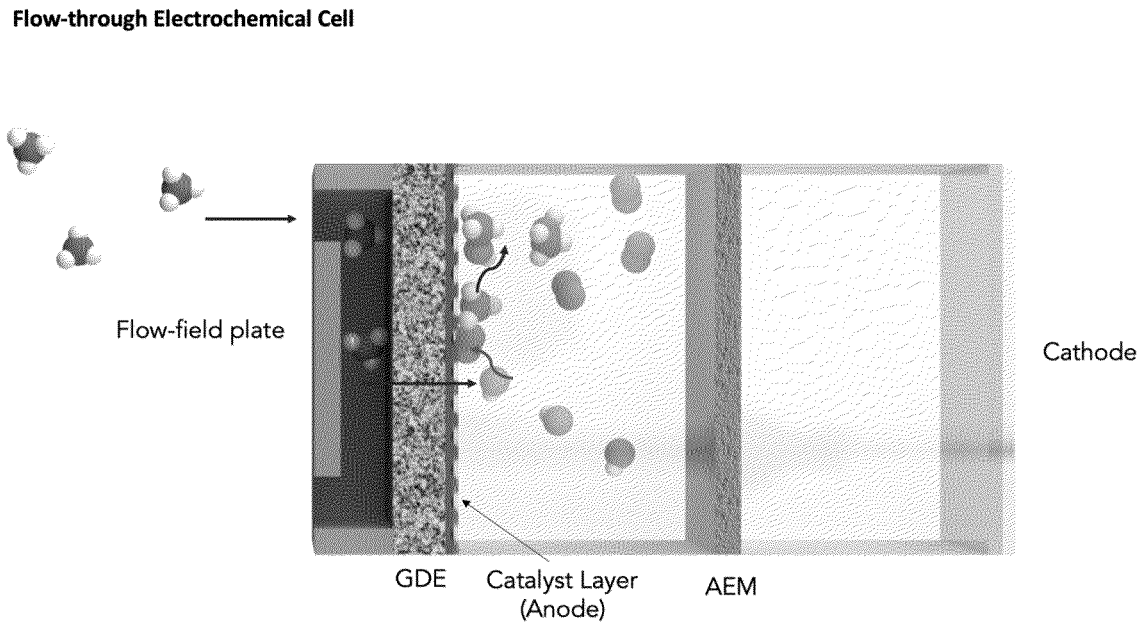
FIG. 2B is a schematic illustration of a flow-through electrochemical cell in accordance with the disclosure.
Figure 2C:
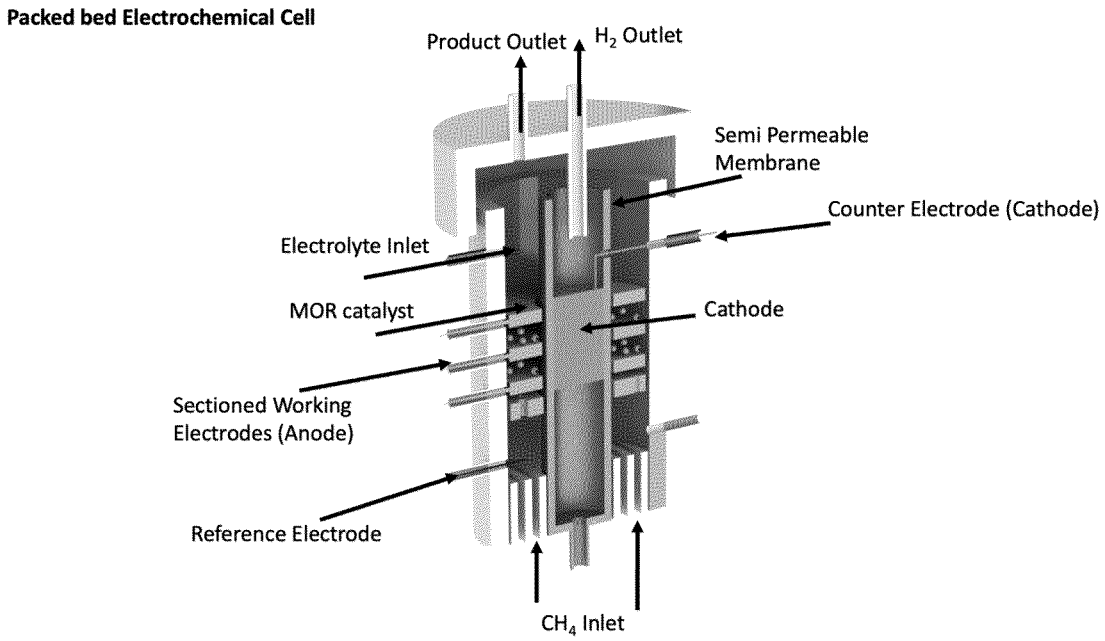
FIG. 2C is a schematic illustration of a packed-bed electrochemical cell in accordance with the disclosure.

An electrochemical cell for conversion of methane to methanol and/or formate can include an anode compartment separated from a cathode compartment by a membrane. The anode compartment comprises an anode immersed in an electrolyte and the cathode compartment comprises a cathode immersed in an electrolyte. Referring to FIG. 2A, the electrochemical cell can be a flow-by cell in which the methane or methane containing source is flowed be and in contact with an anode comprising the catalyst. Referring to FIG. 2B, the electrochemical cell can be a flow-through cell in which methane or a methane containing source is flowed through an anode containing the catalyst. In either arrangement, the anode can be a gas diffusion electrode or include a gas diffusion layer and the catalyst can be supported on or by the gas diffusion electrode or gas diffusion layer. Referring to FIG. 2C, in still further arrangements, the electrochemical cell can be a packed bed cell. The packed bed cell includes a cathode compartment having the cathode surrounded by the anode compartment. The anode is provided as a sectioned anode, with each section having a catalyst layer supported thereon. Any suitable number of sections can be provided. In general, the sectioned anode includes 2 or more sections. In each of the arrangements, the cell includes a gas inlet for introduction of the methane or methane containing source into the anode compartment and/or in contact with the catalyst layer disposed on the anode. The cell further includes a product outlet for recovering covered methanol from the cell.

In any of the arrangements herein, the cell can be a flow through cell in which electrolyte is continuously flowed through the anode and cathode compartments. In such arrangements, the system can further include anolyte and catholyte compartments in fluid communication with the anode and cathode compartments, respectively.

The electrolyte can be a $Cl^-$ containing electrolyte such as, for example, KCl or phosphate buffer solution. Other suitable electrolytes can include anions such as halides. For example, the electrolyte can include $F^-$, $I^-$, and/or $Br^-$.

Any suitable membrane can be used. For example, the membrane can be an anion exchange membrane, a cation exchange membrane, or a semi-permeable membrane.

The bimetallic catalyst is provided in a patterned arrangement of a first metal region and a second metal region and is disposed on a support. The pattern include alternating regions of first and second metals, with an interface being defined between adjacent ones of the first and second metal regions. Referring to FIG. 4A, each of the first and second pattern regions can have a square-shape, triangular, hexagonal, or circular, for example. Each shaped region can have a length or effective diameter of on the order of about a few nanometers to about a few millimeters. For example, the shaped regions can have a length of effective diameter of about 10 nm to about 10 mm, about 100 nm to about 500 nm, about 1 mm to about 4 mm, or about 5 mm to about 10 mm. Other sizes can be contemplated herein as well. For example, for a square-shaped pattern, the first and second metal regions can have a pattern size of about 1×1 mm to 4×4 mm.

Bimetallic catalyst of the disclosure include a patterned surface comprising an alternating arrangement of a first metal selected to provide *OH active sites and a second metal selected to provide $*CH_3$ active sites. The pattern provides multiple interfaces of first and second metal. It has been observed that MOR active sites are present at the interface between the two metals. The first metal combines the methyl group from the $*CH_3$ active sites on the second metal with the *OH bound to the first metal at the *OH active sites to form the methanol and/or formate. Once formed, the methanol and/or formate dissolves into the solution and can be recovered.

The first metal can be any metal that provides *OH active sites. Generally, the first active metal will strongly bind OH. For example, the first active metal can have a CO binding free energy of about 0.1 eV to about 3 eV. For example, the first metal can be one or more of Cu, Pd, Ag, or Ni.

The second metal can be any transition metal that provides *CO active sites and is capable of breaking the first C—H bond of methane to form $*CH_3$. The second metal can be one or more of Ti, Ir, Ru, Sn, Pb and Pt. For example, the second metal can be one or more of Ti, Ir, Pb, and Pt.

A process for converting methane to methanol using an electrochemical cell of the disclosure can include flowing methane or a methane containing source into contact with the catalyst arranged on the anode while applying a potential. Upon contact with the catalyst, methane is converted to methanol and/or formate at the interface between the first and second metal, as described in detail above.

The methane containing source can be, for example, biogas, shale gas, natural gas, mine gas, and/or methane from coal mines.

The processes of the disclosure can have faradic efficiency of methanol production of about 6 to 20%, which is significantly higher than conventional processes. Processes of the disclosure can have a faradaic efficiency of methane oxidation reaction (MOR) of about 10% to about 80%, or about 20% to about 50%.

Processes of the disclosure can be performed at ambient conditions. For example, using ambient temperature and pressure. For example, the process can be performed at room temperature.

The applied potential can be about 1.5 V to about 3V.

Also disclosed herein is a reactant a reactant-impulse chronoamperometry method for measuring $CH_4$ binding energy. The process includes alternating Ar-saturated electrolyte feeds and $CH_4$-saturated feeds while measuring the dynamic change in OER current density. A rotating disk electrode comprising the catalyst can be used. The Ar-saturated electrolyte is first flowed at a fixed temperature and fixed potential. The electrolyte is then switched by flowing the $CH_4$ saturated electrolyte and finally the electrolyte is then switched again back to the Ar-saturated electrolyte. The dynamic change in OER current density can be correlated to the $CH_4$ binding free energy. The electrolytes can be flowed each for about 10 to about 15 mins while measuring the OER current density.

The change in current density is calculated by $$\theta = \frac{I_{OER,Ar} - I_{OER,CH_4}}{I_{OER,Ar}}$$

where θ is the fractional coverage of the $*CH_4$ on the electrode surface, $I_{OER,Ar}$ is the OER current density in Ar-saturated electrolyte, and $I_{OER,CH_4}$ is the OER current density in the $CH_4$-saturated electrolyte. The binding free energy of $CH_4$ is then determined from:

$$\Delta G = RT \ln(K)$$

where R is the universal gas constant (8.314 J $mol^{-1}$ $K^{-1}$) and T is the temperature, and K is $$K = \frac{\theta(1 - x^*}{x^*(1 - \theta)}$$

where x* is the mole fraction of dissolved $CH_4$ in the electrolyte.

The fixed potential can be about 1.3 V to about 1.5 V. The temperature can be about 25° C. to about 70° C. For example, the temperature can be ambient temperature.

EXAMPLES

Example 1: Electrocatalyst Preparation and Characterization

Transition metal plates of $Sc_2O_3$, $TiO_2$, $ZrO_2$, $Fe_2O_3$, $Co_3O_4$, NiO, $Cu_2O_3$, ZnO, $IrO_2$, $PtO_2$, $SnO_2$, and $PbO_2$ (>99.9% purity, ACI Alloys) of 1 mm thickness were cut into disks of 8-mm diameter and polished using alumina suspensions followed by sonication in deionized water and drying under Ar flow. The transition metals disks were utilized as the working electrode in the electrochemical cell.

The Cu—Ti bimetallic catalyst was prepared by electrodepositing Cu on a Ti disk from 0.1 M $Cu(NO_3)_2$ (pH=2) at −2V versus Ag/AgCl for 45 min. A membrane-less H-cell as shown in FIGS. 5A and 5B was used for electrodeposition. A 0.1 M solution of Cu(NO3)2 (pH=2) was sparged with Ar for 30 minutes at 50 sccm and then introduced into the H-cell. A weighed Ti disc was then immersed in the solution and chronoamperometry was performed by applying −2V (vs Ag/AgCl) at the Ti disc for 45 minutes. This time was sufficient to deposit enough Cu to cover most of the surface of the disc. The disc was then taken out of the solution and rinsed thoroughly with DI water and dried under Ar. The dried disc was weighed to determine the loading percentage of Cu using:

$$\%\ \text{loading} - \frac{(W_{final} - W_{initial})}{W_{initial}} \times 100$$

where $W_{initial}$ is the initial weight of the Ti disc before electrodeposition and $W_{final}$ is the final weight after electrodeposition.

Referring to FIG. 5A, the electrochemical cell was designed in SOLIDWORKS and printed using a PMMA clear resin in a FormLabs Form 2 3D printer. The printed parts were then washed with isopropyl alcohol for 30 mins and are UV cured for 3 hours. All the experiments were performed in this 3D printed H—Cell. The resin used is resistant to harsh chemical environments. Approximately 6 mL of 0.1M phosphate buffer solution (pH=7.0) and 0.1M KOH (pH=13.0) were used as electrolytes for all the experiments in the H—Cell. The cell consists of a working and a counter compartment each holding approximately 3 mL of electrolyte. A Pt strip was used as the counter electrode in the counter compartment. The gas inlet on one side of the working compartment had a frit is fitted to allow methane to be sparged through for an enhanced mass transfer at gas-liquid interface. On the other side of the working compartment, an Ag/AgCl micro-reference electrode (Innovative Instruments) was inserted. The overall applied potential to the working electrode was determined by:

$$V_{actual} = V_{applied} + 0.205 + 0.059 \times \text{pH}$$

The working and the counter compartments were separated by an anion exchange membrane (Excellion, Snow Pure technologies) which was pretreated by hydrating the membrane in deionized water for 48 hours at 85° C. followed by a similar treatment with the electrolyte for 12 hours. The top of the working compartment was sealed by a rubber cork with two circular openings. One of them was used to insert the working electrode disk from the top and the other served as the outlet of the gases which go to GC for product determination. The entire setup was placed on a magnetic stirrer plate where the electrolyte in the working compartment was stirred at 200 rpm.

Linear sweep voltammetry was performed under oxidation potentials to develop an oxide layer, followed by chronoamperometry in a $CH_4$-sparged H—Cell. The linear sweep voltammetry (LSV) was performed at a rate of 5 mV/s in a wide range of oxidation potentials (0-3.11 V vs RHE). FIGS. 6A-6O shows the LSVs of the transition metals used.

For both neutral and alkaline media experiments, the electrolyte solution was saturated with methane for 1 hour. Methane saturated electrolyte was transferred to the H-Cell and for each electrode, chronoamperometry was performed for ~2 hours at a fixed potential. At the interval of 20 minutes, the gas products evolved were detected by passing the outlet from the electrochemical cell to an SRI GC 8610C MG #5 with argon as the carrier gas and the product detection was done through thermal conductivity detector (TCD) and flame ionization detector (FID). The product gases in the GC were passed through two size-exclusion columns, Mol-sieve 8A and HaySep D. HaySep D efficiently separates larger molecules like CH4 and CO2 and were detected by FID. Smaller molecules like $O_2$ (from oxygen evolution reactions (OER)) were separated through Mol-sieve 8A and detected by TCD. The potential was varied in the range of 1.5 to 2.4 V vs RHE to determine the onset potential for methane oxidation for each Electrode.

FIGS. 7A and 7B shows the product distribution obtained from the oxidation of $CH_4$-saturated electrolyte using the 12 stable transition metal oxide electrodes in neutral (pH 7.2) and alkaline (pH 13) conditions. The missing first-row transition metals such as V, Cr, and Mn in FIGS. 7A and 7B were not stable in a wide pH range. While $O_2$ is the dominant product on the majority of the transition metal oxides, $CO_2$ was produced only on $TiO_2$, $IrO_2$, and $PbO_2$ in phosphate buffer solution. Since phosphate ions can specifically adsorb and poison Pt surfaces, $PtO_2$ did not show any activity toward MOR in phosphate buffer. However, a significant selectivity (~10% FE) to MOR was observed on $PtO_2$ in 1 M KCl electrolyte. Comparing FIG. 7A to 7B, it was observed that the four active MOR catalysts show a higher FE in the neutral medium. Without intending to be bound by theory, it is believed that this is because there is a higher concentration of $OH^-$ in alkaline medium (0.1 M $OH^-$) that specifically adsorbs to the positive electrode and oxidizes to produce $O_2$, which reduces the availability of the free site for MOR.

FIG. 8A, shows the variation of FE of MOR producing $CO_2$ with increasing applied potential of the active transition metal oxides in neutral pH phosphate buffer electrolyte. The onset potentials for MOR were found to be 1.65, 1.9, and 2.1 V verse RHE for $TiO_2$, $IrO_2$, and $PbO_2$, respectively. These onset potentials are the lowest applied potential for which the produced $CO_2$ was detected in gas chromatography. FIG. 8B shows the partial current densities of MOR producing $CO_2$ at different applied potentials. The Tafel slopes of MOR increased in the following order: $PbO_2$, 190 mV/dec; $TiO_2$, 232 mV/dec, and $IrO_2$, 274 mV/dec. The exchange current density also followed a similar trend: $PbO_2$, $6.5\times10^{-13}$ mA/cm$^{-2}$; $TiO_2$, $9.2\times10^{-11}$ mA/cm$^{-2}$; $IrO_2$, $6.6\times10^{-9}$ mA/cm$^{-2}$. $IrO_2$ had the highest intrinsic rate of MOR, but suffered greatly from the higher Tafel slope. The large Tafel slopes of the three transition metal oxides are indicative of passive oxide layer formation, which increases the resistance for electron transfer.

$IrO_2$ had the highest Tafel slope for MOR (274 mV/dec). However, as the applied potential increased, the FE of $CO_2$ increased. This can be attributed to the increase in the Tafel slope of OER at higher potentials. Higher Tafel slopes imply a greater resistance to an electrochemical reaction. If OER has a higher Tafel slope, then it would imply that the catalyst would show an increase in activity of MOR as the potential increases. FIG. 9 shows the OER Tafel plot obtained using the OER partial current density from the chronoamperometry studies of MOR on $IrO_2$ at 1.9, 2.1, 2.3, and 2.5 V vs. RHE. The OER partial current density can be inferred from the FE and MOR partial current density ($i_{MOR}$) shown in FIGS. 8A and 8B.

The Tafel slope was 971 mV/dec, which was higher than that of MOR. This high value of the Tafel slope is attributable to the presence of the competing MOR simultaneously taking place on the same electrode.

In contrast, the Tafel slope for higher potentials (1.7-2.3 V vs RHE) obtained from the LSV of the Ar-sparged electrolyte for purely OER (FIG. 6L) was calculated to be 546 mV/dec, which increased further with increasing applied potential. This Tafel slope was similar to the value obtained (586 mV/dec for V>1.7 V vs RHE) in the literature for OER on $IRO_2$ in a phosphate buffer solution at higher potentials.

Characterization of Electrodes: The metal oxide electrodes for methane oxidation reaction (MOR) were characterized by scanning electron microscopy (SEM), energy dispersive X-ray spectroscopy (EDS), and X-ray photoelectron spectroscopy (XPS) before and after electrocatalysis. SEM and EDS were performed using Hitachi S4800 Field Emission SEM. XPS measurement was conducted using Thermo Scientific ESCALAB 250XI microprobe with an Al $K_\alpha$ source. The image scans were done at an accelerating voltage of 5 kV and 10 μA of emission current at nearly 10000× and 60000× magnification. The EDS point identification was done at an accelerating voltage of 20 kV and enabling the signals from both the upper and lower detectors to get the maximum signal collection.

Referring to FIGS. 10-12, comparing the SEM and EDS analysis for the active metals before and after MOR, it was observed that the surface of the catalysts post-electrocatalysis had a rougher texture. This was attributed to formation of the oxide layer during MOR. The oxygen peaks detected in the EDS spectrum after MORE indicated that there was a layer of oxide formed on the surface of the transition metal disks. This was further confirmed by XPS. Referring to FIGS. 13-15, XPS for active electrocatalysts before and after electrocatalysis consisted of a survey scan to check for impurities and an elemental scan to assess the chemical state of the electrodes. All XPS spectra were corrected for charge shift using C 1s at 284.8 eV as the reference. It was observed that the binding energies of the elemental peaks were shifted to a higher value indicating incorporation of electron withdrawing groups or the formation of oxide layers on the metals (FIGS. 13B, 13D, 14B, 14D, 15B, 15D).

Example 2: Reactive-Impulse Chronoamperometry for Estimation of $CH_4$ Binding Energy The dissolved $CH_4$ in the electrolyte must bind or at least interact with the active sides on the electrode before the activation of the C—H bond can occur. It has been postulated that the activation of the C—H bond involves the dissociation of $CH_4$ to form *O—$CH_3$ and *O—H. The energy of such a dissociation of $CH_4$ is difficult to measure. However, the binding energy of $CH_4$ in the preactivation step (*+$CH_4$→*$CH_4$) can be measured and correlated with the $CH_4$ activation energy. The decrease in OER current density was measured by exchanging Ar-saturated electrolyte with $CH_4$-saturated electrolyte. The adsorption of $CH_4$ on the transition metal decreases the active sites for OER, and thereby decreases the OER current density, which can be used to estimate the fractional coverage and binding energy of *$CH_4$ on the transition metal oxides. FIG. 3A shows a schematic illustration of this reversible process of $CH_4$ binding to the transition metal oxides and its influence on OER intermediate coverages. As the Ar-saturated electrolyte is swapped with the $CH_4$-saturated electrolyte, the $CH_4$ adsorbs on the transition metal oxide and reduces the number of active sites for OER. Switching the $CH_4$-saturated electrolyte back with the Ar-saturated electrolyte allows $CH_4$ desorption and an increase in the number of active sites for OER.

A reactive-impulse chronoamperometry (RIC) was performed in a rotating disk electrode cell by switching the Ar-saturated electrolyte with the $CH_4$-saturated electrolyte at a potential lower than the onset potential for MOR (e.g., 1.52 V verses RHE). The Ar-saturated and $CH_4$-saturated electrolytes were prepared by pre-saturating respective gasses in a 0.1 M potassium phosphate buffer at pH 7. The dynamic variation in the OER current density was measured by sequentially varying electrolyte feed in the following manner: first feeding Ar-saturated electrolyte for 10 to 15 min, followed by $CH_4$-saturated electrolyte, and then back to Ar-saturated electrolyte. $CH_4$-saturated electrolyte was found to suppress the OER current density, which could occur by either direct binding of $CH_4$ to the free active sites (*) or binding of $CH_4$ to the O atom of OER intermediates (*OH, *O, *OOH, and $*O_2$). Therefore, the fractional coverage of $*CH_4$ can be estimated by calculating the change in the OER current density:

$$\theta = \frac{I_{OER,Ar} - I_{OER,CH_4}}{I_{OER,Ar}}$$

where θ is the fractional coverage of the $*CH_4$ on the electrode surface, $I_{OER,Ar}$ is the OER current density in Ar-saturated electrolyte, and $I_{OER,CH_4}$ is the OER current density in the $CH_4$-saturated electrolyte. The equilibrium constant K for the $CH_4$ adsorption/desorption $$CH_4 + * \rightleftharpoons * CH_4$$

can be obtained from Evertt isotherm equation for a dissolved $CH_4$ in contact with a TMO surface.

$$K = \frac{\theta(1 - x^*}{x^*(1 - \theta)}$$

where x* is the mole fraction of dissolved $CH_4$ in the electrolyte. The binding energy can be estimated from the Gibbs free energy relation:

$$\Delta G = RT \ln(K)$$

where R is the universal gas constant (8.314 J $mol^{-1}$ $K^{-1}$) and T(298.15 K) is the temperature at which the experiments were performed.

Figure 3C:
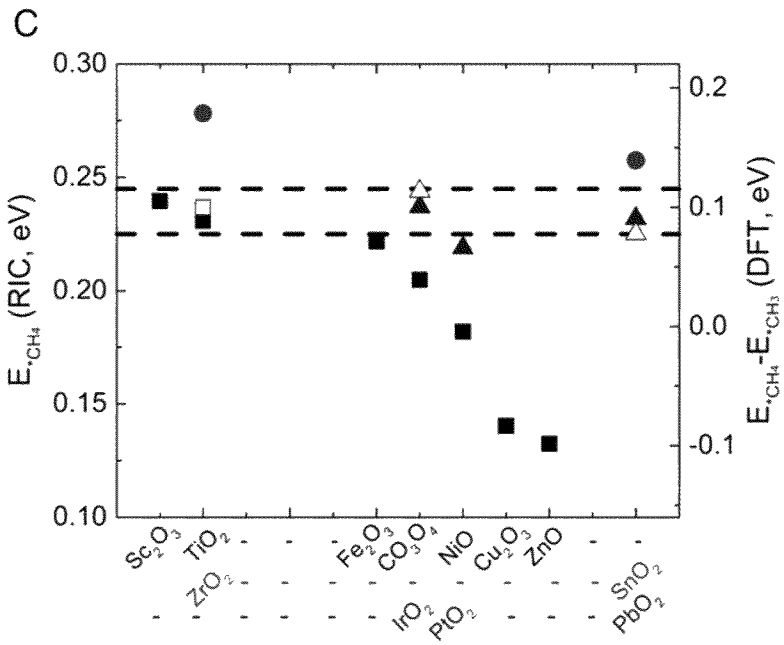

Referring to FIG. 3B, the effect of reversible adsorption/desorption on the OER current density is shown on $TiO_2$. FIG. 3C shows the binding energy of $*CH_4$ on 12 transition metal oxides in near-neutral pH electrolyte at 1.53 V verses RHE. The measured binding energy of $*CH_4$ decreased with increasing group number or decreasing the period number in the periodic table. A similar trend of adsorption energies of $CH_4$ on the transition metals has been reported. Referring to FIG. 3C, the binding energies of $CH_4$ on MOR active catalysts—$TiO_2$, $IrO_2$, and $PbO_2$, were similarly and in the range of 0.24±0.01 eV. $PtO_2$ was also observed to be a MOR active catalyst in neutral pH KCL electrolyte with the binding energy close to the optimal range. The free energy change for the first step of MOR ($E^*_{CH4}$–$E^*_{CH3}$) for $TiO_2$, $IrO_2$, and $PbO_2$ were similar. Therefore, it can be concluded that the binding energy of $CH_4$ is an activity descriptor for MOR, which governs only the surface coverage of $*CH_4$. The calculated surface coverages of $*CH_4$ on different transition metal oxides is shown in FIG. 16. The transition metal oxides with binding energies of $CH_4$ less than 0.23 eV were not active for MOR because of the lower surface coverages of $*CH_4$. However, there were are few catalyst such as $Sc_2O_3$, $ZrO_2$, and $SnO_2$ that had binding energies greater than 0.23 eV, and were not active for MOR. This is due to competitive active sides for OER and MOR present on these catalysts.

Example 3: Transient Open Circuit Potential Analysis

The open circuit potential (OCP) identifies a mixed potential (or corrosion potential) when the multiple redox reactions—OER and MOR—are in equilibrium at net zero currents. The variation in OCP can be related to the variation in the activity of reactants and products in the double layer. Transient Open Circuit Potential (t-OCP) measurement was used as means to identify key reaction intermediates in MOR. First, chronopotentiometry was performed to obtain a steady potential and FE at the desired current, which ensured fractional coverages of the reaction intermediates and also attained a steady state. Then, the applied current was shifted to zero and the t-OCP was recorded as the reaction intermediates go back from dynamic to status equilibrium. The t-OCP graph is sensitive to reaction pathways and coverages of stable reaction intermediates.

The t-OCP values for OER in Ar-saturated 0.1 M phosphate buffer were measured for initial currents of 0.25 mA and 0.5 mA in the H-cell described above. A $CH_4$ saturated phosphate buffer was transferred to the H—Cell and the open circuit potential was recorded until a stable value was obtained. The steady-state values of t-OCP were compared for 0.25 mA and 0.5 mA to verify the current-independent behavior of steady-state OCP for OER. The system was perturbed by performing chronopotentiometry at a fixed current density until a stable potential was obtained and then the current density was set to zero and once the system was stable, the open circuit potential (OCP) was recorded.

Next, the t-OCP values for MOR were measured for an initial current of 0.25 mA (at 1.8 V verses RHE) and 0.5 mA (at 2.1 V vs. RHE) on a $TiO_2$ disk as the electrocatalyst in a $CH_4$-saturated 0.1 M phosphate buffered solution. Since $CH_3OH$ is one of the possible intermediates of MOR, the variation of the fractional coverage of $*CH_3OH$ was anticipated to have a direct effect on the steady-state values of t-OCP.

The gray adsorbed species in FIG. 17A indicate the possible stable intermediates for MOR and to understand which reaction pathway is preferred, activity of methanol (being the first stable intermediate) oxidation was tested over a range of potentials. FIG. 17B shows the faradaic efficiency (FE) of methanol oxidation to $CO_2$ on $TiO_2$ and confirmed that methanol can be oxidized on $TiO_2$. However, the onset potential for methanol oxidation was 1.9V, which is higher than the onset potential of 1.65V for MOR on $TiO_2$. This confirmed that methanol is not an intermediate at lower potentials and the reaction may proceed purely through the $CH_x$ dissociation pathway.

Chronopotentiometry was performed keeping a constant current of 0.25 mA or 0.5 mA for approximately 30 minutes to let the system attain stability at 1.8V or 2.6V respectively. Current was then set to 0 and system was allowed to reach a stable OCP for each case and the shift in this OCP was observed as seen in FIG. 17C. For the experiments at 0.25 mA (1.8V), the shift in the OCP was observed from 176 mV for no $CH_3OH$ to 296 mV for 0.1M $CH_3OH$ manually introduced in the system indicating the shift in OCP was purely due to the addition of $CH_3OH$ as at 1.8V $CH_3OH$ cannot be oxidized to $CO_2$. The black curve at 0.5 mA (2.6V) in the absence of $CH_3OH$ shows that the OCP was 269 mV which is in between OCP values obtained at 0.25 mA with 0.1 M $CH_3OH$ and no $CH_3OH$. Without intending to be bound by theory, it is believed that this shift in OCP indicates that there may be $CH_3OH$ present as an intermediate in the system at higher potentials because the absence of $CH_3OH$ would have given a performance identical to the one without any manually introduced $CH_3OH$ at 0.25 mA. Hence, it is likely that MOR proceeds through two different mechanisms that are potential dependent. At lower applied potentials, MOR progresses through sequential $CH_x$ dissociation while at higher potential, MOR progresses through formation of methanol and in both cases, $CO_2$ is formed over $TiO_2$ as indicated in FIG. 17A.

To study the influence of methanol as a stable intermediate, varying concentrations of $CH_3OH$ were added to the electrolyte and a comparison of 6 chronopotentiometry experiments was done at 0.25 mA (1.8V) where there was only a single reactant species ($CH_4$). A calibration curve was prepared by measuring the change in the steady-state values of t-OCP for increasing $CH_3OH$ concentrations from 0 to 10 mM, added manually to the $CH_4$-saturated 0.1 M phosphate buffered solution. This calibration curve was used to identify $*CH_3OH$ produced at a higher current—0.5 mA.

Using the stable OCP values for different concentrations of manually introduced $CH_3OH$ from FIG. 17C, a calibration curve was plotted as seen in FIG. 18B relating concentration of methanol to the corresponding OCP. The OCP value of the higher current experiment (0.5 mA), was then used to identify the $*CH_3OH$ using this calibration curve which is indicated by the black star in FIG. 18B.

Open Circuit Potential Measurements for HCOOH Detection: OCP is similar to the Nernst potential for a single redox reaction, where the variation in the local concentration of reactants and products has a direct effect on its value. The stable OCP values were measured on $TiO_2$ for the initial current of 0.25 mA (1.8V) with increasing concentration of HCOOH—0, 2, 5, 10, and 100 mM added to the CH4-saturated phosphate buffer electrolyte and also for the higher current (0.5 mA, 2.6V) without added HCOOH. FIG. 19 shows the increase in stable OCP at steady-state with increasing logarithm of HCOOH concentration, which is similar to the Nernst relation. The increase in the OCP with the increase in concentration confirmed that there was an increase in *HCOOH formation (from $*CH_3OH$ oxidation) as the concentrations of other species—$CH_4$, $H^+$, $OH^-$, $H_2O$, and $O_2$ remained constant. The starred data point is the OCP at a higher current and without manually introduced HCOOH. This trend is similar to the observed shift in the OCP due to the presence of $CH_3OH$. The OCP must shift in the presence of all the intermediates forming along the pathway of MOR. This value also shifts above the OCP of the lower current experiment further supporting the argument of the reaction proceeding through a potential dependent pathway as seen in FIG. 17A.

Example 4: DFT Calculations to Estimate Binding Energies and Free Energy Profile Estimated energies of adsorption and the free energy profile of four metal oxide surfaces, $IrO_2$, $PbO_2$, $TiO_2$, and $SnO_2$ were calculated. Spin-Polarized Density functional theory (DFT) calculations were performed using the Vienna ab-initio Simulation Package (VASP) version 5.3.5. The metal oxide surfaces were modeled using a four-layer (4×4) periodic slab, and the successive slabs were separated by at least 25 Å of vacuum. Adsorption was allowed only one side of the slide. Partial occupancies for each orbital were populated using the Fermi smearing method with a width of 0.1 eV. The electronic wave-functions were expanded in a plane-wave basis set with an energy cutoff of 350 eV. Electron-ion interactions were described using the projector augmented wave (PAW) method in the form of pseudopotentials found in the VASP library. All bare surfaces were fully relaxed using the ISIF=4 tag in VASP at a 1×1×1 Monkhorst-pack k-point mesh and a force tolerance of 0.03 eV/Å using the Perdew-Burke-Ernzerhof (PBE) functional with Grimme's D3 corrections. All subsequent models were constructed from these optimized structures and were relaxed with the same lattice. Here, the surface was held static while the adsorbate was allowed to fully relax in all directions. All adsorbates began 2.0 Å above the desired binding site, subsequently damped molecular dynamics was used to optimize the system. These optimizations were done at a 1×1×1 Monkhorstpack k-point grid and a force tolerance of 0.03 eV/Å. Successive self-consistent calculations for the energies were performed at a 4×4×1 Monkhorst-pack k-point mesh. FIG. 32 shows the convergence of energy with respect to planewave cutoff and irreducible k-points. Energetics were sampled at a 350 eV planewave cutoff and 4×4×1 k-points mesh, which were deemed sufficient as increasing the planewave cutoff to 450 eV changed adsorption energy on the order 0.02 eV and increasing the k-point mesh lead to 0.01 eV changes. All visualization of the systems was done in Visualization for Electronic and Structural Analysis (VESTA).

There are various variables that can potentially impact the reaction pathways of oxygen evolution and methane oxidation reactions on the metal oxide surfaces, including surface coverage, the chosen intermediates for the reaction, binding sites for the intermediates, defects on the samples, and solvation effects. FIG. 20 is a pictorial representation of binding sites utilized. Showing with the "+" symbol where each intermediate is bound. The larger circles represent metal atoms, while the smaller circles represent oxygen atoms. The table below illustrates a symbolic representation of the binding sites and surfaces studied.

| | | |
|---|---|---|
| Oxygen evolution reaction | Reduced | M |
| | Oxidized | M MOM |
| Methane oxidation reaction | Oxidized | M&O MOM M—O |

Referring to FIGS. 17A and 21, reaction profiles for the oxygen evolution reaction demonstrated that the oxygen evolution reaction was not readily catalyzed on the fully oxidized surfaces in all cases except for $PbO_2$. Referring to FIG. 18A, for $PbO_2$ it was found that the surface readily catalyzed oxygen evolution reaction at the bridging oxygen binding site, which only exists on the oxidized surfaces. Without intending to be bound by theory, it is believed that the bridging oxygen on $PbO_2$ is easily abstracted as show in FIG. 22. For all other of the metal oxide surfaces, the oxygen evolution reaction was freely catalyzed on the reduced surface at the metal center binding site.

It was observed that intermediates, which began on a metal center, optimized to bind on non-bringing oxygen or between the oxygen and the metal center. The different in energy between the two binding sites, a metal center or a non-bridging oxygen, was found to be negligible. Therefore, in the calculations herein, the binding sites were combined into one category, which included the version of the system that was lowest in energy. Energetically, methane oxidation reaction was not found to readily occur on any of the surfaces except $SnO_2$.

An alternative mechanism beginning with methanol as listed below:

$$*+CH_3OH(g) \rightarrow *OCH_3+\tfrac{1}{2}H_2(g)$$

$$*OCH_3 \rightarrow *OCH_2+\tfrac{1}{2}{}_2(g)$$

$$*OCH_2 \rightarrow *OCH+\tfrac{1}{2}H_2(g)$$

$$*OCH \rightarrow *CO+\tfrac{1}{2}H_2(g)$$

$$*CO+H_2O(g) \rightarrow *+CO_2(g)+H_2(g)$$

The first step in the catalytic cycle is much higher in energy than the first step of a methane oxidation reaction beginning with methane indicating that at the potential of 2.114 volts methane oxidation reaction is likely occurring with methane gas. However, it is thermodynamically favorable for the methane oxidation reaction to occur through methanol on $IrO_2$ which demonstrates that the methanol pathway maybe plausible for methane oxidation reaction under certain conditions

Example 5: $Cu_2O_3$—$TiO_2$ Bimetallic Catalyst for Methanol Synthesis

A $Cu_2O_3$—$TiO_2$ bimetallic catalyst was prepared as described in Example 1. Under oxidative potentials >1.4V vs RHE, $TiO_2$ overcomes the barrier for $*CH_4$ dissociation to yield $CH_x$ (x=1-3) such that the MOR results in $CO_2$ production. To produce $CH_3OH$, the $*CH_3$ bound on a TMO site must be in the vicinity of another TMO site which would readily provide *OH. Cu has the lowest barrier for the reaction of $*CH_3$ with *OH. The $Cu_2O_3$—$TiO_2$ bimetallic catalysts were successfully used to generate $CH_3OH$. Referring to FIG. 23, the FE of $CH_3OH$ oxidation on $TiO_2$ and $Cu_2O_3$ is shown and it can be seen that a very high potential is needed to oxidize $CH_3OH$ to $CO_2$ on $Cu_2O_3$. Without intending to be bound by theory, it is believed that not only does Cu ($Cu_2O_3$ under oxidative potential) provides a lower barrier for $*CH_3$ and *OH, but also restricts the MOR to $CH_3OH$. The use of the bimetallic catalyst is believed to overcome the $*CH_4$ dissociation barrier using the active sites of $TiO_2$ while restricting the reaction to $CH_3OH$ on the $Cu_2O_3$ active sites.

$1D^1$ H-NMR spectroscopy was performed to qualitatively determine the presence of methanol as an MOR product for $Cu_2O_3$—$TiO_2$ catalyst. NMR spectra were acquired using Bruker DRX 500 MHz equipped with BBO probe at 25° C. A 1 mM methanol in water was used as a control sample to check the spectrometer's capability of detecting methanol which was followed by the analysis of the 0.1 M phosphate buffer electrolyte post-MOR at 2.31 V vs RHE using $Cu_2O_3$—$TiO_2$ catalyst. The samples analyzed were diluted by adding 10% $D_2O$ for deuterium locking and referencing. A total of 8 transient scans were recorded for each sample tested that were sufficient to qualitatively justify the presence of methanol in the post-MOR electrolyte. FIG. 24 shows the $1D^1H$ NMR spectra of methanol-water solution and post-MOR phosphate buffer electrolyte both showing the peak for the proton from methanol at 3.23 and 3.22 ppm respectively which matches with the spectra observed by Kuhl et al, *New insights into the electrochemical reduction of carbon dioxide on metallic copper surfaces. Energy & Environmental Science* 5(5):7050-7059 (2012). The 0.01 ppm shift can be attributed to the presence of the buffer solution.

The liquid products of MOR were quantified using HPLC on Agilent Infinity 1260 II HPLC with a 300 mm×7.5 mm Agilent Hiplex-H column and a refractive index detector (RID). The isocratic elution flow rate of the mobile phase containing 1 mM $H_2SO_4$ was 0.6 mL/min. The column temperature was 60° C., and the RID temperature was 35° C. A 10 μL of the sample was injected into the column through an autosampler and the products were analyzed for the retention time up to 30 mins. This operating method was developed by observing the retention times of the electrolyte and resolving the peaks for possible MOR products: HCOOH, HCHO, and $CH_3OH$. The only liquid product detected in the post-electrolysis samples using a $Cu_2O_3$—$TiO_2$ catalyst was $CH_3OH$. To measure the concentration of $CH_3OH$, a calibration curve was prepared for the $CH_3OH$ concentration range of 0.5 mM to 12.5 mM. FIG. 25 shows the linear increase in the RID peak area relative to the blank mobile phase with increasing $CH_3OH$ concentration. The values of average retention time with the relative peak area are given in the table below.

| Concentration (mM) | Relative Peak Area | Average Retention Time (min) |
|---|---|---|
| 12.5 | 2.08 | 20.02 |
| 6.25 | 1.52 | 20.26 |
| 3.125 | 1.12 | 19.88 |
| 1 | 1.04 | 20.29 |
| 0.5 | 1.00 | 20.08 |

The post-electrolysis samples were analyzed to measure $CH_3OH$ concentration. FIG. 26 shows RID relative peak area at different applied potentials relating to the total concentration of $CH_3OH$ present at the end of each experiment.

After the concentration of $CH_3OH$ was determined, the FE of $CH_3OH$ was calculated using:

$$FE_{CH_3OH}(\%) = \frac{C_{CH_3OH} \times V \times n \times F}{t \times A \times I_{total}}$$

where $C_{CH_3OH}$ is the concentration of $CH_3OH$ detected from HPLC, V is the volume of electrolyte, n is the number of electrons transferred per mol of product (n=2), F is Faraday's constant, tis the total time for the reaction, A is the geometric surface area, and $I_{total}$ is the total current density observed during the chronoamperometry.

Example 6: Patterned $CuTiO_2$ Bimetallic Catalysts

Catalyst Synthesis

Planar Cu—Ti Bi-metallic catalyst: The Cu—Ti bimetallic catalyst was synthesized by electrodepositing Cu using $Cu(NO_3)_2$ as a source of Cu. A membrane-less H-cell was used for electrodeposition. A 0.1 M solution of $Cu(NO_3)_2$ (pH=2) was sparged with Ar for 30 minutes at 50 sccm and then introduced into the H-cell. A weighed Ti disc was then immersed in the solution, and chronoamperometry was performed by applying −2V (vs. Ag/AgCl) at the Ti disc for 45 minutes. This time was sufficient to deposit enough Cu to cover most of the surface of the disc. The disc was then taken out of the solution and rinsed thoroughly with DI water and dried under Ar. The dried disc was weighed to determine the loading percentage of Cu using:

$$\% \text{ loading} - \frac{(W_{final} - W_{initial})}{W_{initial}} \times 100$$

where $W_{initial}$ is the initial weight of the Ti disc before electrodeposition and $W_{final}$ is the final weight after electrodeposition.

Sputtered Patterned Cu—Ti Bi-metallic catalyst: The patterned Cu—Ti bi-metallic catalyst was synthesized by sequentially sputtering coating Cu and Ti on a gas diffusion layer (GDL). Unless stated otherwise herein the pattern was a 4×4 mm square pattern. FIG. 4A provides a schematic illustration of the catalyst synthesis process. In particular, two masks with square patterns complementing each other were designed in SOLIDWORKS and printed using a PMMA clear resin in a FormLabs Form 2 3D printer. The printed parts were then washed with isopropyl alcohol for 30 mins and UV cured for 3 hours. All the experiments were performed in this 3D printed cell. The resin used is resistant to harsh chemical environments. The square patterns of the two masks were arranged so that the voids of the first mask would be blocked by the second mask and vice versa. A Sigracet 22b (Fuel Cell Store) was used as the GDL. A 40×40 mm of the GDL was cut and placed on the sputter coating sample holder and was covered with the first mask. A Quorum EMS 150ES plus sputter coater was used along with a film thickness monitor to sputter 50 nm of Cu with a sputtering current of 100 mA. The mask acts as the obstruction and allows the Cu to be sputtered only on the void square regions of the mask. Once Cu is sputtered, the first mask is replaced by the second one, and the sputtering target is changed from Cu to Ti. The second mask blocks the already sputtered Cu, and 50 nm of Ti is sputtered with the sputtering current of 150 mA on the blank squares Catalyst Characterization Scanning electron microscopy (SEM) for pre and post-MOR bimetallic catalyst was done using Hitachi SU8030 Field Emission SEM. The image scans were done at accelerating voltage between 2 and 10 kV and 10 μA of emission current at varying magnifications. The signal from both upper and lower detectors was enabled to get the maximum signal collection.

X-ray photoelectron spectroscopy (XPS) for the bimetallic catalyst before and after MOR was done using Thermo Scientific ESCALAB 250XI microprobe with an Al Kα source. The beam diameter was set to an optimal value of 500 μm. Each analysis consisted of a survey scan to check for impurities and an elemental scan to access the chemical state of the catalyst. All the XPS spectra were corrected for charge shift using C 1s at 284.8 eV as the reference. For maximum signal to noise ratio, at least 10 spectra were acquired for the survey scan and 20 were acquired for the individual elemental scans for Cu and Ti.

Distinct Cu and Ti zones can be seen in the SEM image from FIG. 27A. A clear boundary is seen where the Cu and the Ti regions meet. This provided visual proof of a successful patterned sputtering synthesis using the 3D printed masks.

Post-MOR characterization of this patterned catalyst gave more insights into the structural changes in the catalyst, as seen in FIG. 27B. The SEM image shows that the pattern still exists but was not as regular as the pre-MOR catalyst. There was some overlap of Cu patterns into Ti patterns, as seen from the zoomed-in inset. This happened as the oxides develop on the catalyst surface under oxidative potentials. Similar behavior was observed in the planar catalysts, where the post-MOR catalysts attained rougher texture due to surface oxidation. The XPS analysis from FIGS. 27C and 27E confirmed that Ti and Cu were in their elemental state with no characteristic shift in peaks or satellite peaks visible before MOR, suggesting that the sputtered catalyst was initially a bimetallic catalyst with Cu (0) and Ti (0) metals. The post-MOR XPS spectra confirmed the formation of oxides in FIGS. 27D and 27F. In FIG. 27D, the binding energy shifted higher due to the presence of the electron-withdrawing groups (i.e., oxygen), and distinct peak shifts were observed, indicating the formation of $TiO_2$. In FIG. 27F, a similar peak shift was observed, along with the presence of mixed oxides of Cu. Post-MOR Cu interface consisted of Cu(0), partially oxidized $Cu^+$ indicating the presence of $Cu_2O$, and the satellite $Cu^{2+}$ peaks indicating the formation of CuO. This characterization was evident of the formation of oxides and MOR activity arising from the interface of the Cu and Ti oxides.

Electrochemical Measurements

The electrochemical experiments were performed using a BioLogic SP300 dual-channel potentiostat. A custom flow-through GDE electrochemical cell was designed using SolidWorks 2018, and 3D printed using a FormLabs Form 2 3D printer with a clear resin. The resin was tested to be stable in aqueous solutions of a wide range of pH (1-14). The printed cell was then washed in 70% iso-propyl alcohol for 30 mins, and then UV cured for 60 mins. The schematic diagram of the cell is seen in FIG. 28. The electrochemical cell employed a 3-electrode system with the patterned bi-metallic catalyst being the working electrode, Pt plate (99.99%, ACI Alloys) as the counter electrode, and an Ag/AgCl micro-reference electrode (Innovative Instruments). The working and the counter compartment were separated by a SnowPure Excellion anion-exchange membrane (AEM). The electrolyte used for all the MOR experiments was near-neutral 1 M KCl at pH 6.89. $CH_4$ was sparged across the flow-through GDE at 50 sccm. All the experiments were performed at constant anodic currents by chronopotentiometry.

Product Quantification

Gas Chromatography (GC): The GC was performed to detect MOR products such as $O_2$ and $CO_2$ using an SRI GC 8610C MG #5 that employed a flame ionization detector (FID) and a thermal conductivity detector (TCD). A 6' HaySep D column was used to separate smaller molecules like $CH_4$ and $O_2$ from $CO_2$ in tandem with a 6' MolSieve column to separate $O_2$ from $CH_4$. An isothermal temperature profile was set at 90° C. with a run time of 13 mins. $O_2$ was detected in the MolSieve column by TCD, while $CH_4$ and $CO_2$ were detected using FID. Ar (99.99%, Praxair) was used as the carrier gas at 20 psi. $H_2$ at 26 psi and internal compressed air at 6 psi to ignite the flame for FID. During MOR, the gaseous products were measured at the interval of 15 mins.

High-Pressure Liquid Chromatography (HPLC): An Agilent Infinity 1260 II HPLC was employed to detect the liquid products of MOR. The HPLC was incorporated with a 300 mm×7.5 mm Agilent Hi-plex-H column to specifically separate small organic acids, alcohols, aldehydes, and ketones. This column was ideally suited for our application here as the likely liquid products from MOR fall in this category. The detection was done using a refractive index detector (RID) with a sampling rate of 4 Hz. An isocratic elution flow rate of 0.6 mL/min was maintained for the mobile phase 1 mM $H_2SO_4$. The column temperature was 60° C., and the RID temperature was 35° C. A 10 μL of the sample was injected into the column. The autosampler needle had a drive speed of 5 L/s for taking in the sample from the vials and an ejection drive speed of 10 L/s. The products were analyzed for retention time up to 30 mins. This operating method was developed and optimized by observing the retention times of the electrolyte and resolving the peaks for the possible MOR products: HCOOH, HCHO, and $CH_3OH$. After 1 hour of a constant current experiment, two samples of 1 mL each from anolyte and catholyte were taken in two separate vials, and the chromatography method was run to analyze the concentration of the MOR liquid products. Since an AEM separates the anolyte and the catholyte, there is a possibility that the products formed in the anolyte may diffuse to the catholyte side. Hence, the samples were taken from both the compartments to ensure a more precise measurement of the liquid products formed during MOR.

MOR Activity of a Planar Cu—Ti Bimetallic Catalyst

Initially, the performance of the electrodeposition-synthesized Cu—Ti catalyst was tested to verify its activity across a wide range of MOR overpotentials. Referring to FIG. 29A, the Cu-oxide sites were observed to be a rich source for *OH active sites that could provide the appropriate oxygenated pathway for the $*CH_3$ active sites on $TiO_2$. FIG. 29B shows the evaluation of $CH_3OH$ FE under various overpotentials. The FE increased to a maximum of ~6% at an applied potential of 2.2V vs. RHE and then started reducing under higher oxidation potentials. The reason for the reduction in FE is two-fold. Under high overpotentials, the $CH_3OH$ formed tends to over-oxidize to $CO_2$, and a decay in the $CH_3OH$ FE is observed. Moreover, the planar metal catalyst was also not very stable under high potentials.

The electrodeposited Cu islands on $TiO_2$ started to erode from the $TiO_2$ surface. This caused the loss in the activity of the catalyst towards $CH_3OH$ formation. Since $TiO_2$ is a semiconductor, even a significant increase of 200 mV in the oxidation potential increases the total current density marginally. Both these factors led to the production of $CO_2$ over $CH_3OH$ at higher oxidation potentials under high oxidation potentials. The planar bimetallic catalyst also showed a very low current density for the MOR experiments. The maximum total current density achieved at the highest $CH_3OH$ FE was only ~5.5 mA/cm$^2$, and the maximum total current density at the highest overpotential was ~15 mA/cm$^2$. These low rates indicate that even with more energy provided to this electrochemical system, the flux of product formation would not be high enough to see any potential scale-up applications.

MOR Activity of a Patterned Cu—Ti Bimetallic Catalyst

The MOR activity of the patterned catalysts was conducted using chronopotentiometry at constant oxidation current densities of 10, 20, 30, and 40 mA/cm$^2$. Referring to FIG. 4B, a significant improvement over the planar catalyst was seen, where the total achievable current densities reached up to 40 mA/cm$^2$. This was about 2.5 times higher than the total current densities obtained with the planar catalyst. Improved activity and selectivity of the MOR for the patterned catalyst was also observed. An additional MOR partial oxidation product, HCOOH, was formed. The total MOR FE increased up to 14% with $CH_3OH$ efficiency as high as 6.5%.

An auxiliary experiment was also conducted using a sputtered catalyst prepared without the patterned masks. 50 nm Ti was initially sputtered, and then 50 nm of Cu was sputtered on top of it. This experiment did not yield any MOR activity, suggesting that the significant MOR activity found in the patterned catalyst is due to the presence of the Cu—Ti boundaries.

Effect of Pattern Size on MOR Activity

The effect of the pattern size was tested by reducing the pattern size from 4×4 mm patterns to 3×3 mm and 1×1 mm patterns. The reducing in pattern size introduced more interfaces between Cu and Ti per unit area of the catalyst. Due to the resolution limitations of 3D printing, a 1×1 mm mask was the smallest reliable resolution that could be fabricated at the time of the experiment.

FIG. 4C shows the effect of pattern size on the MOR activity at the highest current density 40 mA/cm$^2$). The MOR activity increased as pattern size decreased. There was a significant increase in MOR activity from the 4×4 mm pattern (14% FE) as compared to the 1×1 mm pattern size (28% FE). The activity towards MOR doubled at the lowest pattern size with the highest $CH_3OH$ FE of 18%. Moreover, the total current density increased to almost 8 times high (40 mA/cm$^2$) than previously reported current density at maximum FE of $CH_3OH$ (5 mA/cm$^2$).

FIG. 4F shows the comparison of the 1×1 mm square-patterned Cu—Ti bimetallic catalyst with the existing literature on ambient electrochemical MOR. It can be seen that the catalyst in accordance with the disclosure was able to sustain a high total current density of 40 mA/cm$^2$, which to our knowledge is the highest reported current density. Even with the MOR FE of ~28%, the MOR partial current density for this catalyst was 11.2 mA/cm$^2$, which is higher than the total current density of most of the reported conventional catalyst and methods.

Effect of Anions on MOR of Patterned Catalysts

The effect of anions was tested by changing the electrolyte solution from 1 M KCl to 1 M $KNO_3$ and 1 M potassium phosphate buffer solution (PBS, $KH_2PO_4/K_2HPO_4$). The $K^+$ cations were kept the same to evaluate the effect of different anions exclusively. FIG. 4D shows the effect of anions on the MOR activity towards partial oxidation products—HCOOH and $CH_3OH$. The presence of $Cl^-$ significantly enhanced MOR activity towards methanol. The presence of $Cl^-$ likely acts as a promoter towards MOR activity on the patterned bimetallic catalyst, where $$NO_3^-$$

and PBS may poison the active sites or reduce the activation barriers for OER. The $Cl^-$ promotion effect was previously observed only on platinum catalysts, where it was observed that specifically adsorbed chloride enabled facile oxidation of the catalyst while preventing a concomitant overoxidation of $CH_3OH$ to $CO_2$. Conversely, the phosphate was observed to poison the catalyst such as Pt by strongly adsorbing to MOR active sites. FIG. 30 shows the $CO_2$ peak from GC after performing a control experiment using 1 M KCl as the electrolyte at 2.31 V vs RHE with a $PtO_2$ catalyst to test for activity for MOR.

Effect of Temperature on MOR Activity

Conventionally, electrochemical MOR has been practiced at elevated temperatures in an aqueous electrochemical or a fuel cell-based setup. Operating at a higher temperature reduces the activation barrier associated with the cleavage of the first C—H bond and consequently leads to a better MOR performance. A similar observation was made and is illustrated in FIG. 4E, where the MOR activity significantly increased at 40° C. The overall MOR FE reached ~72% at this elevated temperature which is ~2.5 times higher than the MOR FE of ~28% under ambient conditions.

Exampled 7: DFT Analysis of $Cl^-$ Promoted MOR on Bimetallic $CuTiO_2$ Catalyst It has been observed that catalyst active towards methanol formation will simultaneously bind OH weakly (about +0.7 eV) and bind CO strongly (about −1.5 eV). The binding free energies of hydroxide and carbon monoxide separately on $Cu_2O$ (111) and $TiO_2$ (110) were calculated and the results are shown in the table below.

| Catalyst | $\Delta G_{OH}$/eV | $\Delta G_{CO}$/eV |
|---|---|---|
| $Cu_2O$ (111) | −0.3 | −1.5 |
| $TiO_2$ (110) | +1.8 | +0.3 |

Taken alone, neither catalyst is predicted to be active towards MOR. $Cu_2O$ binds OH too strongly, and $TiO_2$(110) binds CO too weakly. A number of configurations of $Cu_2O$ supported on titania were investigated to find a single active site that simultaneously bound OH weakly and CO strongly. None of the possible interfacial sites investigated were found to have this property. CO was observed to strongly prefer binding to copper, as suggested by the binding energies calculated in the table above. This supports the conclusion that MOR on the bimetallic catalyst occurs on at least two separate active sites. Without intending to be bound by theory, it is believed that the more oxophilic titania transfer oxygen to methoxy which is bound to copper. This is supported by the testing in Example 6, which demonstrated a positive trend in FE towards MOR with reduced template size. The reduced template size corresponds to a shorter diffusion length-scale needed to couple OH bound on titania and methoxy bound on copper oxide.

Figure 31B:
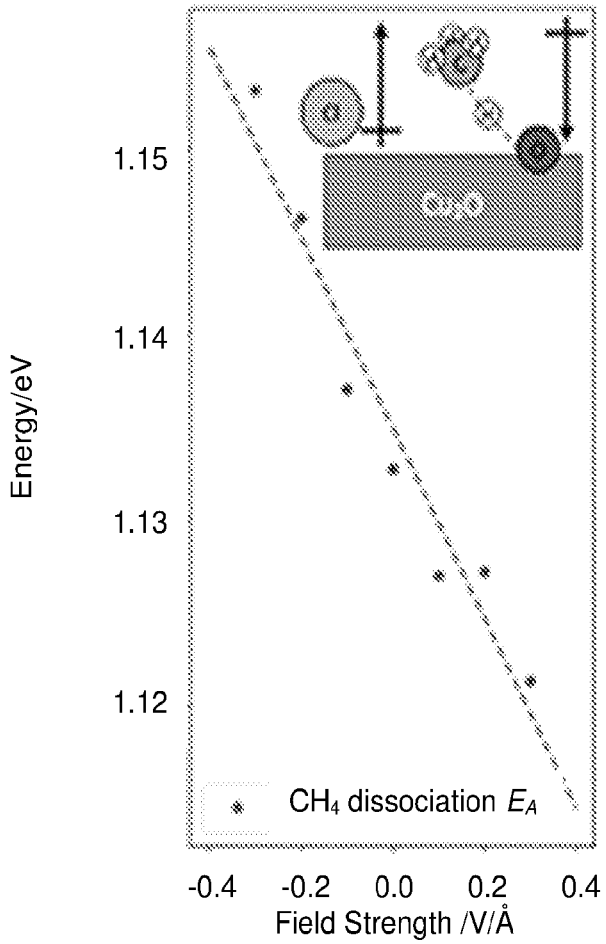

To investigate the possibility of specifically adsorbed chloride on $Cu_2O$ (111) promoting the activation of methane dissociation, the activation barrier of methane dissociation on $Cu_2O$ (111) in the presence of a uniform electric field using was determined and is illustrated in FIG. 31A. Although methane has no significant dipole moment, and the transition state has only a weak dipole moment, the strong local electric fields exerted by specifically adsorbed chloride ions can have a substantial effect on the overall rate of reaction. As the local electric field strength is increased (more positive fields represent higher chloride coverage), the activation barrier of the methane dissociation is decreased. While the scale of the y-axis in FIG. 31B is quite small, the local electric field near a specifically adsorbed chloride ion is likely much higher. It is known in the art that cations in the double layer above Cu(111) exert a local electric field of a magnitude of about 1 V/Å. A similar (but opposite sign) electric field strength in the case of chloride promotion of methane activation corresponds to a reduction in the activation barrier of about 0.05 eV. Assuming an Eyring-like rate expression, i.e.

$$\text{rate} = \frac{k_B T}{h}\exp\left[-\frac{\Delta G_A}{k_B T}\right]$$

this reduction in the barrier corresponds to a nearly order of magnitude increase in the rate at room temperature. This result suggests that specifically adsorbed chloride can act as a promoter for methane activation, often thought to be the rate determining step for MOR.

Many modifications and other embodiments disclosed herein will come to mind to one skilled in the art to which the disclosed compositions and methods pertain having the benefit of the teachings presented in the foregoing descriptions. Therefore, it is to be understood that the disclosures are not to be limited to the specific embodiments disclosed and that modifications and other embodiments are intended to be included within the scope of the appended claims. Although specific terms are employed herein, they are used in a generic and descriptive sense only and not for purposes of limitation.

It is also to be understood that the terminology used herein is for the purpose of describing particular aspects only and is not intended to be limiting. As used in the specification and in the claims, the term "comprising" can include the aspect of "consisting of." Unless defined otherwise, all technical and scientific terms used herein have the same meaning as commonly understood by one of ordinary skill in the art to which the disclosed compositions and methods belong. In this specification and in the claims which follow, reference will be made to a number of terms which shall be defined herein.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

The use of the terms "a," "an," "the," and similar referents in the context of the disclosure herein (especially in the context of the claims) are to be construed to cover both the singular and the plural, unless otherwise indicated. Recitation of ranges of values herein merely are intended to serve as a shorthand method of referring individually to each separate value falling within the range, unless otherwise indicated herein, and each separate value is incorporated into the specification as if it were individually recited herein. The use of any and all examples, or exemplary language (e.g., "such as") provided herein, is intended to better illustrate the disclosure herein and is not a limitation on the scope of the disclosure herein unless otherwise indicated. No language in the specification should be construed as indicating any non-claimed element as essential to the practice of the disclosure herein.

What is claimed is:

1. An electrochemical cell for conversion of methane to methanol and/or formate, comprising:

an anode compartment comprising an anode, the anode comprising or having dispose thereon a bimetallic catalyst, the bimetallic catalyst comprising a patterned arrangement of a first metal region and a second metal region disposed on a support, wherein methane is converted to methanol and/or formate when methane contacts the bimetallic catalysts;

a gas inlet in fluid communication with the anode compartment for introduction of methane into the anode compartment and arranged such that methane flows in contact with and/or through the bimetallic catalyst;

a cathode compartment comprising a cathode;

a membrane separating the anode compartment and the cathode compartment;

one or more electrolytes disposed in and/or flowed through the anode and cathode compartments; and a product outlet in fluid communication with the anode compartment for collection of the methanol and/or formate after conversion;

wherein in the patterned arrangement the first and second metal regions are arranged in a uniform alternating fashion across the catalyst with an interface defined between adjacent ones of the first and second metal regions, wherein each of the first metal regions comprises one or more of Cu, Pd, Ag, and Ni, and each of the second metal regions comprises one or more of Ti, Ir, Ru, Sn, Pb, and Pt.

2. The electrochemical cell of claim 1, wherein the electrolyte comprises Cl ions.

3. The electrochemical cell of claim 1, wherein each of the first and second metal regions is square-shaped, triangular, hexagonal, and/or circular.

4. The electrochemical cell of claim 1, wherein each of the first metal regions is copper and each of the second metal regions is titanium.

5. The electrochemical cell of claim 1, wherein the cell is a flow-through cell and comprises a catholyte tank in fluid communication with the cathode compartment to circulate electrolyte through the cathode compartment and an anolyte tank in fluid communication with the anode compartment to circulate electrolyte through the anode compartment.

6. The electrochemical cell of claim 1, wherein the membrane is an ion exchange membrane.

7. The electrochemical cell of claim 1, wherein the anode comprises a sectioned anode having two or more sections each comprising the bimetallic catalyst.

8. The electrochemical cell of claim 1, wherein the anode compartment surrounds the cathode compartments and the membrane disposed between the anode and cathode compartments and wherein the anode comprises a sectioned anode having two more sections each comprising the bimetallic catalyst.

9. The electrochemical cell of claim 8, wherein the membrane is a semi-permeable membrane.

10. The electrochemical cell of claim 1, wherein the support is a gas diffusion layer.

11. The electrochemical cell of claim 1, wherein the cell has a faradaic efficiency of methanol production of about 6% to about 20%.

12. The electrochemical cell of claim 1, wherein each of the first metal regions comprises copper and each of the second metal regions comprises one or more of Ti, Ir, Pb, and Pt.

13. A process for converting methane to methanol and/or formate using the electrochemical cell of claim 1, comprising:

flowing methane and/or a methane containing source in contact with the bimetallic catalyst, wherein upon contact with the bimetallic catalyst the methane is converted to methanol and/or formate at the interface between the first and second metal regions.

14. The process of claim 13, wherein the process has a faradic efficiency of methanol production of about 6% to about 20% and/or wherein the process has a faradic efficiency of methane oxidation reaction of about 10% to about 80%.

15. The process of claim 13, comprising applying a potential of about 1.5V to about 3V while flowing the methane in contact with the bimetallic catalyst.

16. The process of claim 13, comprising performing the process at room temperature.

17. The process of claim 13, wherein the methane containing source is biogas, natural gas, and/or mining gas.

* * * * *